US008950465B2

(12) United States Patent
Lin et al.

(10) Patent No.: US 8,950,465 B2
(45) Date of Patent: Feb. 10, 2015

(54) ALUMINUM ALLOYS, ALUMINUM ALLOY PRODUCTS AND METHODS FOR MAKING THE SAME

(71) Applicant: Alcoa Inc., Pittsburgh, PA (US)

(72) Inventors: Jen C. Lin, Export, PA (US); James R. Fields, Export, PA (US); Albert L. Askin, Lower Burrell, PA (US); Xinyan Yan, Murrysville, PA (US); Ralph R. Sawtell, Gibsonia, PA (US); Shawn Patrick Sullivan, Oakmont, PA (US); Janell Lyn Abbott, New Stanton, PA (US)

(73) Assignee: Alcoa Inc., Pittsburgh, PA (US)

( * ) Notice: Subject to any disclaimer, the term of this patent is extended or adjusted under 35 U.S.C. 154(b) by 0 days.

(21) Appl. No.: 13/694,457

(22) Filed: Dec. 3, 2012

(65) Prior Publication Data

US 2013/0160963 A1 Jun. 27, 2013

Related U.S. Application Data

(62) Division of application No. 12/657,099, filed on Jan. 12, 2010, now Pat. No. 8,349,462.

(60) Provisional application No. 61/187,183, filed on Jun. 15, 2009, provisional application No. 61/221,943, (Continued)

(51) Int. Cl.

| | |
|---|---|
| ***B22D 17/00*** | (2006.01) |
| ***B22D 25/00*** | (2006.01) |
| ***C22C 21/00*** | (2006.01) |

(Continued)

(52) U.S. Cl.

CPC ..... *B22D 25/00* (2013.01); *B22D 17/00* (2013.01); *C22C 21/00* (2013.01); *C25D 11/04* (2013.01); *C25D 11/18* (2013.01)

USPC ..... 164/113; 164/69.1; 164/76.1

(58) Field of Classification Search

USPC ..... 164/69.1, 76.1, 113

See application file for complete search history.

(56) References Cited

U.S. PATENT DOCUMENTS

| | | | | |
|---|---|---|---|---|
| 2,612,666 | A | 10/1952 | McGarigal | 22/68 |
| 2,885,286 | A | 5/1959 | Weber et al. | 75/138 |

(Continued)

FOREIGN PATENT DOCUMENTS

| | | |
|---|---|---|
| EP | 0845812 | 6/1998 |
| EP | 1205567 | 5/2002 |

(Continued)

OTHER PUBLICATIONS

Banghong, H., et al., "Development of Precision Forming Technologies for Magnesium Components," *Singapore Institute of Manufacturing Technology,* Precision Metal Forming Group, Process Technology Division, pp. 1-8, (2001).

(Continued)

*Primary Examiner* — Kevin P Kerns

(74) *Attorney, Agent, or Firm* — Greenberg Traurig, LLP

(57) ABSTRACT

Decorative shape cast products and methods, systems, compositions and apparatus for producing the same are described. In one embodiment, the decorative shape cast products are produced from an Al—Ni or Al—Ni—Mn alloy, with a tailored microstructure to facilitate production of anodized decorative shape cast product having the appropriate finish and mechanical properties.

8 Claims, 60 Drawing Sheets
(29 of 60 Drawing Sheet(s) Filed in Color)

Related U.S. Application Data filed on Jun. 30, 2009, provisional application No. 61/269,660, filed on Jun. 26, 2009, provisional application No. 61/160,631, filed on Mar. 16, 2009, provisional application No. 61/145,416, filed on Jan. 16, 2009.

(51) Int. Cl.
*C25D 11/04* (2006.01)
*C25D 11/18* (2006.01)

(56) References Cited

U.S. PATENT DOCUMENTS

| | | | | |
|---|---|---|---|---|
| 3,043,754 | A | 7/1962 | Hollingsworth et al. | 204/29 |
| 3,107,159 | A | 10/1963 | Fetzer et al. | 29/195 |
| 3,150,967 | A | 9/1964 | Moltering | 75/141 |
| 3,151,948 | A | 10/1964 | Steeves et al. | 29/145 |
| 3,326,728 | A | 6/1967 | Robinson et al. | 148/6.1 |
| 3,704,209 | A | 11/1972 | Patrie | 204/35 N |
| 3,704,210 | A | 11/1972 | Patrie | 204/35 N |
| 3,709,742 | A | 1/1973 | Jacobs et al. | 148/6.1 |
| 3,769,180 | A | 10/1973 | Gedde | 204/35 N |
| 3,989,548 | A | 11/1976 | Morris | 148/2 |
| 4,847,048 | A | 7/1989 | Nishi et al. | 420/547 |
| 4,973,523 | A | 11/1990 | Neuhaus et al. | 428/653 |
| 4,976,918 | A * | 12/1990 | Nishi et al. | 420/546 |
| 5,076,344 | A | 12/1991 | Fields et al. | 164/457 |
| 5,246,055 | A | 9/1993 | Fields et al. | 164/61 |
| 5,259,436 | A | 11/1993 | Yun et al. | 164/97 |
| 5,290,424 | A | 3/1994 | Mozelewski et al. | 205/116 |
| 5,318,641 | A | 6/1994 | Masumoto et al. | 148/403 |
| 5,370,171 | A | 12/1994 | Fields et al. | 164/312 |
| 5,417,819 | A | 5/1995 | Askin et al. | 428/687 |
| 5,435,373 | A | 7/1995 | Drane et al. | 164/72 |
| 5,472,788 | A | 12/1995 | Benitez-Garriga | 428/472.2 |
| 5,478,414 | A | 12/1995 | Mozelewski et al. | 148/265 |
| 5,492,166 | A | 2/1996 | Liu et al. | 164/312 |
| 5,538,600 | A | 7/1996 | Schultz et al. | 428/31 |
| 5,616,231 | A | 4/1997 | Askin et al. | 205/153 |
| 5,637,404 | A | 6/1997 | Bombalski et al. | 428/422 |
| 5,697,422 | A | 12/1997 | Righi et al. | 164/120 |
| 5,725,683 | A | 3/1998 | Serafin et al. | 148/243 |
| 5,865,931 | A | 2/1999 | Serafin et al. | 156/269 |
| 5,955,147 | A | 9/1999 | Serafin | 427/286 |
| 5,985,046 | A | 11/1999 | Serafin et al. | 148/243 |
| 6,051,327 | A | 4/2000 | Serafin et al. | 428/652 |
| 6,077,616 | A | 6/2000 | Serafin et al. | 428/622 |
| 6,132,531 | A | 10/2000 | Fang et al. | 148/440 |
| 6,235,409 | B1 | 5/2001 | Serafin et al. | 428/654 |
| 6,277,217 | B1 | 8/2001 | Yoshino et al. | 148/440 |
| 6,306,342 | B2 | 10/2001 | Koch et al. | 420/543 |
| 6,374,737 | B1 | 4/2002 | Bennett et al. | 101/457 |
| 6,440,290 | B1 | 8/2002 | Vega et al. | 205/201 |
| 6,503,292 | B2 | 1/2003 | Klingensmith et al. | 75/386 |
| 6,517,954 | B1 | 2/2003 | Mergen et al. | 428/653 |
| 6,521,391 | B1 | 2/2003 | Bennett et al. | 430/275.1 |
| 6,560,845 | B2 | 5/2003 | Serafin et al. | 29/469.5 |
| 6,569,601 | B1 | 5/2003 | Bennett et al. | 430/273.1 |
| 6,631,679 | B2 | 10/2003 | Bennett et al. | 101/457 |
| 6,673,519 | B2 | 1/2004 | Bennett et al. | 430/278.1 |
| 6,715,420 | B2 | 4/2004 | Blake et al. | 101/456 |
| 6,733,566 | B1 | 5/2004 | Fang et al. | 75/709 |
| 6,749,992 | B2 | 6/2004 | Bennett et al. | 430/272.1 |
| 6,773,666 | B2 | 8/2004 | Lin et al. | 420/546 |
| 6,783,730 | B2 | 8/2004 | Lin et al. | 420/550 |
| 6,783,836 | B2 | 8/2004 | Bennett et al. | 428/149 |
| 7,067,232 | B2 | 6/2006 | Bennett et al. | 430/276.1 |
| 7,527,872 | B2 | 5/2009 | Steele et al. | 428/447 |
| 7,584,778 | B2 | 9/2009 | Song et al. | 164/122.1 |
| 8,349,462 | B2 * | 1/2013 | Lin et al. | 428/472.2 |
| 2002/0034707 | A1 | 3/2002 | Bennett et al. | 430/273.1 |
| 2002/0121204 | A1 | 9/2002 | Bennett et al. | 101/401.1 |
| 2002/0129484 | A1 | 9/2002 | Serafin et al. | 29/469.5 |
| 2002/0150750 | A1 | 10/2002 | Bennett et al. | 428/327 |
| 2002/0185790 | A1 | 12/2002 | Klingensmith et al. | 266/81 |
| 2003/0000409 | A1 | 1/2003 | Blake et al. | 101/454 |
| 2003/0138730 | A1 | 7/2003 | Bennett et al. | 430/272.1 |
| 2003/0143485 | A1 | 7/2003 | Bennett et al. | 430/278.1 |
| 2003/0194572 | A1 | 10/2003 | Cooper et al. | 428/457 |
| 2004/0011437 | A1 | 1/2004 | Lin et al. | 148/549 |
| 2004/0261916 | A1 | 12/2004 | Lin et al. | 148/549 |
| 2005/0167012 | A1 | 8/2005 | Lin et al. | 148/549 |
| 2005/0191204 | A1 | 9/2005 | Lin et al. | 420/531 |
| 2005/0238528 | A1 | 10/2005 | Lin et al. | 420/532 |
| 2005/0238529 | A1 | 10/2005 | Lin et al. | 420/541 |
| 2006/0021683 | A1 | 2/2006 | Lin et al. | 148/549 |
| 2006/0027291 | A1 | 2/2006 | Matsuoka et al. | 148/550 |
| 2006/0093829 | A1 | 5/2006 | Smith et al. | 428/413 |
| 2006/0204780 | A1 | 9/2006 | Vega et al. | 428/687 |
| 2006/0289093 | A1 | 12/2006 | Yan et al. | 148/549 |
| 2007/0017604 | A1 | 1/2007 | Yan et al. | 148/549 |
| 2007/0029207 | A1 | 2/2007 | Anglin et al. | 205/300 |
| 2007/0042215 | A1 | 2/2007 | Osanai et al. | 428/632 |
| 2007/0062669 | A1 | 3/2007 | Song et al. | 164/516 |
| 2007/0092739 | A1 | 4/2007 | Steele et al. | 428/450 |
| 2007/0125460 | A1 | 6/2007 | Lin et al. | 148/549 |
| 2008/0066833 | A1 | 3/2008 | Lin et al. | 148/549 |
| 2008/0241573 | A1 | 10/2008 | Askin et al. | 428/612 |
| 2009/0026063 | A1 | 1/2009 | Skiles et al. | 204/157.3 |
| 2009/0061216 | A1 | 3/2009 | Levendusky et al. | 428/336 |
| 2009/0061218 | A1 | 3/2009 | Levendusky et al. | 428/336 |
| 2010/0008040 | A1 | 1/2010 | Weber et al. | 361/679.56 |
| 2010/0047113 | A1 | 2/2010 | Lin et al. | 420/532 |
| 2010/0183869 | A1 | 7/2010 | Lin et al. | 428/332 |

FOREIGN PATENT DOCUMENTS

| | | |
|---|---|---|
| FR | 671737 | 12/1929 |
| FR | 2128311 | 10/1972 |
| GB | 1331413 | 9/1973 |
| GB | 2155036 | 9/1985 |
| GB | 2321781 | 8/1998 |
| JP | 01-247549 | 10/1989 |
| JP | 02-295640 | 12/1990 |
| JP | 04-032541 | 2/1992 |
| JP | 04-107236 | 4/1992 |
| JP | 06-322493 | 11/1994 |
| RU | 2001145 | 10/1993 |
| RU | 2001147 | 10/1993 |
| TW | 178648 | 2/1992 |
| TW | 200409825 A | 6/2004 |
| WO | WO2004/061146 | 7/2004 |
| WO | WO2008/049010 | 4/2008 |

OTHER PUBLICATIONS

Barclay, R.S., et al., "Off-Eutectic Composite Solidification and Properties in Al-Ni and Al-Co Alloys," *Journal of Materials Science* 6:1168-1173 (1971).

Gigliotti, M. F. X., Jr., et al, "A Temperature-Composition zone of coupled Eutectic Growth in the Sn-Bi System," *Metallurgical Transactions* 1:1038-1041 (Apr. 1970).

Kang, C-S, et al., "Thin-Wall Aluminum Die-Casting Technology for Development of Notebook Computer Housing," *J. Mater. Sci. Technol.* 24(1):65-69 (2008).

Mondolfo, L. F. "Manganese in Aluminium Alloys," pp. 25-26, 35, 59-61, 88-89, 110-117, printed in Great Britain by Page Bros. (Norwich) Ltd., Norfolk (1978), ISBN 3 1951 000 527 010 S.

Namahoot, J. "Effect of Deformation on Corrosion of Al-Mn Alloys," thesis submitted o the University of Birmingham, Metallurgy and Materials School of Engineering, The University of Birmingham, Sep. 2004.

Panseri, C., "Manuale di Fonnderia Dalluminio," III Edizone, p. 839 (1966) (No English Translation available).

Smith, W. F., "Principles of Materials Science and Engineering," Third Editio pp. 445-451, McGraw-Hill, Inc. publisher (1996), ISBN 0-07-059241-1.

ASM Specialty Handbook: Aluminum and Aluminum Alloys, "Foundry Products," pp. 88-120, 552, ASM International, Materials Park, OH (1993).

(56) References Cited

OTHER PUBLICATIONS

ASM Specialty Handbook: Aluminum and Aluminum Alloys, "Physical Metallury," p. 41, ASM International, Materials Park, OH (1993).
ASM Handbook: Metals Handbook, vol. 2, Properties and Selection: Nonferrous Alloys and Special-Purpose Materials, pp. 46-47, 55 (1990).
ColorTouch PCT technidyne, product brochure, downloaded from web site at http://www.technidyne.com/Color-Tough-PCT.html, © Technidyne Corporation 2008.
ASTM B117-03 "Standard Practice for Operating Salt Spray (Fog) Apparatus," ASTM International, Jun. 2006.
Computer-aided Runner and gating design technology for pressure die casting, retrieved from the Internet on Dec. 3, 2009 at http://www.castecaustralia.com/products.html, website of Castec Australia Pty, Ltd.
"La Lega Da Fonderia Al Ni2 Mn2, Pyral N2, Ad Elevato Punto Di Fusione," *Allumino; revista della nuova metallurgia* 45:47-51 (1971) (Anonymous) (English translation attached).
Final Office Action, mailed Mar. 31, 2008, from commonly-owned U.S. Appl. No. 10/891,480.
Non-final Office Action, mailed Oct. 12, 2007 from commonly-owned U.S. Appl. No. 10/891,480.
Final Office Action, mailed Apr. 6, 2007, from commonly-owned U.S. Appl. No. 10/891,480.
Non-final Office Action, mailed Oct. 11, 2006, from commonly-owned U.S. Appl. No. 10/891,480.
Non-final Office Action, mailed Nov. 26, 2003, from commonly-owned U.S. Appl. No. 10/325,561.
Non-final Office Action, mailed Mar. 26, 2012 from commonly-owned U.S. Appl. No. 12/657, 099.
International Search Report, mailed Apr. 3, 2004, from commonly-owned International Patent Application No. PCT/US2003/036862.
International Preliminary Examination Report, dated Oct. 5, 2004, from commonly-owned International Patent Application No. PCT/US2003/036862.
International Search Report, mailed Jul. 5, 2010, from commonly-owned International Patent Application No. PCT/US2010/020937.
Extended Search Report, dated Jul. 12, 2010, 10159717.7, from commonly-owned European Patent Application No. 10159717.7.
Supplemental European Search Report, dated Dec. 22, 2005, from commonly-owned European Patent Application No. 03768975.9.
Office Action of the European patent office, mailed May 23, 2012 from commonly-owned European Patent Application No. 10700362.6.
Wernick, S., et al., "Colouring Anodic Oxide Coatings," in The Surface Treatment and Finishing of Aluminium and its Alloys, Ch. 10, pp. 445-477, 1964.
Non-final Office Action, mailed May 27, 2014, from commonly-owned Taiwanese Patent Application No. 099101143 (including English translation thereof).

* cited by examiner

Al-Ni Phase Diagram – FIG. 4a
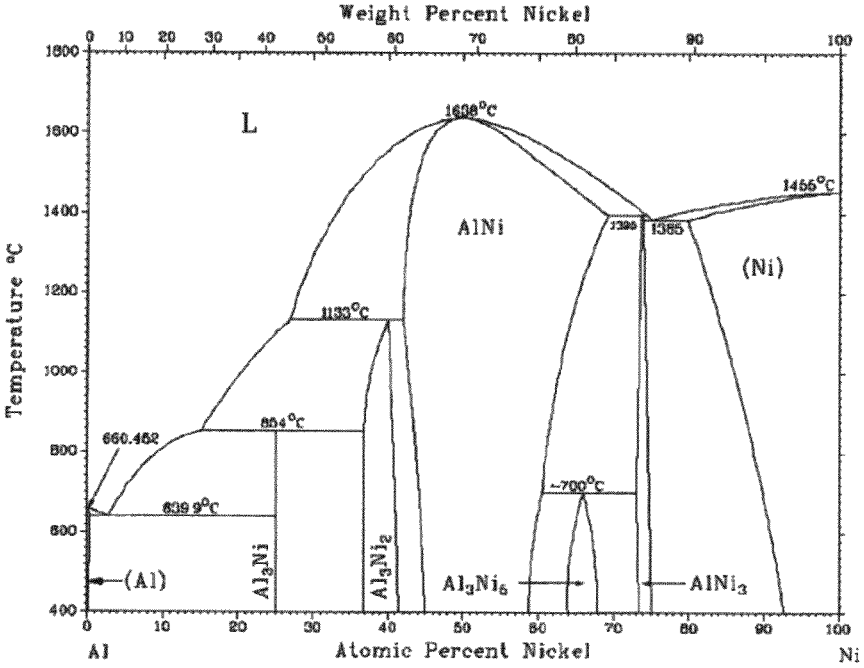

Ternary Eutectic: Ni ~6.2 wt%, Mn ~2.1 wt% @ about 625°C (Al-Ni6.9-Mn2.9)

(Al-Ni4-Mn2)

(Al-Ni1-Mn2)

(Al-Ni6.5)

(A380)

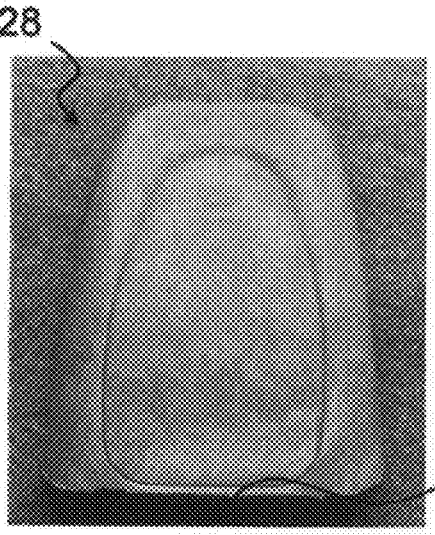
FIG. 20A
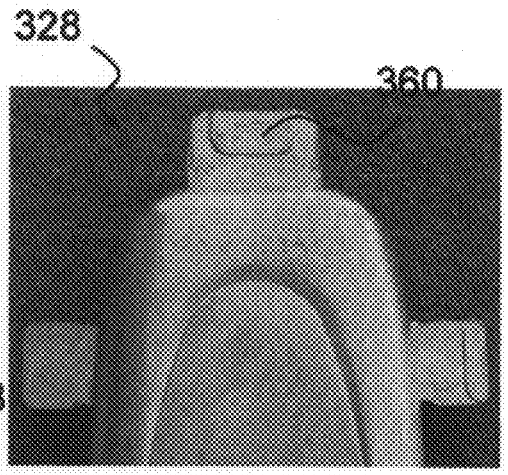
FIG. 20B
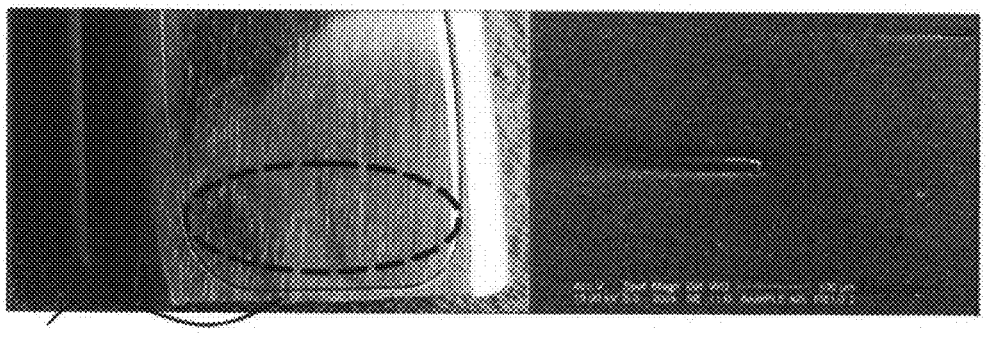
FIG. 21A
FIG. 21B

Essentially clear
of dark streaks
Al - 6.7 Ni

Dark
streaks
Fan Gate

Streaks

ALUMINUM ALLOYS, ALUMINUM ALLOY PRODUCTS AND METHODS FOR MAKING THE SAME

CROSS REFERENCE TO RELATED APPLICATIONS

This patent application is a divisional patent application of U.S. patent application Ser. No. 12/657,099 filed on Jan. 12, 2010, now U.S. Pat. No. 8,349,462, which claims priority to the following U.S. Provisional Patent Applications, each of which is incorporated herein by reference in its entirety: (1) U.S. Provisional Patent Application No. 61/145,416, entitled "Aluminum Alloys for Consumer Electronics", filed Jan. 16, 2009; (2) U.S. Provisional Patent Application No. 61/160,631, entitled "Aluminum Alloys for Consumer Electronics", filed Mar. 16, 2009; (3) U.S. Provisional Patent Application No. 61/187,183, entitled "Aluminum Alloys for Consumer Electronics", filed Jun. 15, 2009; (4) U.S. Provisional Patent Application No. 61/269,660, entitled "Aluminum alloys for consumer electronic products and methods, systems and apparatus for producing the same", filed Jun. 26, 2009; and (5) U.S. Provisional Patent Application No. 61/221,943, entitled "Die-casting process", filed Jun. 30, 2009.

BACKGROUND

Façades for consumer products, such as consumer electronic products, must meet a variety of criteria in order to be commercially viable. Among those criteria are durability and visual appearance. Lightweight, durable façades that are visually appealing would be useful in consumer product applications.

SUMMARY

Broadly, the present disclosure relates to aluminum alloys for consumer products, consumer products containing such aluminum alloys, and methods, systems and apparatus for producing the same. These aluminum alloys may be used as a façade of the consumer product (e.g., a mobile electronic device cover). The consumer products may realize a unique combination of appearance, durability, and/or portability, due to, at least in part, the unique alloys, casting processes and/or finishing processes disclosed herein. Indeed, the Al—Ni and Al—Ni—Mn alloys described herein at least partially assist in providing consumer products having a high brightness and/or low grayness, and in the anodized condition, which at least facilitate the production of visually attractive shape cast products. These alloys also have a good combination of mechanical properties in the as-cast condition (F temper), castability, and anodizability, as described in further detail below, making them well suited for use in consumer product applications. The casting processes may facilitate production of shape cast alloys having few or no visually apparent surface defects. The finishing processes may produce decorative shape cast products that are durable, UV resistant, and abrasion resistant, among other properties.

Further embodiments of the disclosure follow:

4.1 A thin-walled shape cast aluminum alloy product comprising: a body comprising an intended viewing surface, wherein the body comprises: (I) an aluminum alloy base, wherein the aluminum alloy base comprises from about 0.5 to about 8.0 wt. % Ni and up to about 3.5 wt. % Mn; (II) a uniform oxide layer formed from the aluminum alloy base, wherein the oxide layer comprises a plurality of pores, and wherein the oxide layer is associated with the intended viewing surface of the thin-walled shape cast aluminum alloy product; wherein the intended viewing surface of the shape cast product is substantially free of visually apparent surface defects; and wherein the thin-walled shape cast aluminum alloy product has a tensile yield strength of at least about 100 MPa in the F temper.

4.2 The thin-walled shape cast aluminum alloy product of paragraph 4.1, wherein the oxide layer consists essentially of Al, Ni, O and at least one of S, P, Cr, and B.

4.3 The thin-walled shape cast aluminum alloy product of paragraph 4.1, wherein the oxide layer consists essentially of Al, Ni, O and at least one of S and P.

4.4 The thin-walled shape cast aluminum alloy product of paragraph 4.1, wherein the body is free of non-oxide layers between the aluminum alloy base and the oxide layer.

4.5 The thin-walled shape cast aluminum alloy product of paragraph 4.1, wherein the variability of the color of the intended viewing surface of the shape cast product is not greater than +/−5.0 Delta E, and wherein the variability is due to, at least in part, the uniformity of the uniform oxide layer.

4.6 The thin-walled shape cast aluminum alloy product of paragraph 4.1, comprising: a colorant at least partially filling the pores of the oxide layer.

4.7. The thin-walled shape cast aluminum alloy product of paragraph 4.6, wherein the colorant is in the form of a silicon polymer coating, wherein the coating overlays at least a portion of the oxide layer.

4.8 The thin-walled shape cast aluminum alloy product of paragraph 4.6, wherein the coating passes a cross-hatching test in accordance with ASTM D3359-09, wherein the intended viewing surface of the thin walled shape cast aluminum alloy product contains no pits on the intended viewing surface after 2 hours of exposure to a salt solution when tested in accordance with ASTM B117, wherein the coating passes a Taber abrasion test in accordance with ASTM D4060-07, wherein the coating of the thin walled shape cast aluminum alloy product realizes a Delta-E of less than about 0.7 after 24 hours of exposure to a QUV-A bulb having a wavelength of 340 nm when tested in accordance with ISO 11507, wherein the intended viewing surface realizes no material visual change following exposure to artificial sweat when tested in accordance with EN 1811 to nickel extraction, wherein the intended viewing surface of the decorative shape cast product achieves a rating of at least about 2H as measured in accordance with the pencil hardness test of ASTM D3363-09, and wherein the variability of the color of the intended viewing surface of the shape cast product is not greater than +/−5.0 Delta E.

4.9 The thin-walled shape cast aluminum alloy product of paragraph 4.6, wherein the variability of the color of the intended viewing surface of the shape cast product is not greater than +/−5.0 Delta E.

4.10 The thin-walled shape cast aluminum alloy product of paragraph 4.6, wherein the aluminum alloy composition comprises a hypereutectic alloy composition of aluminum, nickel and manganese.

4.11 A thin-walled cast aluminum alloy product comprising: a body comprising an intended viewing surface, wherein the body comprises: (I) an aluminum alloy base having a layered microstructure, wherein the aluminum alloy base comprises from about 0.5 to about 8.0 wt. % Ni and up to about 3.5 wt. % Mn, and wherein the layered microstructure comprises a fairly regular distribution of alpha aluminum phase and eutectic microstructure; (II) an oxide layer formed of the aluminum alloy base, wherein the oxide layer comprises a plurality of pores, wherein the oxide layer is associated with the intended viewing surface of the thin-walled shape cast aluminum alloy product, and wherein a colorant at least partially fills the pores of the oxide layer; wherein the intended viewing surface of the shape cast product has a substantially marbled appearance, wherein the alpha aluminum phase comprises a first color due to the colorant, and wherein the eutectic microstructure comprises a second color due to the colorant, wherein the second color is different than the first color, wherein the combination of the first color of the alpha aluminum phase and the second color of the eutectic microstructure at least partially contributes to the marbled appearance.

4.12 A method comprising: (a) producing a thin walled shape cast aluminum alloy product having an intended viewing surface; (i) wherein the producing comprises die casting an aluminum alloy containing from about 0.5 to about 8.0 wt. % Ni and up to about 3.5 wt. % Mn; (ii) wherein, after the producing step, the thin-walled shape cast product comprises an outer layer having alpha aluminum phase and eutectic phase; (b) removing not greater than about 500 microns of the outer layer from the thin-walled shape cast product; (c) anodizing the thin-walled shape cast product, wherein the anodizing comprises forming an oxide layer from a portion of the thin walled shape cast aluminum alloy product, wherein the oxide layer is associated with the intended viewing surface, and wherein the oxide layer comprises a plurality of pores; (d) applying a colorant to the oxide layer of the thin walled shape cast aluminum alloy product, wherein after the applying step at least some of the colorant is at least partially disposed within the pores of the oxide layer; wherein, after the applying step, the intended viewing surface is substantially free of visually apparent surface defects; and wherein, after the applying step, the variability of the color of the intended viewing surface is not greater than +/−5.0 Delta E.

4.13 The method of paragraph 4.11, wherein the applying colorant step comprises: contacting the oxide layer with a dye and in the absence of electric current.

4.14 The method of paragraph 4.11, wherein the applying step comprises: depositing a coating precursor on a surface of the oxide layer; and converting the coating precursor to a coating, wherein after the converting step the coating substantially covers the oxide layer.

4.15 The method of paragraph 4.14, wherein the coating precursor is a precursor to a silicon polymer and wherein the covering step comprises applying radiation or heat to the coating precursor to produce a coating containing the silicon polymer.

4.16 A method comprising: (a) producing a thin walled shape cast aluminum alloy product having an intended viewing surface; (i) wherein the producing comprises die casting an aluminum alloy containing from about 0.5 to about 8.0 wt. % Ni and up to about 3.5 wt. % Mn; (ii) wherein, after the producing step, the thin-walled shape cast product comprises a fairly regular distribution of alpha aluminum phase and eutectic phase; (b) removing not greater than about 500 microns of the outer layer from the thin-walled shape cast product; (c) anodizing the thin-walled shape cast product, wherein the anodizing comprises forming an oxide layer from a portion of the thin walled shape cast aluminum alloy product, wherein the oxide layer is associated with the intended viewing surface, and wherein the oxide layer comprises a plurality of pores; (d) applying a colorant to the oxide layer of the thin walled shape cast aluminum alloy product, wherein after the applying step at least some of the colorant is at least partially disposed within the pores of the oxide layer; wherein, after the applying step, the intended viewing surface of the shape cast product has a substantially marbled appearance, wherein the alpha aluminum phase comprises a first color due to the colorant, and wherein the eutectic microstructure comprises a second color due to the colorant, wherein the second color is different than the first color, wherein the combination of the first color of the alpha aluminum phase and the second color of the eutectic microstructure at least partially contributes to the marbled appearance.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

FIG. 4*a* is a phase diagram for the binary Al—Ni system.

FIG. 20A is a photograph of a mobile electronic device cover in the as-cast condition having visually apparent surface defects (flow-lines) near the gate area.

FIG. 20B is a photograph of a mobile electronic device cover in the as-cast condition having visually apparent surface defects (dark mottled discoloration) near the vent regions.

FIGS. 21A-21B is an optical micrograph and a scanning electron microscope (SEM) photograph, respectively, of a mobile electronic device cover in the as-cast condition having visually apparent surface defects (comet tails) near the gate area.

DETAILED DESCRIPTION

Figure 1:
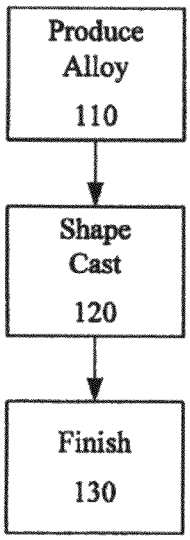
FIG. 1 is a flow chart illustrating one method for producing a shape cast product in accordance with the present disclosure.

Reference is now made to the accompanying figures, which at least partially assist in illustrating various pertinent features of the present disclosure. One embodiment of a method for producing a decorative shape cast product is illustrated in FIG. 1. In the illustrated embodiment, the method includes producing the alloy (110), shape casting the alloy to produce a shape cast product (120) and finishing the shape cast product (130) to form a decorative shape cast product.

A. Shape Cast Products

Shape cast products are those products that achieve their final or near final product form after the aluminum alloy casting process. A shape cast product is in final form if it requires no machining after casting. A shape cast product is in near final form if it requires some machining after casting. By definition, shape cast products excludes wrought products, which generally require hot and/or cold work after casting to achieve their final product form. Shape cast products may be produced via any suitable casting process, such as die casting and permanent mold casting processes, among others, as described in further detail below.

In one embodiment, the shape cast products are "thin walled" shape cast products. In these embodiments, the shape cast products have a nominal wall thickness of not greater than about 1.0 millimeter. In one embodiment, a shape cast product has a nominal wall thickness of not greater than about 0.99 mm. In another embodiment, a shape cast product has a nominal wall thickness of not greater than about 0.95 mm. In other embodiments, the shape cast product has a nominal wall thickness of not greater than about 0.9 mm, or not greater than about 0.85 mm, or not greater than about 0.8 mm, or not greater than about 0.75 mm, or not greater than about 0.7 mm, or not greater than about 0.65 mm, or not greater than about 0.6 mm, or not greater than about 0.55 mm, or not greater than about 0.5 mm, or even less.

Figure 2A:
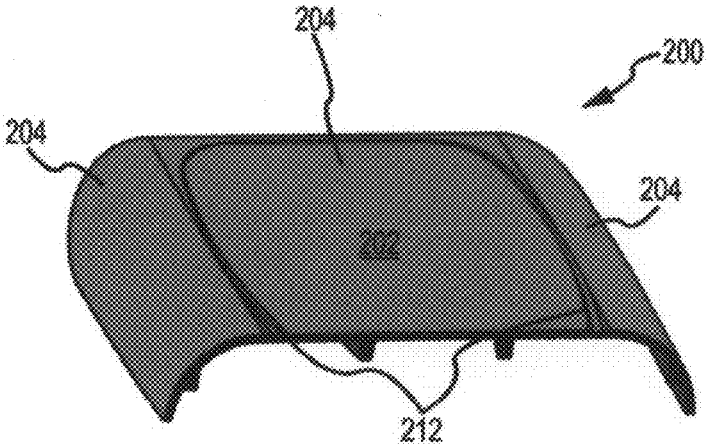
FIG. 2*a* is a schematic, top-perspective view of one embodiment of a thin walled, shape cast mobile electronic device cover produced from an aluminum alloy.
Figure 2B:
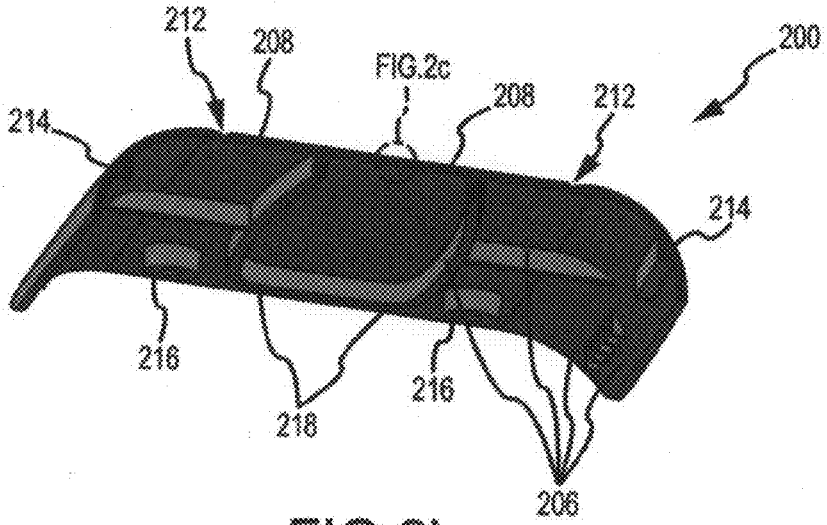
FIG. 2*b* is a schematic, bottom-perspective view of one embodiment of a thin walled, shape cast mobile electronic device cover produced from an aluminum alloy.
Figure 2C:
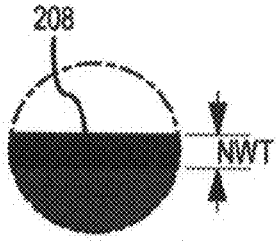
FIG. 2*c* is a close-up view of a portion of the mobile electronic device phone cover of FIG. 2*b*, illustrating its nominal wall thickness.

The nominal wall thickness of a shape cast product is the predominant thickness of the wall of the shape cast product, not including any decorative or support features such as bosses, ribs, webs or draft applied to allow part release from the die. For example, as illustrated in FIGS. 2*a*-2*c*, a mobile electronic device cover 200 has a body 202 having intended viewing surfaces 204 and internal surfaces 206. Intended viewing surfaces, such as surfaces 204 illustrated in FIGS. 2*a*-2*c*, are surfaces that are intended to be viewed by a consumer during normal use of the product. Internal surfaces 206, such as surfaces 206 illustrated in FIGS. 2*a*-2*c*, are generally not intended to be viewed during normal use of the product. For example, the internal surfaces 206 of the mobile electronic device cover 200 are not normally viewed during normal use of the product (e.g., when using to send text messages and/or when using to converse telephonically), but may be occasionally viewed during non-normal usage, such as when changing the battery. In the illustrated embodiment, the body 202 has a nominal wall thickness (NWT) 208 of not greater than about 1.0 mm (e.g., about 0.7 mm). This nominal wall thickness (NWT) does not include any thickness of the decorative features 212, mounting features 214, screw bosses 216, or reinforcing ribs 218, among others.

In other embodiments, the shape cast product may have a medium wall thickness. In these embodiments, the shape cast product has a nominal wall thickness of not greater than 2 mm, but at least about 1.01 mm. In one embodiment, the shape cast product has a nominal wall thickness of not greater than about 1.95 mm. In other embodiments, the shape cast product may have a nominal wall thickness of not greater than about 1.9 mm, or not greater than about 1.85 mm, or not greater than about 1.8 mm, or not greater than about 1.75 mm, or not greater than about 1.7 mm, or not greater than about 1.65 mm, or not greater than about 1.6 mm, or not greater than about 1.55 mm, or not greater than about 1.5 mm, or not greater than about 1.45 mm, or not greater than about 1.4 mm, or not greater than about 1.35 mm, or not greater than about 1.3 mm, or not greater than about 1.25 mm, or not greater than about 1.2 mm, or not greater than about 1.15 mm, or not greater than about 1.1 mm. In these embodiments, the shape cast product may have a nominal wall thickness of greater than about 1.0 mm.

In yet other embodiments, the shape cast products may have a relatively thick wall thickness. In these embodiment, a shape cast product may have a nominal wall thickness of not greater than about 6 millimeters, but at least about 2.01 mm. In one embodiment, a shape cast product has a nominal wall thickness of not greater than about 5 millimeters. In other embodiments, a shape cast product has a nominal wall thickness of not greater than about 4 millimeters, or not greater than about 3 millimeters. In these embodiments, the shape cast product may have a nominal wall thickness of greater than 2 millimeters.

B. Decorative Shape Cast Products

After casting, a shape cast product may be finished to produce a decorative shape cast product. Decorative shape cast products are those shape cast products that are subjected to one or more finishing steps, as described in further detail below, and which result in the shape cast products having a predetermined color, gloss, and/or texture, among other features, located on at least a portion of an intended viewing surface of the shape cast product. Often these decorative shape cast products achieve a predetermined color, gloss, and/or texture, among other features, that meets consumer acceptance standards.

The decorative shape cast products may have a predetermined color. A predetermined color means a color that is picked in advanced, such as intended color of the end-use decorative shape cast product. In some embodiments, the predetermined color is different than that of the natural color of the substrate.

The predetermined color of the decorative shape cast products is generally achieved by application of a colorant to an oxide layer of the decorative shape cast products. These colorants generally at least partially occupy the pores of the oxide layer. In one embodiment, after application of the colorant, the pores of the oxide layer may be sealed (e.g., when using dye-type colorants). In one embodiment, there is no need to seal the pores of the oxide layer as the colorant already does so (e.g., when using colorants having a polymer backbone based on Si, such as with the use of polysilazanes and polysiloxanes).

In one embodiment, the decorative shape cast products achieve color uniformity on one or more of their intended viewing surfaces. This color uniformity may be due to, for example, the selected alloy composition, the selected casting process, and/or the selected finishing process, which may result in the shape cast product being substantially free of visually appearance surface defects. "Color uniformity" and the like means that the color of the finished shape cast product is substantially the same across the intended viewing surface of the shape cast product. For example, in some embodiments, color uniformity may be facilitated via the ability to produce a uniform oxide layer during anodizing, which may result in the ability to reliably produce a uniform color across an intended viewing surface of a shape cast product. In one embodiment, color uniformity is measured via Delta-E (CIELAB). In one embodiment, the variability of the color of the shape cast product is not greater than +/−5.0 Delta E, as measured via a colorimeter employing CIELAB (e.g., a Color Touch PC, by TECHNIDYNE). In other embodiments, the variability of the color of the shape cast product is not greater than +/−4.5 Delta E, or +/−4.0 Delta E, or +/−3.5 Delta E, or +/−3.0 Delta E, or +/−2.5 Delta E, or +/−2.0 Delta E, or +/−1.5 Delta E, or +/−1.0 Delta E, or +/−0.9 Delta E, or not greater than +/−0.8 Delta E, or not greater than +/−0.7 Delta E, or not greater than +/−0.6 Delta E, or not greater than +/−0.5 Delta E, or not greater than +/−0.4 Delta E, or not greater than +/−0.2 Delta E, or not greater than +/−0.1 Delta E, or not greater than +/−0.05 Delta E, or less, as measured via a colorimeter employing CIELAB (e.g., a Color Touch PC, by TECHNIDYNE).

The decorative shape cast products may have a predetermined gloss. A predetermined gloss is a gloss that is picked in advanced, such as an intended gloss of the end-use product. In some embodiments, the predetermined gloss is different than that of the natural gloss of the substrate. In some embodiments, the predetermined gloss is achieved by application of a colorant having a predetermined gloss. In one embodiment, a shape cast product has gloss uniformity. "Gloss uniformity" means that the gloss of the finished shape cast product is substantially the same across the intended viewing surface of the shape cast product. In one embodiment, gloss uniformity is measured in accordance with ASTM D 523. In one embodiment, the variability of the gloss of the shape cast product is not greater than about +/−20 units (e.g., % gloss units) across the intended viewing surface of the shape cast product. In other embodiments, the variability of the gloss is not more than about +/−15 units, or not more than about +/−13 units, or not more than about +/−10 units, or not more than about +/−9 units, or not more than about +/−8 units, or not more than about +/−7 units, or not more than about +/−6 units, or not more than about +/−5 units, or not more than about +/−4 units, or not more than about +/−3 units, or not more than about +/−2 units, or not more than about +/−1 unit across the intended viewing surface of the shape cast product. One instrument for measuring gloss is a BYK-GARDNER AG-4430 micro-TRI-gloss glossmeter.

The color uniformity and/or gloss uniformity of the decorative shape cast products may be due to the relatively uniform oxide layer that is formed during anodization of the shape cast product. As described in further detail below, uniform oxide layers may be facilitated via the use of the Al—Ni and AL-Ni—Mn alloys described herein. These uniform oxide layers may facilitate a uniform absorption of colorant, and therefore promote color and/or gloss uniformity in the decorative shape cast products.

The decorative shape cast products may have a tailored texture. A tailored texture is texture with predefined shape(s) and/or orientation that is created via chemical, mechanical and/or other processes (e.g., lasers etching, embossing, engraving, and lithographic techniques). In one embodiment, a tailored texture may be created after casting, such as via tailored mechanical processes, such as machining, brushing, blasting and the like. In another embodiment, a tailored texture may be created during casting, such as via the use of predefined patterns within the casting die. In other embodiments, the decorative shape cast products may have a generally smooth surface, i.e., a non-texturized outer surface.

Figure 2D:
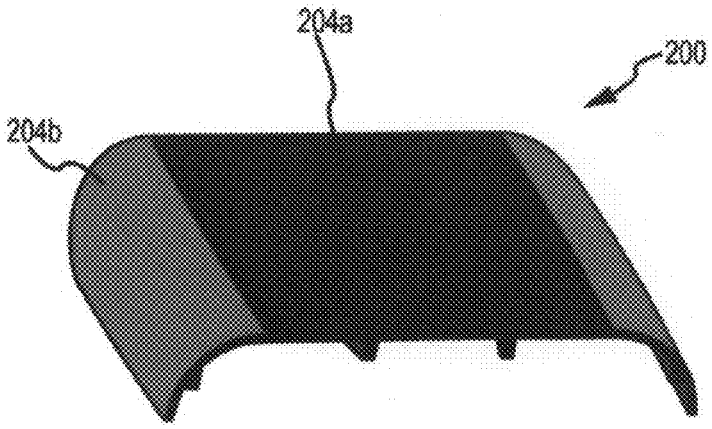
FIG. 2*d* is a top-perspective view of one embodiment of a mobile electronic device cover having different colored intended viewing surfaces.

In some embodiments, a shape cast product may have at least two intended view surfaces, one with a first color, gloss, and/or texture, and a second with a second color, gloss and/or texture. For example, and with reference now to FIG. 2*d*, a mobile electronic device cover 200 has a first intended viewing surface 204*a* having a first predetermined color, and a second intended viewing 204*b* surface having a second predetermined color, which is different than the first predetermined color 204*a*. In these embodiments, the color uniformity of the first intended viewing surface 204*a* is determined only within the area defined by the first intended viewing surface, and the color uniformity of the second intended viewing surface 204*b* is determined only within the area defined by the second intended viewing surface. The same applies for gloss uniformity and texture. Furthermore, a decorative shape cast product may have any number of intended viewing surfaces, and with the same principles applying. The examples provided above are for illustrative purposes only.

In some embodiments, the decorative shape cast product is substantially free of visually apparent surface defects. "Substantially free of visually apparent surface defects" means that the intended viewing surfaces of the decorative shape cast product are substantially free of surface defects as viewed by human eyesight, with 20/20 vision, when the decorative shape cast product is located at least 18 inches away from the eyes of the human viewing the decorative shape cast product. Examples of visually apparent surface defects include those cosmetic defects that can be viewed due to the casting process (e.g., cold-shuts, lap-lines, flow-lines and mottled discolorations, voids) and/or the alloy microstructure (e.g., the presence of randomly located alpha aluminum phase at or near the intended viewing surface of the decorative shape cast product), among others. Since the finishing process (described below) generally allows an appreciable amount of visible light to penetrate tens or hundreds or microns of the decorative shape cast product, which may be reflected and/or absorbed, it may be useful to produce a uniform microstructure and/or restrict or eliminate randomly distributed intermetallics and/or alpha aluminum phase, resulting in a decorative shape cast product that is substantially free of visually apparent surface defects, and which may be accepted by consumers. The presence of visually apparent surface defects is generally determined after anodizing, such as after application of the colorant to the shape cast product. Examples of decorative shape cast products that are substantially free of visually apparent surface defects are illustrated in FIGS. 36, 37, 41B, 42B and 43B. Example of decorative shape cast products that contain one or more visually apparent surface defects are illustrated in FIGS. 20A, 20B, 21A, 41A, 42A, and 43A.

In other embodiments, such as with marbled finishes, a decorative shape cast product may include visually apparent surface defects. These visually apparent surface defects may facilitate tailored differential coloring of the intended viewing surfaces of the shape cast product, and therefore may facilitate marbled appearances. A marbled finish is a finish having patterns that resemble veins or streaks that resemble marble after application of one or more colorants.

The intended viewing surfaces of the shape cast product may have a low grayness and/or have a high brightness. In one embodiment, the intended view surfaces of a shape cast product realize a grayness level that perceptibly less than that of a comparable shape cast product produced from casting alloy 380. For example, the shape cast product may have a CIELAB "L-value" that is at least about 1 unit greater than that of a comparable 380 product as measured via a colorimeter employing CIELAB (e.g., a Color Touch PC, by TECHNIDYNE). A comparable 380 product is a product that is produced via the same casting process and finishing processes (if appropriate) as the decorative shape cast product, but is produced from casting alloy 380 instead of the alloy compositions described herein. The CIELAB L-value indicates the level of white-black (e.g., 100=pure white, 0=pure black). In some embodiments, the shape cast product may have a CIELAB "L-value" that is at least about 2 units greater, or at least about 3 units greater, or at least about 4 units greater, or at least about 5 units greater, or at least about 6 units greater, or at least about 7 units greater, or at least about 8 units greater, or at least about 9 units greater, or at least about 10 units greater, or at least about 11 units, or at least about 12 units, at least about 13 units, at least about 14 units, at least about 15 units, at least about 16 units, at least about 17 units, or at least about 18 units greater, or at least about 19 units greater, or at least about 20 units greater, or more, than that of a comparable 380 product as measured via a colorimeter employing CIELAB (e.g., a Color Touch PC, by TECHNIDYNE). In one embodiment, the shape cast product may have a CIELAB "L-value" that is at least about 5% better than that of a comparable 380 product as measured via a colorimeter employing CIELAB (e.g., a Color Touch PC, by TECHNIDYNE). In other embodiments, the shape cast product may have a CIELAB "L-value" that is at least about 10% better, or at least about 15% better, or at least about 20% better, or at least about 25% better, or at least about 30% better, or at least about 35% better, or at least about 40% better, or at least about 45% better, or more, than that of a comparable 380 product as measured via a colorimeter employing CIELAB (e.g., a Color Touch PC, by TECHNIDYNE). In one embodiment, the shape cast product may have a CIELAB "L-value" of at least about 55. In other embodiments, the shape cast product may have a CIELAB "L-value" of at least about 56, or at least about 57, or at least about 58, or at least about 59, or at least about 60, or at least about 61, or at least about 62, or at least about 63, or at least about 64, or at least about 65, or at least about 66, or at least about 67, or at least about 68, or more, as measured via a colorimeter employing CIELAB (e.g., a Color Touch PC, by TECHNIDYNE). In one embodiment, the L-values are determined relative to the "as cast" products (i.e., after casting 120). In one embodiment, the L-values are determined after finishing (130). In one embodiment, the L-values are determined after during an intermediate finishing step, such as after anodizing, but prior to application of color.

In one embodiment, the intended viewing surfaces of a shape cast product realize a brightness level that is perceptibly greater than that of a comparable shape cast product produced from casting alloy 380. For example, the shape cast product may have a ISO brightness level that is at least about 1 unit greater than that of a comparable 380 product as determined in accordance with ISO 2469 and 2470. In other embodiments, the shape cast product may have a ISO brightness level that is at least about 2 units greater, or at least about 3 units greater, or at least about 4 units greater, or at least about 5 units greater, or at least about 6 units greater, or at least about 7 units greater, or at least about 8 units greater, or at least about 9 units greater, or at least about 10 units greater, or at least about 11 units greater, or at least about 12 units greater, or at least about 13 units greater, or at least about 14 units greater, or at least about 15 units greater, or at least about 16 units greater, or at least about 17 units greater, or at least about 18 units greater, or at least about 19 units greater, or at least about 20 units greater, or more, than that of a comparable 380 product as determined in accordance with ISO 2469 and 2470. In one embodiment, the shape cast product may have a ISO brightness level that is at least about 5% greater than that of a comparable 380 product as determined in accordance with ISO 2469 and 2470. In other embodiments, the shape cast product may have a ISO brightness level that is at least about 10% greater, or at least about 20% greater, or at least about 30% greater, or at least about 40% greater, or at least about 50% greater, or at least about 60% greater, or at least about 70% greater, or at least about 80% greater, or at least about 90% greater, or at least about 100% greater, or at least about 110% greater, or at least about 120% greater, or at least about 130% greater, or at least about 140% greater, or at least about 150% greater, or at least about 160% greater, or more, than that of a comparable 380 product as determined in accordance with ISO 2469 and 2470. In one embodiment, the shape cast product may have a ISO brightness level of at least about 20, as determined in accordance with ISO 2469 and 2470. In other embodiments, the shape cast product may have a ISO brightness level of at least about 21, or at least about 22, or at least about 23, or at least about 24, or at least about 25, or at least about 26, or at least about 27, or at least about 28, or at least about 29, or at least about 30, or at least about 31, or at least about 32, or at least about 33, or at least about 34, or at least about 35, or at least about 36, or at least about 37, or at least about 38, or at least about 39, or more, as determined in accordance with ISO 2469 and 2470. In one embodiment, the ISO brightness is measured by a Color Touch PC by TECHNIDYNE. In one embodiment, the ISO brightness values are measured relative to the "as cast" products (i.e., after casting 120). In one embodiment, the ISO brightness values are measured after finishing (130). In one embodiment, the ISO brightness values are measured after during an intermediate finishing step, such as after anodizing, but prior to application of color.

Any of the above described color uniformity, grayness and/or brightness values may be achieved, and in any combination, via the appropriate alloy selection, casting process selection, and/or finishing process selection, to produce the decorative shape cast products described herein.

C. Shape Cast Product Properties

As described in further detail below, the decorative shape cast products may realize a unique combination of visually attractiveness and durability. For example, the shape cast products may realize a unique combination of visual attractiveness, strength, toughness, corrosion resistance, coating adhesiveness, hardness, UV resistance, and/or chemical resistance, as described in further detail below. These combination of properties may enable the use of the presently disclosed products in various consumer applications, as described in further detail below. One or more of these properties of the shape cast products may be realized, at least in part, due to the selection of the appropriate Al—Ni and/or Al—Ni—Mn alloy, and/or microstructure of the same, for the shape cast products, discussed below.

D. Shape Cast Product Applications

The decorative shape cast products of the instant disclosure may be utilized in a variety of applications. In one embodiment, the shape cast product is a consumer electronic part. Consumer electronic parts are generally used to enhance the appearance, durability and/or portability of the consumer electronic product, and may be used as at least part of a façade of the consumer electronic part. Example of consumer electronic parts useful with the instant disclosure include outer pieces (e.g., façades, such as faces and covers) or inner pieces for mobile phones, portable and non-portable audio and/or video devices (e.g., iPods or iPhones or portable similar audio/video devices, such as MP3 players), cameras, video cameras, computers (e.g., laptops, desktops), personal digital assistants, televisions, displays (e.g., LCD, plasma), household appliances (e.g., microwaves, cookware, washers, dryers), video playback and recording devices (e.g., DVD players, digital video recorders), other handheld devices (e.g., calculators, GPS devices) and the like. In other embodiments, the decorative shape cast product is a product for other industries, such as products for any of the medical device, sporting goods, automotive or aerospace industries, among others.

E. Selection of Shape Cast Product Microstructure and Alloy Composition

Figure 3A:
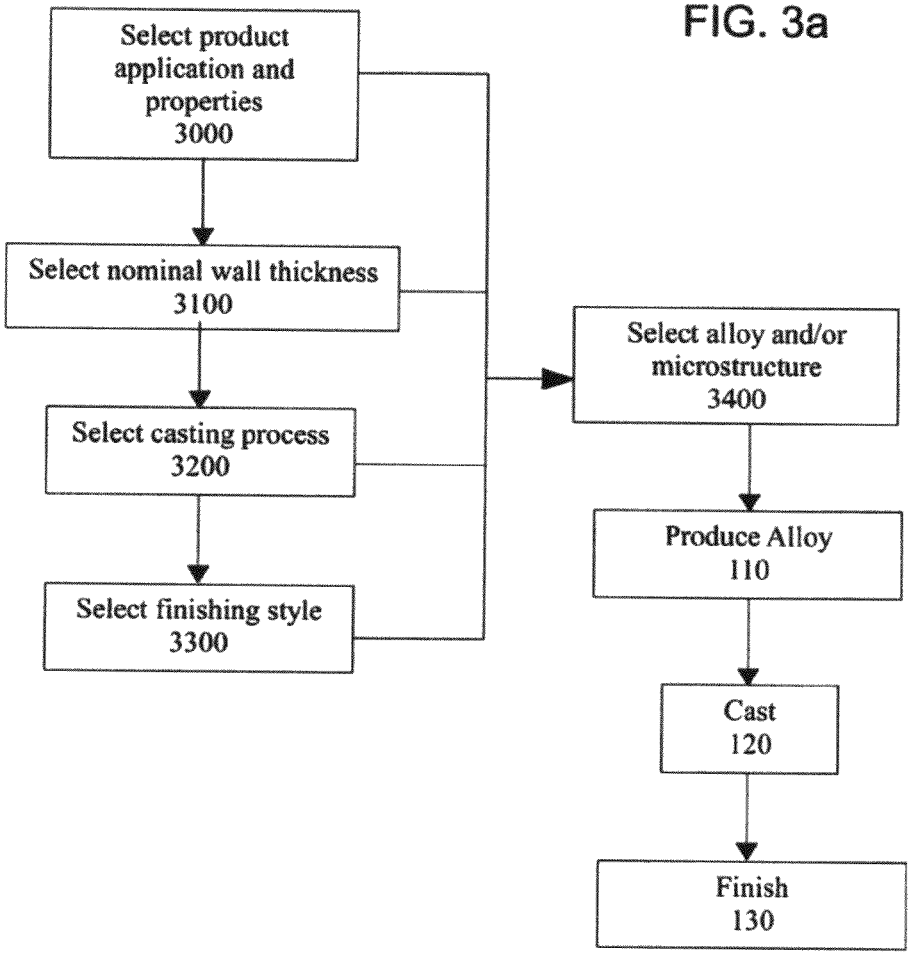
FIG. 3*a* is a flow diagram illustrating one embodiment of a method for producing a decorative shape cast product in accordance with the present disclosure.

The microstructure of the shape cast products may affect one or more properties of the end product, such as surface defects, strength, color uniformity, brightness, grayness, and corrosion resistance, among others. Therefore, in some embodiments, it may be useful to determine the product application (e.g., mobile electronic device cover) and corresponding properties (e.g., strength, brightness), nominal wall thickness, casting process, and/or finishing style to facilitate determination of the appropriate alloy composition and microstructure. In one embodiment, and with reference to FIG. 3*a*, a method may include selecting a shape cast product application and properties (3000), selecting the nominal wall thickness for the product application (3100), selecting the shape casting process (3200), and selecting the finish style for the product application (3300). In response to, and based on at least one of these steps, the appropriate alloy composition and/or microstructure may be selected (3400). These steps may be completed in any suitable order. For example, in one instance, finishing style (3300) and then product application and properties (3000) may be selected, after which the nominal wall thickness (3100) and/or casting process (3200) may be selected. A predetermined microstructure and/or alloy composition (3400) may then be selected so as to achieve the desired finishing style (3300) and properties (3000), and within the realms of the selected casting (3200) and nominal wall thickness (3100) requirements. In response to one or more of these selections, the method may include producing the alloy (110), shape casting the alloy into a shape cast product (120) and finishing (130) the shape cast product into a decorative shape cast product. The decorative shape cast product may achieve the selected properties and achieve the selected finishing style due to, at least in part, the selected alloy composition and corresponding microstructure.

Figure 3B:
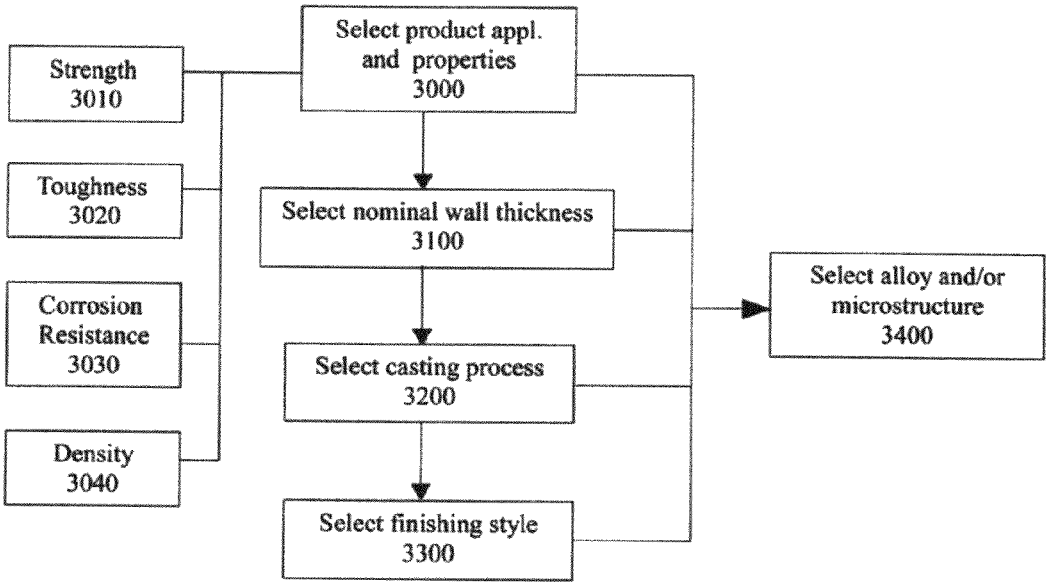
FIG. 3*b* is a flow diagram illustrating some of the decorative shape cast product properties that may be selected in accordance with some embodiments of the method of FIG. 3*a*.
Figure 3C:
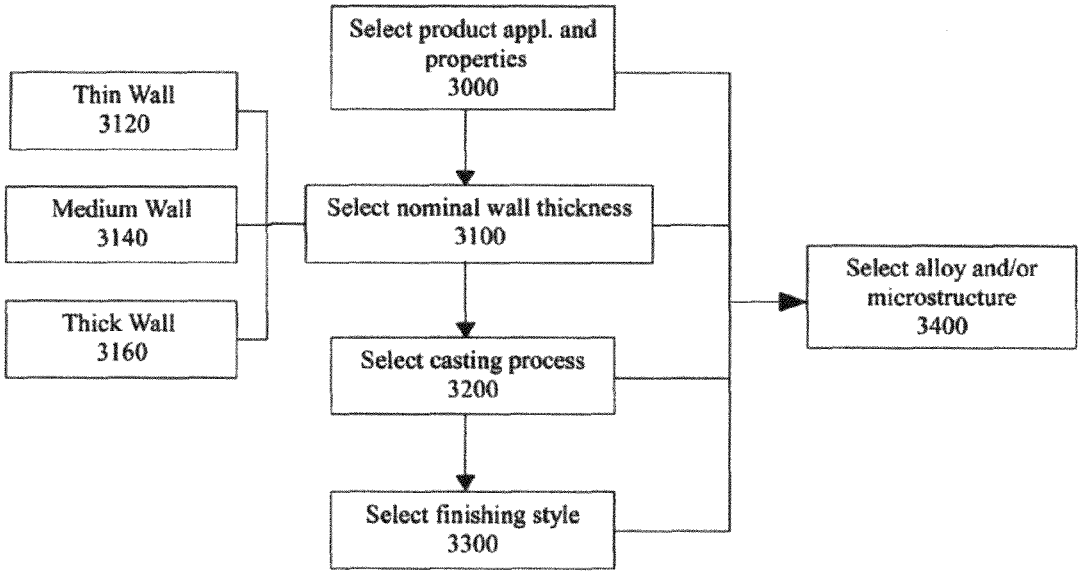
FIG. 3*c* is a flow diagram illustrating various nominal wall thicknesses of a decorative shape cast product that may be selected in accordance with some embodiments of the method of FIG. 3*a*.
Figure 3D:
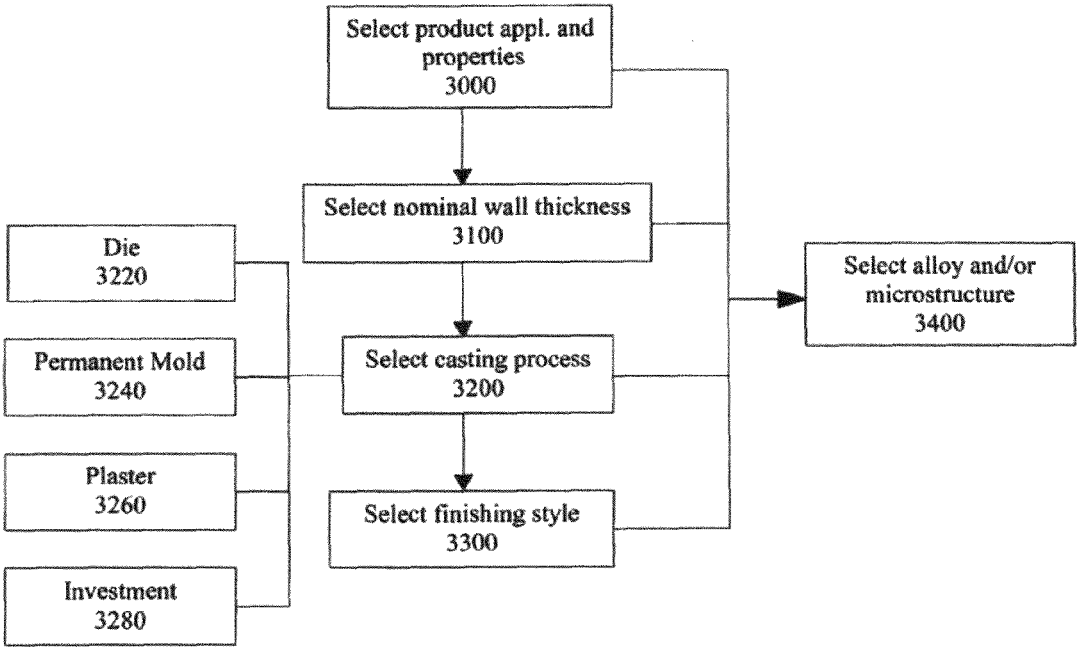
FIG. 3*d* is a flow diagram illustrating some of the casting processes that may be selected to produce a decorative shape cast product in accordance with some embodiments of the method of FIG. 3*a*.
Figure 3E:
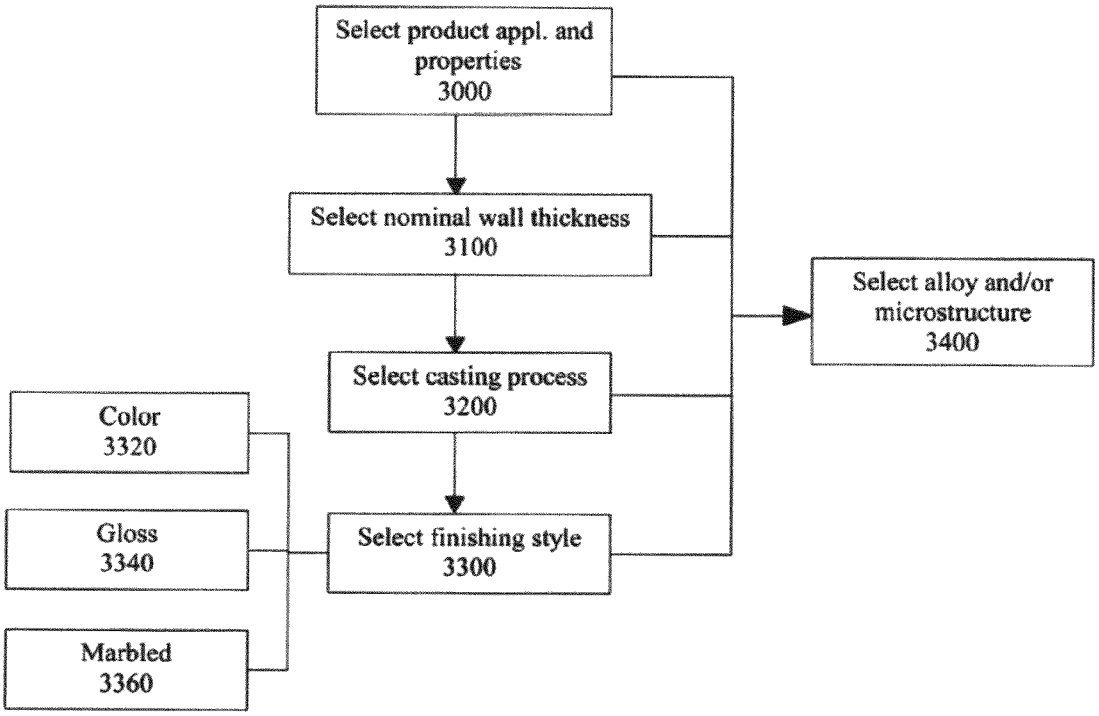
FIG. 3*e* is a flow diagram illustrating some of the finishing properties that may be selected for a decorative shape cast product according to some embodiments of the method of FIG. 3*a*.

Generally, the properties of the shape cast product contribute to the selection of the microstructure of the shape cast product and/or the alloy used to produce the shape cast product. Some properties of interest include strength (3010), toughness (3020), corrosion resistance (3030), and density (3040), among others, as illustrated in FIG. 3*b*. In one example, once the product application and required properties (3000) and/or finishing style (3300) are selected, the nominal wall thickness, such as any one of thin wall (3120), medium wall (3140), or thick wall (3160), as described above, may be selected (3100), as illustrated in FIG. 3*c*. The casting process may be selected (3200), at least in part, based on at least one of the selected nominal wall thickness (3100), the product application and properties (3000) and/or finishing style (3300). For some product applications, as illustrated in FIG. 3*d*, the casting process will be a die casting process (3220), such as high pressure die casting, which is generally economical in producing decorative shape cast products. However, other casting process, such as permanent mold (3240), plaster (3260), investment casting (3280), among others (e.g., semi-solid casting, Thixomolding), may be used to produce the decorative shape cast products. The selection of the finishing style (3300) may be completed by the customer, and generally includes selection of a color (3320) (e.g., a predetermined color defined by a CIELAB value and associated tolerances), gloss (3340) (e.g., a predetermined gloss) and/or surface defect view (e.g., for marbled products), as illustrated in FIG. 3*e*, among others.

Once one or more of the shape cast product application and properties (3000), the nominal wall thickness (3100), the shape casting process (3200), and/or the finish style for the product application (3300) are selected, the appropriate microstructure and/or alloy composition may be selected. For example, and with reference to FIG. 3*f*, a layered microstructure (3420) or a homogeneous microstructure (3430) may be selected as the microstructure (3410), depending on requirements. Generally, the desired microstructure (3410) of the shape cast alloy is selected prior to alloy selection, as finishing requirements generally take precedent since the microstructure of those shape cast products may be visible due to the finishing (130) process used. For some products, the alloy (3440)-(3460) may be selected first so as to tailor the strength and other properties of the shape cast product. Depending on requirements, an Al—Ni (3440), Al—Ni—Mn (3450), or other casting alloy (3460) may be selected. Considerations for the selection of the appropriate alloy include the castability (3470) of the alloy, the ability of the alloy to meet the property requirements (3480), and the ability of the alloy to meet the finishing requirements (3490).

i. Layered Microstructure

Figure 3F:
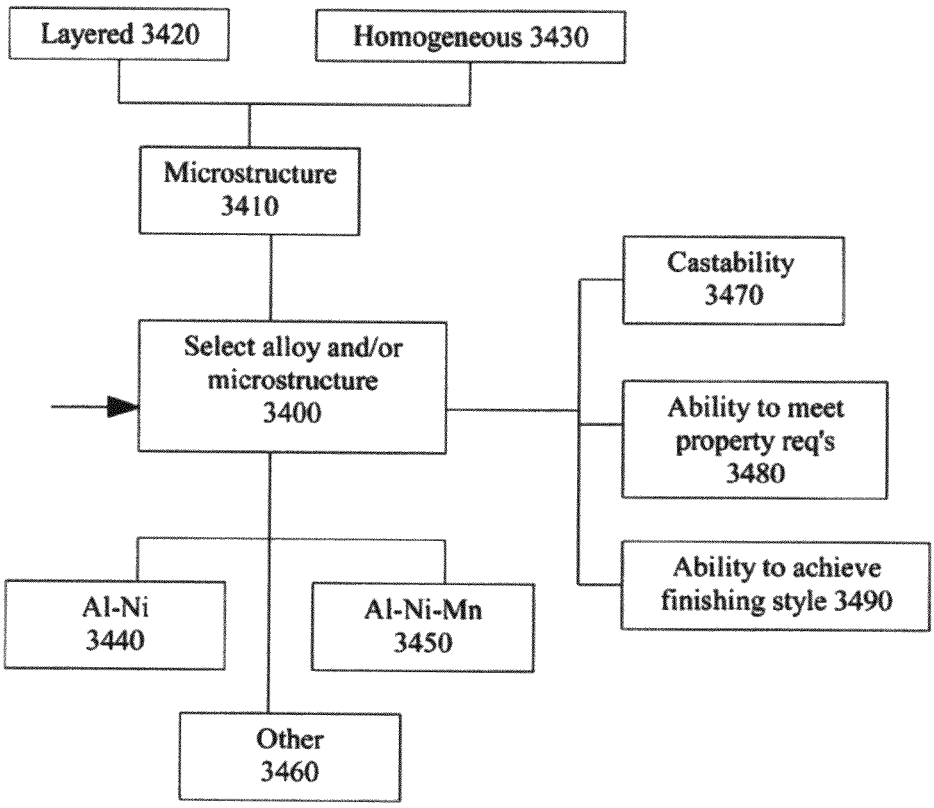
FIG. 3*f* is a flow diagram illustrating the selection of particular alloys and microstructures according to some embodiments of the method of FIG. 3*a*.
Figure 3G:
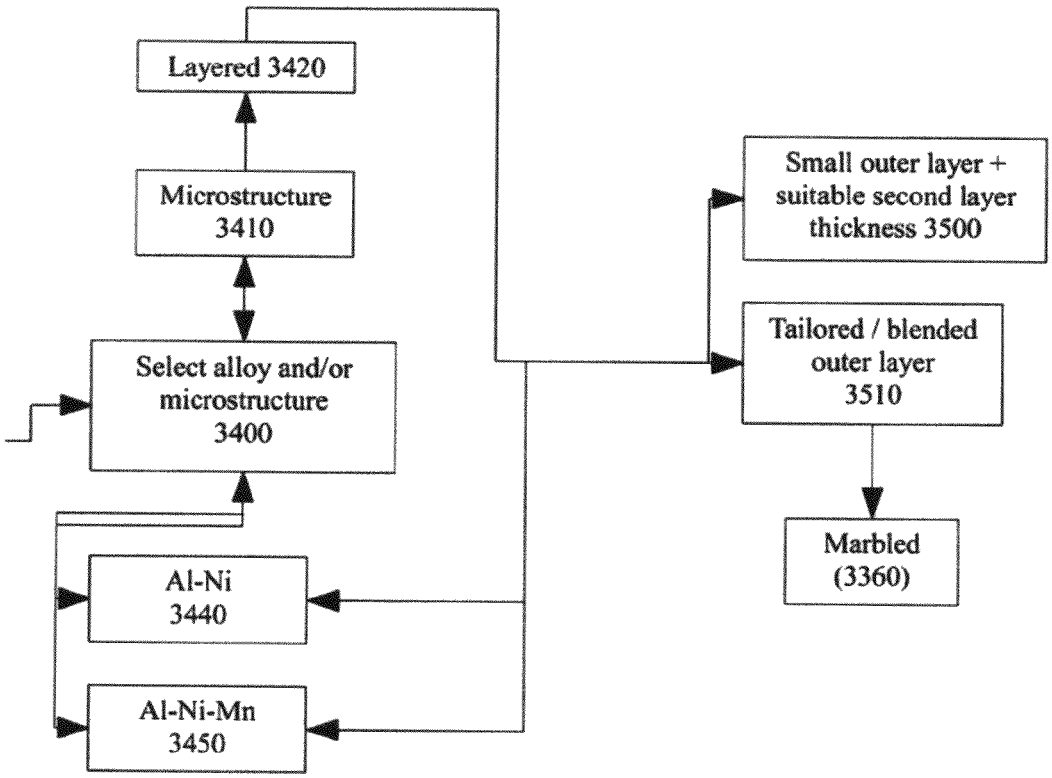
FIG. 3*g* is a flow diagram illustrating one embodiment of a method for producing a decorative shape cast product having a layered microstructure according to the method of FIG. 3*a*.
Figure 3H:
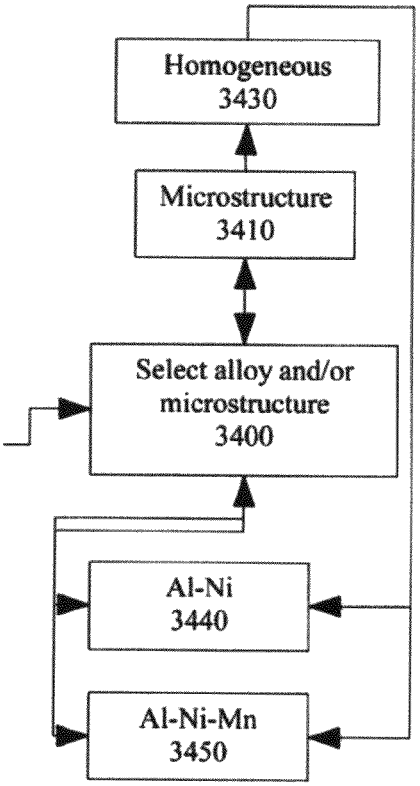
FIG. 3*h* is a flow diagram illustrating one embodiment of a method for producing a decorative shape cast product having a homogeneous microstructure according to the method of FIG. 3*a*.
Figure 4B:
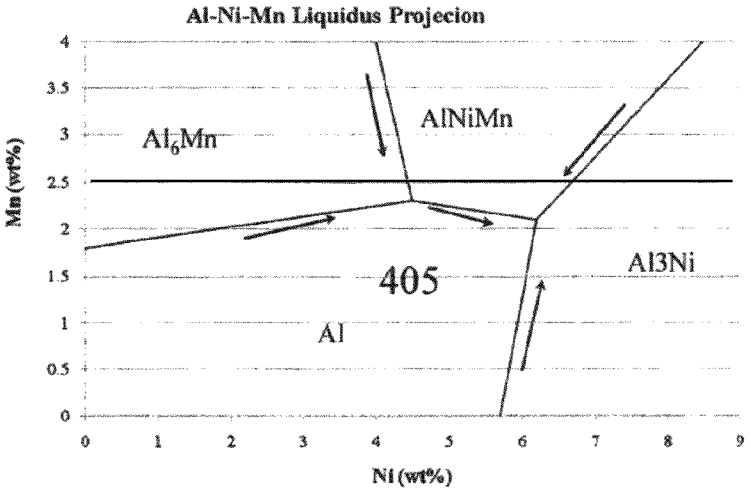
FIG. 4*b* is a liquidus projection for the ternary Al—Ni—Mn system.

With reference now to FIG. 3*g*, a layered microstructure (3420) may be used for some finishing applications. A layered microstructure may be useful in product applications where a small amount (or no) surface defects is required. To achieve a layered microstructure (3420), a hypereutectic alloy composition may be selected. For Al—Ni alloys, the eutectic point occurs at the eutectic composition of about 5.66 wt. % Ni, and the eutectic temperature of about 639.9° C., as illustrated in FIG. 4*a*. Thus, alloys having more than 5.66 wt. % Ni are considered hypereutectic for Al—Ni alloys. For Al—Ni—Mn alloys, the eutectic point occurs at the eutectic composition of about 6.2 wt. % Ni, and about 2.1 wt. % Mn, at a eutectic temperature of about 625° C., as illustrated in FIG. 4*b*. Thus, alloys falling outside of region 405 of FIG. 4*b*, may be considered hypereutectic for Al—Ni—Mn alloys.

Figure 5A:
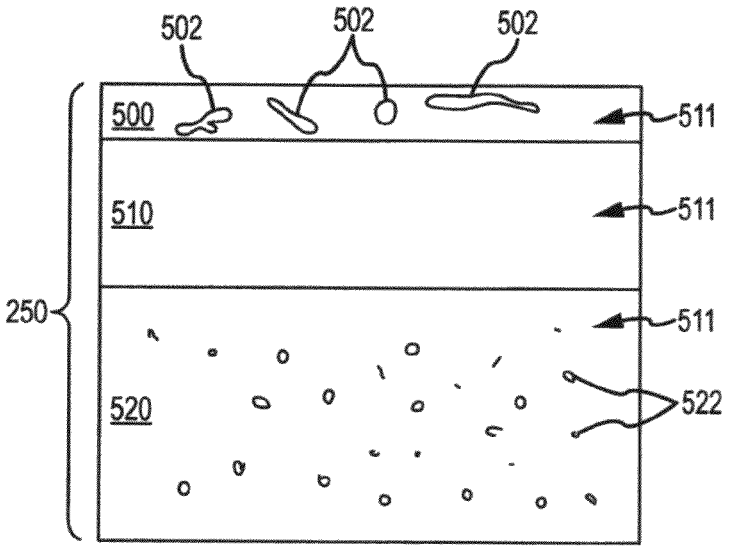
FIG. 5*a* is a cross-sectional, schematic view of one embodiment of a layered microstructure of a shape cast product.

One example of a layered microstructure (3420) is illustrated in FIG. 5*a*. In the illustrated embodiment, a casting process produces a cast product having multiple layers, a section of which 250 is illustrated in FIG. 5*a*. The illustrated cast product has at least an outer portion 500, a second portion 510, and a third portion 520.

In some aluminum alloys (e.g., Al—Ni and/or Al—Ni—Mn), the outer portion 500 may be in the form of a layer containing both eutectic microstructure 511 and a non-negligible amount of alpha-aluminum phase 502 (sometimes known as dendrites). The thickness of this layer will depend on the casting alloy used and the casting conditions, but the outer portion 500 of a cast product produced from a hypereutectic alloy generally has a thickness of not greater than about 500 microns. In other embodiments, the outer portion of a cast product may have a thickness of not greater than about 400 microns, or not greater than about 300 microns, or not greater than about 200 microns, or not greater than about 175 microns, or not greater than about 150 microns, or not greater than about 125 microns, or not greater than about 100 microns, or not greater than about 75 microns, or less.

In some embodiments, it may be useful to restrict the thickness of this outer layer 500, e.g., due to the non-uniform distribution of the alpha-aluminum phase 502. In these embodiments, it may be useful to select a hypereutectic alloy composition that deviates by one-percent or more from the eutectic composition (e.g., for thin walled shape cast products). For shape cast products intended to restrict the amount of surface defects, it is generally useful to restrict the thickness of this type of outer layer 500, as at least a portion of it may have to be removed during some finishing processes, as described in further detail below. Due to non-equilibrium solidification conditions that are encountered during the casting process (e.g., under cooling, described below), the use of a eutectic or hypoeutectic composition could result in a thick outer layer 500, whereas a hypereutectic alloy composition may result in a thinner outer layer 500.

Figure 6A:
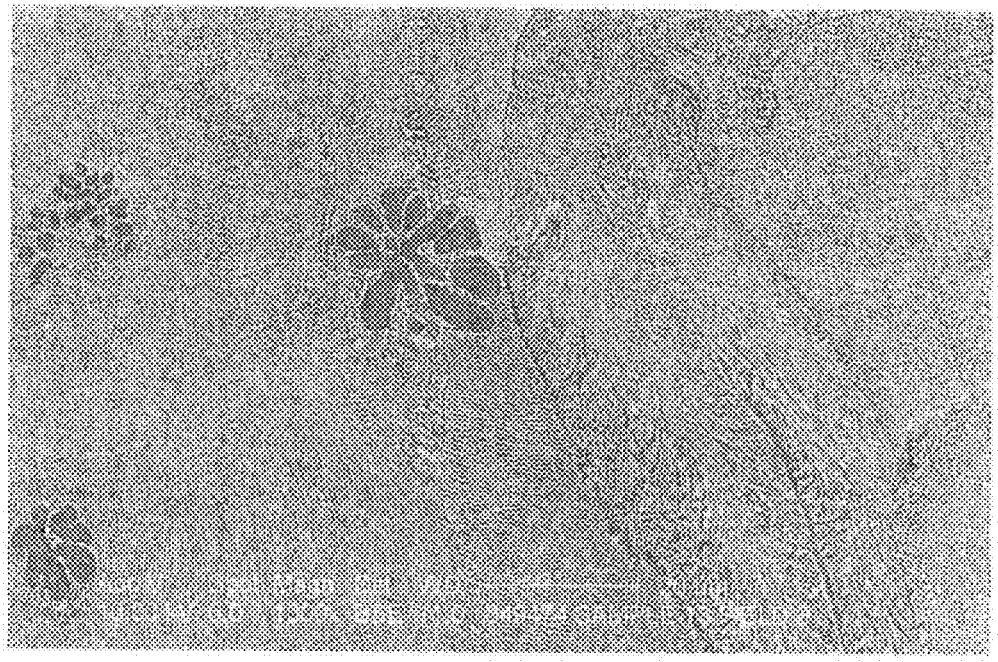
FIG. 6*a* is a micrograph illustrating the microstructure of an Al—Ni—Mn shape cast product produced in accordance with the present disclosure, and containing about 6.9 wt. % Ni, 2.9 wt. % Mn, the balance being aluminum, incidental elements and impurities.

One embodiment of a first layer 500 produced from a hypereutectic Al—Ni—Mn alloy is illustrated in FIG. 6*a*. The layer has a eutectic microstructure (light portions) with alpha-aluminum (dark, flower petal-like portions) interspersed therein. In this case, the casting alloy contains about 6.9 wt. % Ni and 2.9 wt. % Mn, the balance being aluminum, incidental elements and impurities.

In some instances, and referring now back to FIG. 5*a*, a layered microstructure may be useful to accentuate surface defects, e.g., for a marbled style finish, or where high strength is useful (e.g., due to the presence of higher amounts of Ni and/or Mn). For these type of shape cast products, it may be useful to ensure the creation of an outer portion 500 having a fairly regular distribution of the alpha-aluminum phase 502 and eutectic microstructure 511 at the intended viewing surface of the shape cast product. In these embodiments, after finishing processes, described below, the alpha-aluminum phase 502 may at least partially contribute to the production of a marble-like finish since the alpha aluminum phase 502 may create different colors within the finished eutectic microstructure, and may create readily distinguishable patterns that are similar to those of marble. In these embodiments, it may be useful to select a hypereutectic or hypoeutectic alloy composition that is closer, or near to, the eutectic composition. For these marbled finish embodiments, the outer layer 500 may have a thickness of at least about 20 microns. In other embodiments, for these marbled finish embodiments, the outer layer 500 may have a thickness of at least about 40 microns, or at least about 60 microns, or at least about 80 microns, or at least about 100 microns, or more.

In some of these embodiments, the shape cast product may be contacted by (e.g., immersed in) at least one colorant (e.g., a dye), as described below, and at least some of the pores of the oxide layer of the shape cast product may be at least partially filled with colorant. In one embodiment, the shape cast product is contacted by a single colorant. In one embodiment, the alpha aluminum phase of the shape cast product comprises a first color due to the colorant, and the eutectic microstructure of the shape cast product comprises a second color due to the colorant. The second color is generally different than the first color due to the inherent difference in properties between the alpha aluminum phase and the eutectic microstructure. The combination of the fairly regular distribution of the alpha aluminum phase and the eutectic microstructure, along with the combination of the first color of the alpha aluminum phase and the second color of the eutectic microstructure, may at least partially contribute to the production of shape cast products having a marbled appearance at their intended viewing surface.

Figure 6B:
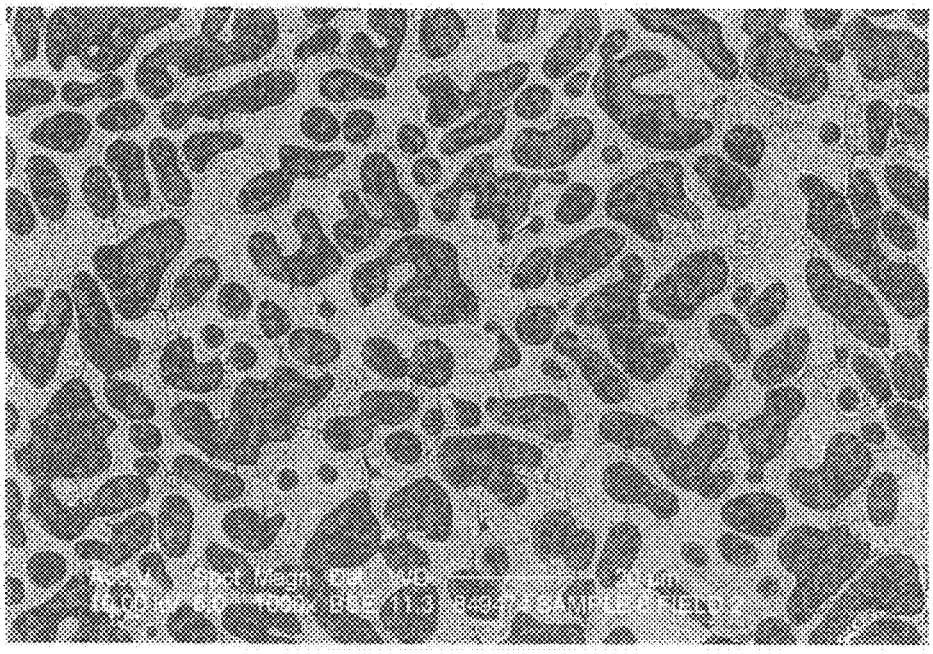
FIG. 6*b* is a micrograph illustrating the microstructure of an Al—Ni—Mn shape cast product produced in accordance with the present disclosure, and containing about 4 wt. % Ni, 2 wt. % Mn, the balance being aluminum, incidental elements and impurities.

One embodiment of a first layer 500 produced from a hypoeutectic composition is illustrated in FIG. 6*b*. The layer has a eutectic microstructure (light portions) with alpha-aluminum phase (dark globular portions) interspersed therein. In this case, the casting alloy contains about 4 wt. % Ni and 2 wt. % Mn, the balance being aluminum, incidental elements and impurities. As illustrated, the alpha-aluminum phase regularly forms at the surface of the alloy, providing the necessary differentiation between that of the eutectic microstructure, which may result in the production of a marbled effect in the finished product.

Referring back to FIG. 5*a*, the second portion 510 may comprise a predominate amount of eutectic microstructure 511. Shape cast products having high color uniformity may be produced from Al—Ni and/or Al—Ni—Mn alloys having a eutectic microstructure 511 at or near the surface of the cast product. In one embodiment, the second portion 510 comprises all, or nearly all, eutectic microstructure 511, as illustrated. Similarly, the second portion 510 may be substantially free of alpha aluminum phase 502 and/or intermetallics 522 (described below). In some embodiments, the second portion 510 contains less than 5 vol. %, or even less than 1 vol. %, alpha aluminum phase 502 and/or intermetallics 522.

The thickness of the second portion 510 layer will depend on the casting alloy used and the casting conditions, but the second portion generally has a thickness of at least about 25 microns. In one embodiment, the second portion has a thickness of at least about 50 microns. In other embodiments, the second portion 510 has a thickness of at least about 100 microns, or at least about 150 microns, or at least about 200 microns, or at least about 300 microns, or at least about 400 microns, or at least about 500 microns. The second portion 510 generally has a thickness of less than about 1000 microns. Furthermore, since the outer layer 500 generally comprises alpha-aluminum phase, it may be useful to produce cast products that have a generally large second portion 510, while having a generally small outer portion 500, such as in shape cast products intended to have a restricted amount of visually apparent surface defects.

The third portion 520 follows the second portion, and may include, among other features, intermetallics 522 (e.g., $Al_3Ni$). In this embodiment, the third portion generally makes up the remainder of the shape cast product. This portion is generally not viewed by the human eye due to its depth below the outer surface of the final product.

Production of shape cast products having a predominate amount of eutectic microstructure may be facilitated by the use of Al—Ni and/or Al—Ni—Mn alloys having higher amounts of Ni and/or Mn, as described in further detail below.

ii. Homogeneous Microstructure

Figure 5B:
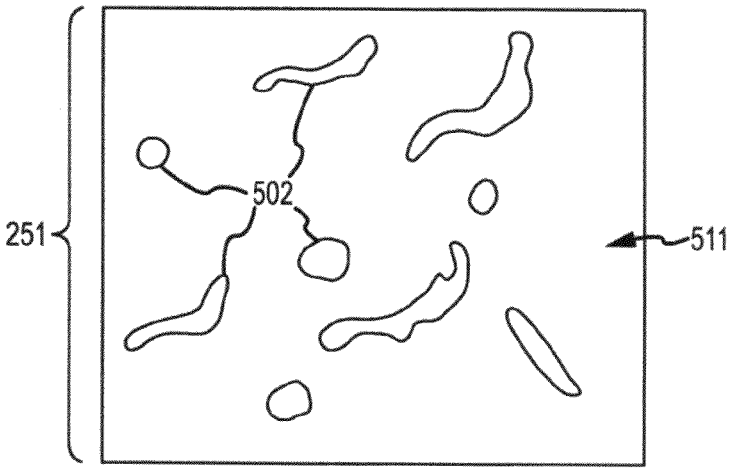
FIG. 5*b* is a cross-sectional schematic view of one embodiment of a homogenous microstructure of a shape cast product.

In another embodiment, and with reference now to FIGS. 3*f* and 5*b*, the shape cast product may include a homogeneous microstructure (3430). This homogeneous, or near homogenous, microstructure may facilitate successful finishing process as described in further detail below. A homogeneous microstructure is one that contains a fairly regular distribution of alpha aluminum phase 502, as opposed to a "patchy" distribution of alpha aluminum phase 502 (e.g., as would be produced with hypereutectic alloys experiencing under cooling conditions). In the illustrated embodiment, a casting process produces a cast product having a homogenous microstructure, a section of which 251 is illustrated. The illustrated cast product has a single homogenous layer 251, which contains a fairly regular distribution of alpha-aluminum phase 502 within a eutectic microstructure 511.

Production of shape cast products having a homogenous microstructure may be facilitated by the use of Al—Ni and/or Al—Ni—Mn alloys having lower amounts of Ni. To achieve a homogenous microstructure, a hypoeutectic alloy composition may be selected. Alloys having less than about 5.6 wt. % Ni are considered hypoeutectic for Al—Ni alloys. Alloys falling within region 405 of FIG. 4*b*, may be considered hypoeutectic for Al—Ni—Mn alloys.

Figure 6C:
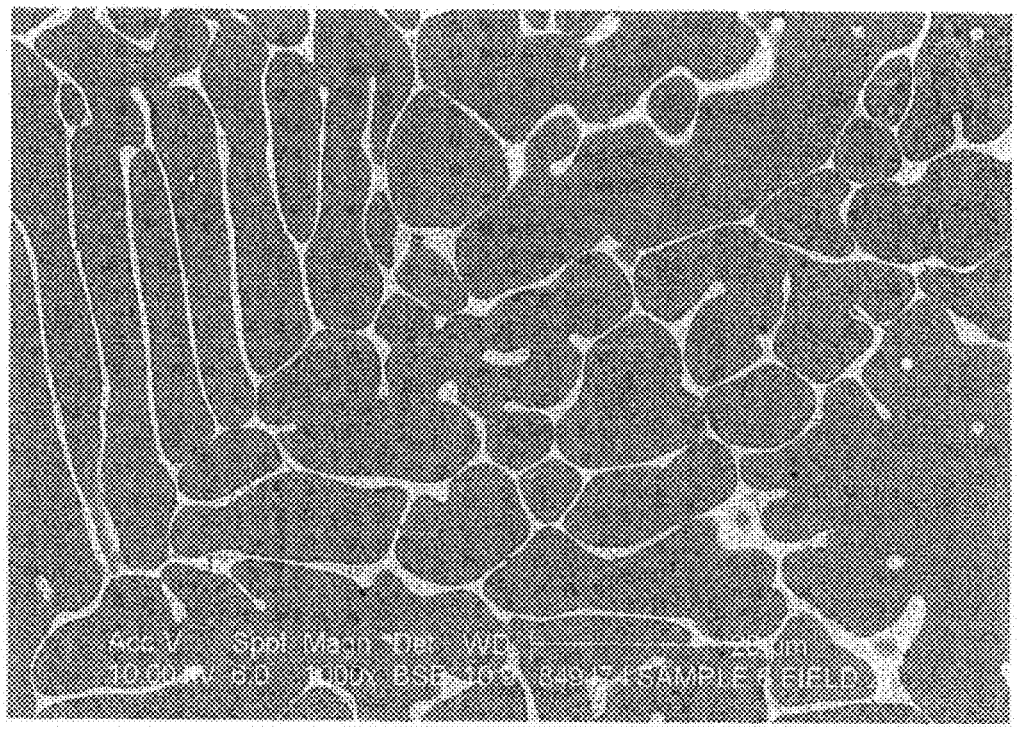
FIG. 6*c* is a micrograph illustrating the microstructure of an Al—Ni—Mn shape cast product produced in accordance with the present disclosure, and containing about 1 wt. % Ni, 2 wt. % Mn, the balance being aluminum, incidental elements and impurities.

One embodiment of a homogenous microstructure is illustrated in FIG. 6*c*. As illustrated, the cast product contains a fairly regular distribution of alpha-aluminum phase (dark portions) in a eutectic microstructure (light portions). In this case, the casting alloy contains about 1 wt. % Ni and 2 wt. % Mn, the balance being aluminum, incidental elements and impurities.

The production of shape cast products having a homogenous microstructure may be more cost effective than those having a layered microstructure since the amount of under cooling might not need to be strenuously regulated when producing shape cast products having a homogenous microstructure. This is due to the fact that alpha-aluminum phase forms as a product of equilibrium solidification in these hypoeutectic alloys, whereas the alpha-aluminum phase forms due to non-equilibrium solidification for the hypereutectic alloys.

The specific details of the various compositions, systems, methods, and apparatus that may be used to create the visually appealing, shape cast products are described in detail below.

I. Aluminum Alloys Useful in Producing Shape Cast Products

Figure 7:
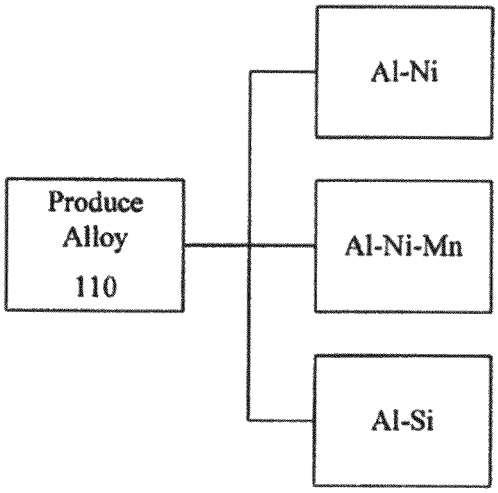
FIG. 7 is a chart illustrating some casting alloys that may be used to produce decorative shape cast products in accordance with the present disclosure.

Referring now to FIG. 7, the shape cast products described herein are generally produced from aluminum casting alloys (110). Suitable aluminum casting alloys include those aluminum alloys that are capable of achieving a visually attractive and/or durable end product. For example, the aluminum alloy may be capable of realizing a commercially acceptable finish, and in an anodized state, as described in further detail below. In one embodiment, the aluminum alloy is an Al—Ni casting alloy. In other embodiments, the alloy is an Al—Ni—Mn casting alloy. Other casting alloys may be used, as described in further detail below.

A. Al—Ni Casting Alloys

Al—Ni casting alloys have good combination of strength, electrochemical formability (e.g., anodizability), and castability, among other properties. In some embodiments, the Al—Ni alloys have a high brightness and/or low grayness. In general, an Al—Ni casting alloy comprises (and some instances consists essentially of) from about 0.5 wt. % to about 8.0 wt. % Ni, the balance being incidental elements and impurities. In one embodiment, the amount of Ni in the Al—Ni alloy is selected so as to produce the desired microstructure (layered or homogenous) in the shape cast product, and in the as-cast condition, based on the selected casting conditions. Alloys having more than 8.0 wt. % Ni may realize the production of intermetallics (e.g., $Al_3Ni$) within the outer layer of the shape cast product, and/or may be brittle. Alloys having less than 0.5 wt. % Ni may not achieve one or more of the properties described herein.

In one embodiment, and as described above, the amount of nickel is selected so that the shape cast product will have layered microstructure with a thin outer layer and a second layer of suitable thickness. These embodiments may be useful for thin walled shape cast products having a restricted amount of visually apparent surface defects. In some of these embodiments, nickel is in the range of from about 5.7 wt. % to about 6.9 wt. %. In one embodiment, and as described above, the amount of nickel is selected so that the shape cast product will have an outer layer having an irregular distribution of alpha aluminum phase (e.g., as illustrated in FIG. 5*a*, reference numeral 502). These embodiments may be useful for thin walled shape cast products having marbled finish. In some of the embodiments, nickel is in the range of from about 5.4 wt. % to 6.6 wt. %. In one embodiment, and as described above, the amount of nickel is selected so that the shape cast product will have a homogenous microstructure. In some of these embodiments, nickel is in the range of from about 2.8 wt. % to about 5.2 wt. %.

B. Al—Ni—Mn Casting Alloys

Al—Ni—Mn casting alloys are useful for many shape cast products. Al—Ni—Mn alloys have a good combination of strength, electrochemical formability (e.g., anodizability), and castability, among other properties. In some embodiments, the hypereutectic Al—Ni—Mn alloys have a high brightness and/or a low grayness.

Al—Ni—Mn alloys may contain from about 0.5 wt. % to about 8.0 wt. % nickel, for the same reasons described above relative to the Al—Ni alloys. The Al—Ni—Mn alloys also contain purposeful additions of Mn (e.g., to increase the strength of the alloy and/or reduce die sticking and/or soldering), and usually in the range of 0.5% to 3.5 wt. % Mn. In one embodiment, the amount of Ni and Mn in the Al—Ni—Mn alloy is selected so as to produce the appropriate microstructure (layered or homogenous) in the shape cast product, and in the as-cast condition.

In one embodiment, an Al—Ni—Mn alloy includes Ni in the range of from about 6.6 wt. % to about 8.0 wt. %. In these embodiments, the Al—Ni—Mn alloy includes at least about 0.5 wt. % Mn, and generally from about 1.0 wt. % Mn to about 3.5 wt. % Mn. In another embodiment, an Al—Ni—Mn alloy includes Ni in the range of from about 2 wt. % to about 6 wt. %. In some of these embodiments, the Al—Ni—Mn alloy may include Mn in the range of from about 3.1 wt. % to about 3.5 wt. %. In others of these embodiments, the Al—Ni—Mn alloy may include Mn in the range of from about 0.5 wt. % to about 3.0 wt. %.

In one embodiment, and as described above, the amount of nickel and manganese is selected so that the shape cast product will have a layered microstructure having a thin outer layer and suitably sized second layer. These embodiments may be useful for thin walled shape cast products having a restricted amount of visually apparent surface defects. In some of these embodiments, nickel is in the range of from about 5.7 wt. % to about 7.1 wt. %, and manganese is in the range of from about 1.8 wt. % to about 3.1 wt. %. In one embodiment, and as described above, the amount of nickel and manganese is selected so that the shape cast product will have an outer layer having an irregular distribution of alpha aluminum phase (e.g., as illustrated in FIG. 5*a*, reference numeral 502). In some of these embodiments, nickel is in the range of from about 5.6 wt. % to about 6.8 wt. %, and manganese is in the range of from about 2.0 wt. % to about 3.2 wt. %. These embodiments may be useful for thin walled shape cast products having marbled finish. In one embodiment, and as described above, the amount of nickel and manganese is selected so that the shape cast product will have a homogenous microstructure. In some of these embodiments, nickel is in the range of from about 1.8 wt. % to about 3.2 wt. %, and manganese is in the range of from about 0.8 wt. % to about 3.2 wt. %.

In some embodiments, the alloy is the Al—Ni—Mn alloy disclosed in U.S. Pat. No. 6,783,730, issued Aug. 31, 2004, to Lin et al., and entitled "Al—Ni—Mn casting alloy for automotive and aerospace structural components", which is incorporated herein by reference in its entirety.

C1. Creation of Layered Microstructure Having a Thin Outer Layer

In one embodiment, to create visually appealing shape cast products, a eutectic microstructure may be created at or near the intended viewing surface of the shape cast product. For example, and with reference to FIG. 5*a*, the shape casting production parameters e.g., composition selection, die temperature, cooling rate, melt temperature) may be chosen/tailored so that the thickness of the outer layer 500 is restricted (e.g., relatively small, such as not greater than about 100 microns), while the thickness of the second layer 510 is of a suitable thickness. The nearly complete eutectic microstructure 511 of the second layer 510 may facilitate a uniform grayness and/or brightness level of the product, even after anodizing, which may facilitate visually attractive end products. Furthermore, reducing the thickness of the outer layer 500 may facilitate its removal during subsequent finishing operations. This outer layer 500 may be removed to facilitate production of decorative shape cast products having a finish that meets consumer acceptance standards. The compositions used to create shape cast products having these types of layered microstructures are generally hypereutectic compositions. Some embodiments of useful hypereutectic Al—Ni and Al—Ni—Mn compositions for creating these types of layered microstructures are provided in Table 1, below.

TABLE 1

Examples of Hypereutectic Compositions For Creating A Layered Microstructure Having a Small Outer Layer and a Suitable Second Layer

| Shape Cast | Layered Microstructure | |
|---|---|---|
| Product Thickness | Al—Ni | Al—Ni—Mn |
| ≤about 1 mm | 6.7 ± 0.2 wt. % Ni | 6.9 ± 0.2 wt. % Ni<br>2.9 ± 0.2 wt. % Mn |
| about 1 to about 2 mm | 6.2 ± 0.2 wt. % Ni | 6.4 ± 0.2 wt. % Ni<br>2.3 ± 0.2 wt. % Mn |
| about 2 to about 6 mm | 5.7 ± 0.2 wt. % Ni | 6.2 ± 0.2 wt. % Ni<br>2.1 ± 0.2 wt. % Mn |

In general, as the nominal wall thickness increases, the alloy composition required to restrict the thickness of the outer layer is closer to the eutectic composition of the alloy since thicker products will cool at a rate closer to equilibrium cooling conditions.

These types of layered microstructures may be useful for creating products having a restricted amount of visually apparent surface defects, and with a colorant at least partially disposed within the oxide layer of the shape cast product. For example, and with reference to FIGS. 3*a*-3*g*, a method may include selecting a finish (3300), selecting a shape cast product application (3000) (e.g., high strength mobile electronic device cover), selecting the nominal wall thickness for the product application (3100) (e.g., thin walled (3120), such as about 0.7 mm), and selecting the shape casting process (3200) (e.g., die casting (3220), such as HPDC). Based on one or more of these selections (3000-3300), a suitable Al—Ni (3440) or Al—Ni—Mn (3450) composition may be selected so that a layered microstructure (3420) is created and which has a relatively thin outer layer and a suitably sized second layer (3500). The method may further include producing the alloy (110), shape casting the alloy into a shape cast product (120) and finishing (130) the shape cast product into a decorative shape cast product. The finished decorative shape cast product may be substantially free of visually apparent surface defects, may have a bright surface, may have a low grayness, and/or may have color and/or gloss uniformity due to, at least in part, the selected microstructure and/or alloy composition.

In one embodiment, an aluminum casting alloy consists essentially of from about 6.6 to about 8.0 wt. % Ni, from about 0.5 to about 3.5 wt. % Mn, up to about 0.25 wt. % of any of Fe and Si, up to about 0.5 wt. % of any of Cu, Zn, and Mg, up to about 0.2 wt. % of any of Ti, Zr, and Sc, wherein one of B and C may be included up to about 0.1 wt. %, and up to about 0.05 wt. % of other elements, wherein the total of the other elements does not exceed 0.15 wt. %, the balance being aluminum.

C2. Creation of Tailored, Blended Alpha-Aluminum Phase for Marbled Products

In one embodiment, to create visually appealing marbled products, a tailored, blended mixture of alpha-aluminum phase and eutectic microstructure may be created at the intended viewing surface of the shape cast product. The compositions used to create a tailored, blended alpha-aluminum phase and eutectic microstructures may be any of a eutectic, hypereutectic, or hypoeutectic composition, and is generally related to product thickness and/or casting conditions (e.g., cooling rate). Some embodiments of useful Al—Ni and Al—Ni—Mn compositions for creating blended alpha-aluminum and eutectic microstructures are provided in Table 2, below.

TABLE 2

Examples of Hypereutectic Compositions For Creating Blended Alpha-Aluminum Phase and Eutectic Microstructure for Marbled Products

| Shape Cast | Blended Microstructure | |
|---|---|---|
| Product Thickness | Al—Ni | Al—Ni—Mn |
| ≤about 1 mm | 6.4 ± 0.2 wt. % Ni | 6.6 ± 0.2 wt. % Ni,<br>3.0 ± 0.2 wt. % Mn |
| about 1 to about 2 mm | 6.0 ± 0.2 wt. % Ni | 6.2 ± 0.2 wt. % Ni<br>2.6 ± 0.2 wt. % Mn |
| about 2 to about 6 mm | 5.6 ± 0.2 wt. % Ni | 5.8 ± 0.2 wt. % Ni<br>2.2 ± 0.2 wt. % Mn |

These types of blended microstructures may be useful for creating marbled products. For example, and with reference to FIGS. 3*a*-3*g*, a method may include selecting a finish (3300), selecting a shape cast product application (3000) (e.g., high strength mobile electronic device cover), selecting the nominal wall thickness for the product application (3100) (e.g., thin walled (3120), such as about 0.7 mm), and selecting the shape casting process (3200) (e.g., die casting (3220), such as HPDC). Based on one or more of these selections (3000-3300), a suitable Al—Ni (3440) or Al—Ni—Mn (3450) composition may be selected so that a blended microstructure (3510) is created at the intended viewing surface of the shape cast product. The method may include producing the alloy (110), shape casting the alloy into a shape cast product (120) and finishing (130) the shape cast product into a decorative shape cast product. The marble finished decorative shape cast product (3360) may be have a marbled finish and/or have a bright surface that meet consumer acceptance standards due to, at least in part, the selected alloy microstructure and/or composition.

C3. Creation of Homogenous Microstructure

In one embodiment, to create visually shape cast products, a homogenous microstructure may be created. This homogenous microstructure may facilitate a uniform grayness and/or brightness level of the product, even after anodizing, which may facilitate visually attractive end products. The compositions used to create homogenous microstructures are generally hypoeutectic. Some embodiments of useful Al—Ni and Al—Ni—Mn hypoeutectic compositions that may be used to create homogenous microstructures are provided in Table 3, below.

TABLE 3

Examples of Compositions For Creating Homogenous Microstructure

| Shape Cast | Homogenous Microstructure | |
|---|---|---|
| Product Thickness | Al—Ni | Al—Ni—Mn |
| ≤about 1 mm | 5 ± 0.2 wt. % Ni | 3 ± 0.2 wt. % Ni<br>2 ± 0.2 wt. % Mn |
| about 1 to about 2 mm | 4 ± 0.2 wt. % Ni | 2.5 ± 0.2 wt. % Ni<br>1.5 ± 0.2 wt. % Mn |
| about 2 to about 6 mm | 3 ± 0.2 wt. % Ni | 2.0 ± 0.2 wt. % Ni<br>1.0 ± 0.2 wt. % Mn |

Homogeneous microstructures may be useful for creating products having a restricted amount of visually apparent surface defects, and with a colorant at least partially disposed within the oxide layer of the shape cast product, and may realize lower tensile strength but higher impact strength due to the reduction in nickel and/or manganese. In one embodiment, and with reference to FIGS. 3*a*-3*f* and 3*h*, a method may include selecting a finish (3300), selecting a shape cast product application (3000) (e.g., high strength mobile electronic device cover), selecting the nominal wall thickness for the product application (3100) (e.g., thin walled (3120), such as about 0.7 mm), and selecting the shape casting process (3200) (e.g., die casting (3220), such as HPDC). Based on one or more of these selections (3000-3300), a suitable Al—Ni (3440) or Al—Ni—Mn (3450) composition may be selected so that a homogenous microstructure (3430) is created. The method may include producing the alloy (110), shape casting the alloy into a shape cast product (120) and finishing (130) the shape cast product into a decorative shape cast product. The decorative shape cast product may be substantially free of visually apparent surface defects, may have a bright surface, may have a low grayness and/or may have color and/or gloss uniformity due to, at least in part, the selected alloy composition.

D. Incidental Elements and Impurities

The above described Al—Ni and Al—Ni—Mn alloys may include minor amounts of incidental elements and impurities, as described in further detail below. Generally, the amount of impurities should be restricted so as to facilitate attainment of applicable properties and finish characteristics. Thus, these casting alloys may be produced from a primary recycle loop, which has a low amount of impurities. These casting alloys are generally not produced from a secondary recycle loop due to the amount of impurities in these alloys.

Incidental elements includes those elements that may assist in the production of the shape cast products, such as grain refiners. Grain refiners are those elements or compounds that assist in nucleation of the grains of the alloy during solidification. One particularly useful grain refiner for shape casting is titanium (Ti). In one embodiment, the grain refiner is titanium with boron or carbon. When titanium is included in the alloy, it is generally present in an amount of at least about 0.005 wt. %. In one embodiment, a casting alloy includes at least about 0.01 wt. % Ti. In other embodiments, a casting alloy includes at least about 0.02 wt. % Ti, or at least about 0.03 wt. % Ti, at least about 0.04 wt. % Ti, at least about 0.05 wt. % Ti, or at least about 0.06 wt. % Ti. When present, the amount of titanium in the alloy generally does not exceed 0.10 wt. %. In one embodiment, a casting alloy includes not greater than about 0.09 wt. % Ti. In other embodiments, a casting alloy includes not greater than about 0.08 wt. % Ti, or not greater than about 0.07 wt. % Ti. When present, boron (B) and/or carbon (C) are included in the casting alloy in about ⅓ the amount of the titanium (e.g., B=⅓ *Ti), such as in the range of 0.001 to about 0.03 wt. % total B and/or C.

Impurities are those elements that may be present in the casting alloy due to the inherent nature of the metal smelting, alloying and casting processes. These impurities include Fe, Si, Cu, Mg, and Zn, among others. Each of these impurities may be included in the casting alloy in amounts that do not detrimentally affect the properties or appearance of the shape cast product. In general, the mechanical properties and appearance of products produced from the alloy are improved with lower amounts of Fe and Si impurities. In this regard, Fe and Si are generally present at levels of not greater than about 0.25 wt. %, but may be as high as 0.5 wt. %, in some cases. In some embodiments, Fe and Si are present at levels of up to about 0.2 wt. %, or up to about 0.15 wt. %, or up to about 0.1 wt. %, or up to about 0.05 wt. %. In one embodiment, the alloy is substantially free (e.g., containing less than about 0.04 wt. %) of Fe and Si.

With respect to Cu, Mg, and Zn, each of these impurities may be present in the casting alloy in amounts of up to about 0.5 wt. %. In other embodiments, each of these impurities may be present in the casting alloy in amounts of up to about 0.45 wt. %, or up to about 0.4 wt. %, or up to about 0.35 wt. %, or up to about 0.3 wt. %, or up to about 0.25 wt. %, or up to about 0.2 wt. %, or up to about 0.15 wt. %, or up to about 0.1 wt. %, or up to about 0.05 wt. %. In one embodiment, the alloy is substantially free (e.g., containing less than about 0.04 wt. %) of one or more of these elements.

For Al—Ni alloys, Mn may be included in the alloy as an impurity. In these embodiments, Mn is generally present in amount of less than about 0.5 wt. %. In one embodiment, an Al—Ni alloy includes less than about 0.45 wt. % Mn. In other embodiments, an Al—Ni—Mn alloy includes less than about 0.4 wt. %, or less than about 0.35 wt. %, or less than about 0.3 wt. %, or less than about 0.25 wt. %, or less than about 0.2 wt. %, or less than about 0.15 wt. %, or less than about 0.1 wt. %, or less than about 0.05 wt. %.

In some embodiments, the alloy is substantially free of other elements, meaning that the casting alloy contains no more than 0.25 wt. % of any other elements other than the Ni, optional Mn and the above-described normal incidental elements and impurities. Further, the total combined amount of these other elements in the alloy does not exceed 0.5 wt. %. In one embodiment, each one of these other elements does not exceed 0.10 wt. %, and the total of these other elements does not exceed 0.35 wt. % or 0.25 wt. %. In another embodiment, each one of these other elements does not exceed 0.05 wt. %, and the total of these other elements does not exceed 0.15 wt. %. In another embodiment, each one of these other elements does not exceed 0.03 wt. %, and the total of these other elements does not exceed 0.1 wt. %.

E. Other Casting Alloys

In other embodiments, non-Al—Ni casting alloys may be used so long as a suitable combination of properties (e.g., castability, strength and/or anodizability) and appearance is realized. In one embodiment, the aluminum alloy is Al—Si alloy suitable for use as a casting alloy, such as suitable casting alloys of the 3xx and 4xx family. In one embodiment, the Al—Si alloy is alloy 380. This alloy may be useful, for example, in thick shape cast products having a blackened, clear coated finish.

F. Castability

The casting alloys described herein may be readily castable, even in thin walled shape casting applications. Castability may be quantified by the fluidity and/or hot cracking tendency of the alloy, among other properties.

In one embodiment, the Al—Ni and/or Al—Ni—Mn casting alloy realizes a fluidity that is at equivalent or nearly equivalent to casting alloy A356 and/or A380. Fluidity may be tested via spiral mold casting. The fluidity of an alloy is determined by measuring the length of the casting that is achieved by the alloy via the spiral mold. These tests may be conducted at the melt temperature or at a fixed temperature above the melting point for each of the tested alloys (e.g., 100° C. of superheat for each of the alloys).

In one embodiment, the Al—Ni or Al—Ni—Mn alloy realizes a fluidity that is at least about 2% better than that of casting alloy A380 and/or A356. In other embodiments, the Al—Ni or Al—Ni—Mn alloy realizes a fluidity that is at least about 4% better, or at least about 6% better, or at least about 8% better, or at least about 10% better, or at least about 12% better, or at least about 14% better, or at least about 16% better, or at least about 18% better, or at least about 20% better than casting alloy A380 and/or A356.

In one embodiment, the Al—Ni and/or Al—Ni—Mn casting alloy realizes a hot cracking index that is equivalent or nearly equivalent to casting alloy A356 and/or A380. In one embodiment, the Al—Ni and/or Al—Ni—Mn casting alloy realizes a hot cracking index of less than 16 mm, as tested via a pencil probe test. In other embodiments, the Al—Ni and/or Al—Ni—Mn casting alloy realizes a hot cracking index of less than 14 mm, or less than 12 mm, or less than 10 mm, or less than 8 mm, or less than 6 mm, or less than 4 mm, or less than 2 mm as tested via a pencil probe test.

G. Tensile Strength

The casting alloys described herein may have a relatively high strength and in the as cast condition. For example, Al—Ni alloys may realize a tensile yield strength (TYS) of at least about 100 MPa, and in the as cast temper (i.e., an "F temper") when tested in accordance with ASTM B557. In one embodiment, a thin wall (<1 mm) or medium wall (1-2 mm) shape cast product produced from an Al—Ni alloy realizes in the F temper a TYS of at least about 105 MPa. In other embodiments, the thin walled, shape cast product produced from an Al—Ni alloy realizes in the F temper a TYS of at least about 110 MPa, or at least about 115 MPa, or at least about 120 MPa, or at least about 125 MPa, or at least about 130 MPa, or at least about 135 MPa, or at least about 140 MPa, or at least about 145 MPa, or at least about 150 MPa, or more. Thicker (2-6 mm) shape cast products produced from an Al—Ni alloy may realize in the F temper a TYS slightly lower than those described above.

Al—Ni—Mn alloys may realize a tensile yield strength (TYS) of at least about 120 MPa in the F temper. In one embodiment, a thin wall (<1 mm) or medium wall (1-2 mm)

shape cast product produced from an Al—Ni—Mn alloy realizes in the F temper a TYS of at least about 150 MPa. In other embodiments, the thin walled, shape cast product produced from an Al—Ni—Mn alloy realizes in the F temper a TYS of at least about 175 MPa, or at least about 180 MPa, or at least about 185 MPa, or at least about 190 MPa, or at least about 195 MPa, or at least about 200 MPa, or at least about 205 MPa, or at least about 210 MPa, or at least about 215 MPa, or at least about 220 MPa, or at least about 225 MPa, or at least about 230 MPa, or at least about 235 MPa, or at least about 240 MPa, or at least about 245 MPa, or at least about 250 MPa, or more. Thicker (2-6 mm) shape cast products produced from an Al—Ni alloy may realize in the F temper a TYS slightly lower than those described above.

H. Impact Strength

The Al—Ni and Al—Ni—Mn alloys may realize a relatively high toughness in the as cast condition. The Al—Ni and Al—Ni—Mn alloys generally realize a toughness that is at least equivalent to a comparable product produced from casting alloy A380 and/or casting alloy A356. Products containing a higher amount of nickel may realize in the F temper an impact strength of at least 4 Joules as tested in accordance with ASTM E23-07, entitled "Standard Test Methods for Notched Bar Impact Testing of Metallic Materials" and via a Charpy Un-Notched Specimen. In some of these embodiments, the shape cast products may realize in the F temper an impact strength of at least about 4.5 Joules, or at least about 5 Joules, or at least about 5.5 Joules, or at least about 6 Joules, or at least about 6.5 Joules, or at least about 7 Joules, or more. Product containing a lower amount of nickel may realize higher impact strengths. In one embodiment, the shape cast products may realize in the F temper an impact strength of at least about 10 Joules. In some of these embodiments, the shape cast products may realize in the F temper an impact strength of at least about 15 Joules, or at least about 20 Joules, or at least about 25 Joules, or at least about 30 Joules, or at least about 35 Joules, or more.

I. Elongation

The Al—Ni and Al—Ni—Mn alloys may realize good elongation and in the as cast condition. The Al—Ni and Al—Ni—Mn alloys generally realize an elongation that is at least equivalent to a comparable product produced from casting alloy A380 and/or casting alloy A356 and in the as cast condition (F temper). In one embodiment, an Al—Ni alloy realizes in the F temper an elongation of at least about 4% when tested in accordance with ASTM B557. In other embodiments, an Al—Ni alloy realizes in the F temper an elongation of at least about 6%, or at least about 8%, or at least about 10%, or at least about 12%. In one embodiment, an Al—Ni—Mn alloy realizes in the F temper an elongation of at least about 2%. In other embodiments, an Al—Ni—Mn alloy realizes an elongation of at least about 3%, or at least about 4%, or at least about 5%, or at least about 6.

J. Anodizability

Figure 8A:
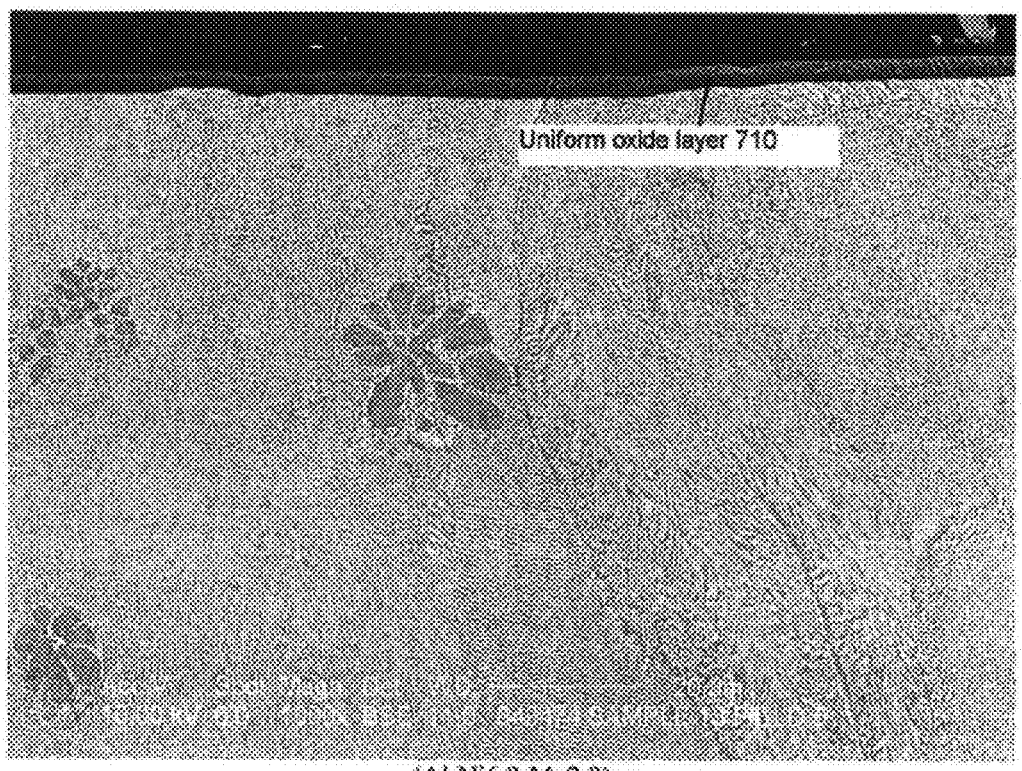
FIG. 8*a* is a micrograph of one anodized Al—Ni—Mn shape cast product produced in accordance with the present disclosure, containing about 6.9 wt. % Ni, 2.9 wt. % Mn, the balance being aluminum, incidental elements, and impurities, and having a uniform oxide layer.
Figure 8B:
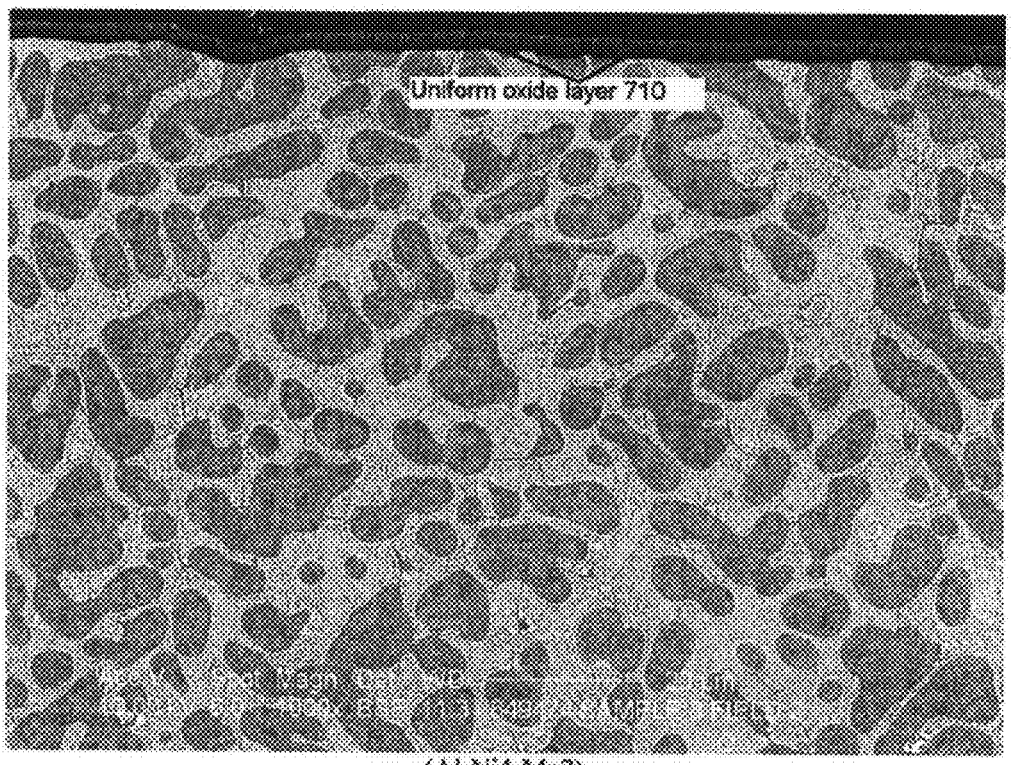
FIG. 8*b* is a micrograph of one Al—Ni—Mn shape cast product produced in accordance with the present disclosure, and containing about 4 wt. % Ni, 2 wt. % Mn, the balance being aluminum, incidental elements and impurities, and having a uniform oxide layer.
Figure 8C:
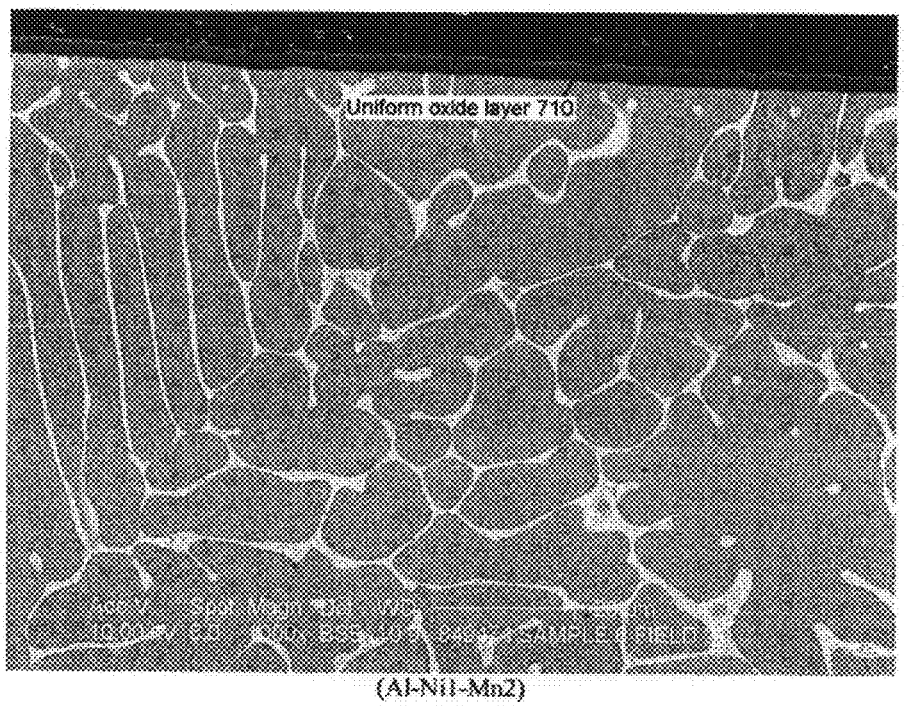
FIG. 8*c* is a micrograph of one Al—Ni—Mn shape cast product produced in accordance with the present disclosure, and containing about 1 wt. % Ni, 2 wt. % Mn, the balance being aluminum, incidental elements and impurities, and having a uniform oxide layer.
Figure 8D:
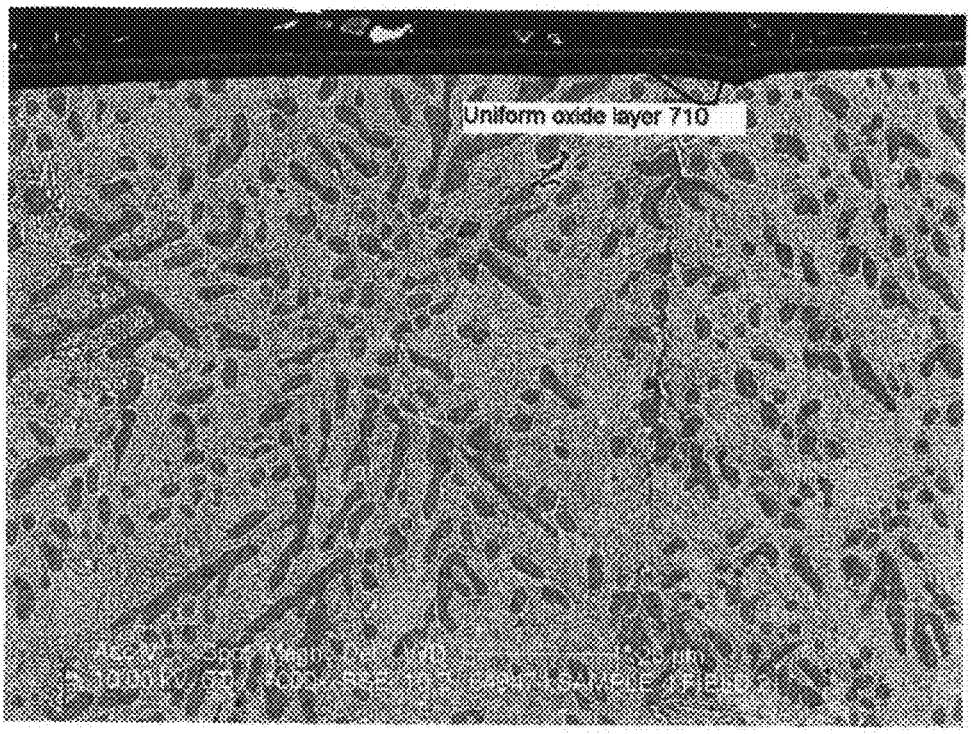
FIG. 8*d* is a micrograph of one Al—Ni shape cast product produced in accordance with the present disclosure, and containing about 6.5 wt. % Ni, the balance being aluminum, incidental elements and impurities, and having a uniform oxide layer.
Figure 8E:
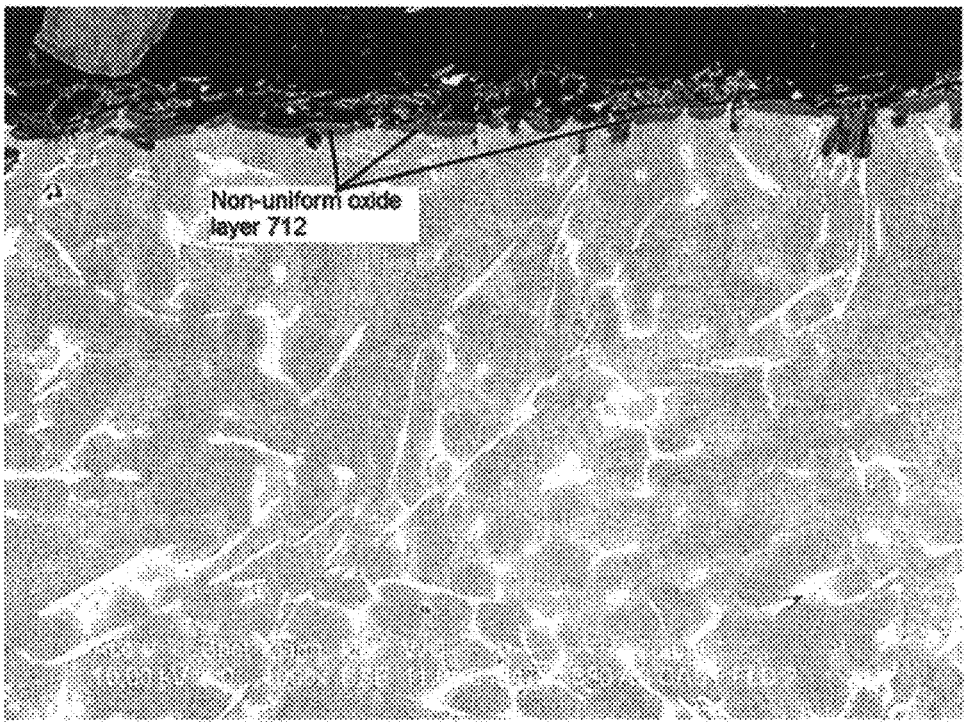
FIG. 8*e* is a micrograph of Al—Si A380 shape cast product and having a non-uniform oxide layer.

The Al—Ni and Al—Ni—Mn alloys described herein may also facilitate production of uniform oxide layers via anodizing of the Al—Ni or Al—Ni—Mn alloy. A uniform oxide layer is one that has a substantially uniform thickness and with minor or no interruptions in the oxide layer. In one embodiment, the oxide layer has a generally linear appearance (e.g., a non-undulating outer surface). A uniform oxide layer may at least partially assist in facilitating color uniformity, durability an/or corrosion resistance of the shape cast product. Example of an Al—Ni and Al—Ni—Mn alloys having a uniform oxide layer are illustrated in FIGS. 8*a*-8*d*, and a comparative A380 alloy is illustrated in FIG. 8*e*. All samples were die cast, and then anodized in about a 20 wt. % $H_2SO_4$ bath at a current density of about 12 asf (amperes per square foot) and a temperature of about 70° F. for about 9 minutes, creating oxide layers having a thickness of about 0.15 mils. As illustrated, the Al—Ni and Al—Ni—Mn alloys achieve a uniform oxide layer 710, whereas the Al—Si alloy A380 (FIG. 8*e*) has a non-uniform oxide layer 712.

In some instances, the Al—Ni or Al—Ni—Mn alloys facilitate relatively fast production of the oxide layer via anodizing. In one embodiment, the Al—Ni or Al—Ni—Mn alloys achieve the same or similar oxide layer thickness as a comparable A380 product, but in a time that is at least 20% faster than the time required to produce the oxide layer of the comparable A380 product. In other embodiments, the Al—Ni or Al—Ni—Mn alloys achieve the same or similar oxide layer thickness as a comparable A380 product, but in a time that is at least 20% faster, or at least 40% faster, or at least 60% faster, or at least 80% faster, or at least 100% faster than the time required to produce the oxide layer of the comparable A380 product. Alloys that may be quickly anodized may facilitate increased throughput, and thus lower cost of production.

In sum, the presently disclosed aluminum alloys facilitate production of shape cast products that are suitable for decorative shape cast product applications. These aluminum alloys have good castability and facilitate production of shape cast products having a good combination of tensile strength, toughness (impact strength), elongation, brightness, and/or grayness, and in the as cast condition (F temper). The aluminum alloys also facilitate selection of a microstructure suited for the selected finishing applications. The aluminum alloys are also readily anodized, and realize a uniform oxide layer, which may contribute to the production of durable and visually appealing decorative shape cast products having color uniformity and/or gloss uniformity.

II. Methods, Systems and Apparatus for Producing Shape Cast Products

Referring back to FIG. 1, after the alloy feedstock is produced (110) a shape casting product may be produced from the alloy feedstock via a shape casting process (120).

Die casting, often which is high-pressure die-casting (HPDC), is a process that may be used for producing shape cast products of aluminum. Die casting may be used to produce shape cast products having a thin, medium or thick nominal wall thickness. In some embodiments, design features including the likes of bosses and ribs, among others, may also be reproduced on the aluminum products.

Die casting involves injecting molten metal into a die cavity at high velocity. This high velocity may result in short fill-time (e.g., milliseconds), and may produce parts in the as-cast condition that are substantially free of visually apparent surface defects (e.g., substantially free of laps and voids). In some embodiments, aluminum alloys may be cast in a manner that reduces or eliminates visually apparent surface defects in the finished shape cast product. The rapid injection may also mean that mold coatings may not be needed, where the product surface may be a replica of the cavity surface in the metal die. In some embodiments, die casting processes have short cycle times and may facilitate large-volume applications.

In one embodiment, a casting process includes flowing a molten metal into an initial path (e.g., a runner passageway and/or gate land region, as described below), and forcing the molten metal from the initial path and into a casting cavity. The molten metal may be forced into the casting cavity via this initial path, and at an angle of transition, described below, so as to facilitate production of shape cast products having an appropriate microstructure. Once in the casting cavity, the molten metal may cool (e.g., at a predetermined rate) to produce a solidified metal, which will become the shape cast product, and which may have the appropriate microstructure.

In one embodiment, the distance traveled by the molten metal from the initial path into the casting cavity is restricted so as to facilitate restricted production of surface defects, as described in further detail below. In one embodiment, this distance traveled is not greater than about 15 mm. In other embodiments, this distance traveled may be not greater than about 10 mm, or not greater than about 5 mm, or not greater than about 4 mm, or not greater than about 3 mm, or not greater than about 2 mm, or not greater than about 1 mm.

In one embodiment, the initial path is connected to the casting cavity via a transition path. For example, a transition path may be include a gate land region and/or a gate, such as a fan gate. The transition path may assist in transition of the flow of the molten metal to the casting cavity so as to produce the desired microstructure in the shape cast product. The transition path may have an angle of transition, which may be in the range of from about 0 degrees to about 90 degrees, as provided in further detail below.

In one embodiment, a transition path includes a tangential gate. In this embodiment, an angle of transition from the initial path to the casting cavity via the tangential gate may be in the range of from about 30 degrees to about 90 degrees. The molten metal may be forced from the initial path into the casting cavity at an angle in this range so as to facilitate production of suitable shape cast products. In some embodiments, the angle of transition is relatively large, such as from about 60 degree to about 90 degrees, or from about 70 degree to about 90 degrees, or from about 80 degree to about 90 degrees. The use of a large degree of transition may facilitate production of shape cast products having an appropriate preselected microstructure, wherein the shape cast product may be readily finished to produce a decorative shape cast product that is substantially free of visually apparent surface defects (e.g., after anodizing and/or coloring of the shape cast product).

In another embodiment, the transition path may include a gate land and/or a fan gate. In these embodiments, the angle of transition may be relatively small (e.g., not greater than about 5 degrees), or may be non-existent (i.e., a linear-direction of flow from the initial path into the casting cavity).

These and other useful features for casting the presently described shape cast products are provided in further detail below.

Shape Casting Process

The die cast process used to produce the decorative shape cast products described herein may be accomplished via any suitable die casting press. In one embodiment, the shape casting process (120) may be carried out on a 750-tonne vacuum die casting press. In some embodiments, the shape casting process (120) may be carried out on a 320-ton die-casting machine or a 250-ton die casting press with automated injection controls. For some thin walled shape cast products, the shape casting process (120) may be carried out on a 150-ton die casting press, or even smaller. In some embodiments, other suitable casting machines or presses may be utilized for carrying out the shape casting process (120). In some embodiments, the shape casting process (120) may incorporate vacuum die casting processes similar to those described in U.S. Pat. No. 6,773,666 granted Aug. 10, 2004, which is incorporated by reference herein in its entirety.

The die casting machines may be manually operated, such as via manual transfer of molten metal to shot sleeve, manual die lubrication, and manual part extraction, to name a few. In other embodiments, the die casting machines may be automated, such as via automatic transfer of molten metal from crucible furnace to shot sleeve, automatic die lubrication, and automated part extraction, to name a few. In some embodiments, trim presses may be incorporated for runner and vent removal. These and other features will become more apparent in the below description and accompanying figures.

Figure 9:
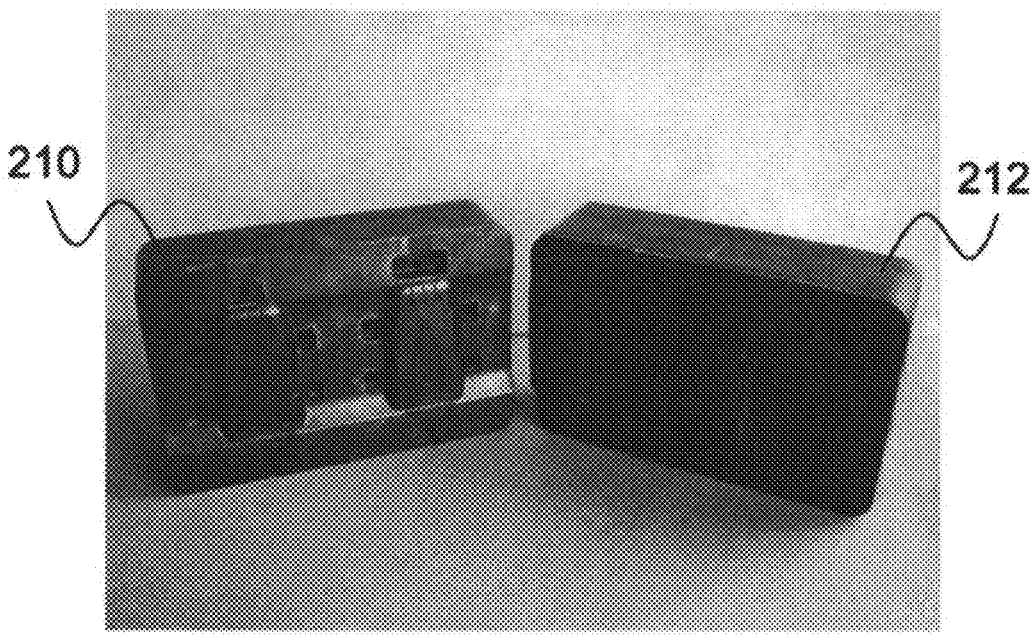
FIG. 9 contains photographs of an ejector die insert and a cover die insert both made of steel for a die casting process in accordance with the present disclosure.

In one embodiment, before beginning a process flow for a shape casting process (120), an ejector die insert 210 and a cover die insert 212 (sometimes call a fixed die insert) for a shape cast product may be produced as shown in FIG. 9. In one embodiment, the ejector die insert 210 and the cover die insert 212 may be made of steel. Other suitable materials for manufacturing the casting die inserts 210, 212 may be used, including, without limitation, ceramics, iron, tungsten, and alloys and superalloys thereof. The die inserts 210, 212 may be shaped as to produce a variety of shape cast products, such as any of the consumer electronic parts described above.

Figure 10:
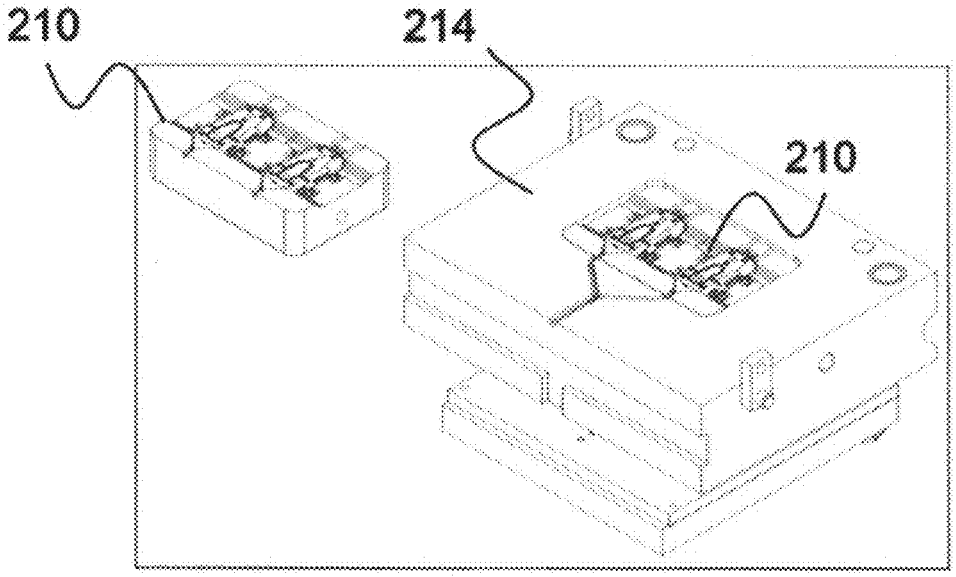
FIG. 10 is a computer-aided design (CAD) drawing of an ejector die insert and a drawing of the ejector die insert mounted to a die frame for a die casting process in accordance with the present disclosure.

Each die insert 210, 212 may be mounted to a die frame 214 similar to that shown for the ejector die insert 210 illustrated in FIG. 10. In one embodiment, a die half includes a die frame 214 having a die insert 210, 212. For example, an ejector die insert 210 may be mounted to an ejector die frame 214 to form one half of a complete die, while a cover die insert 212 may be mounted to a cover die frame 214 to form the other half of the complete die. Subsequently, the die halves may be mounted on a die casting machine 300 for the shape casting process (120) as shown in FIGS. 11A-11I.

Figure 11:
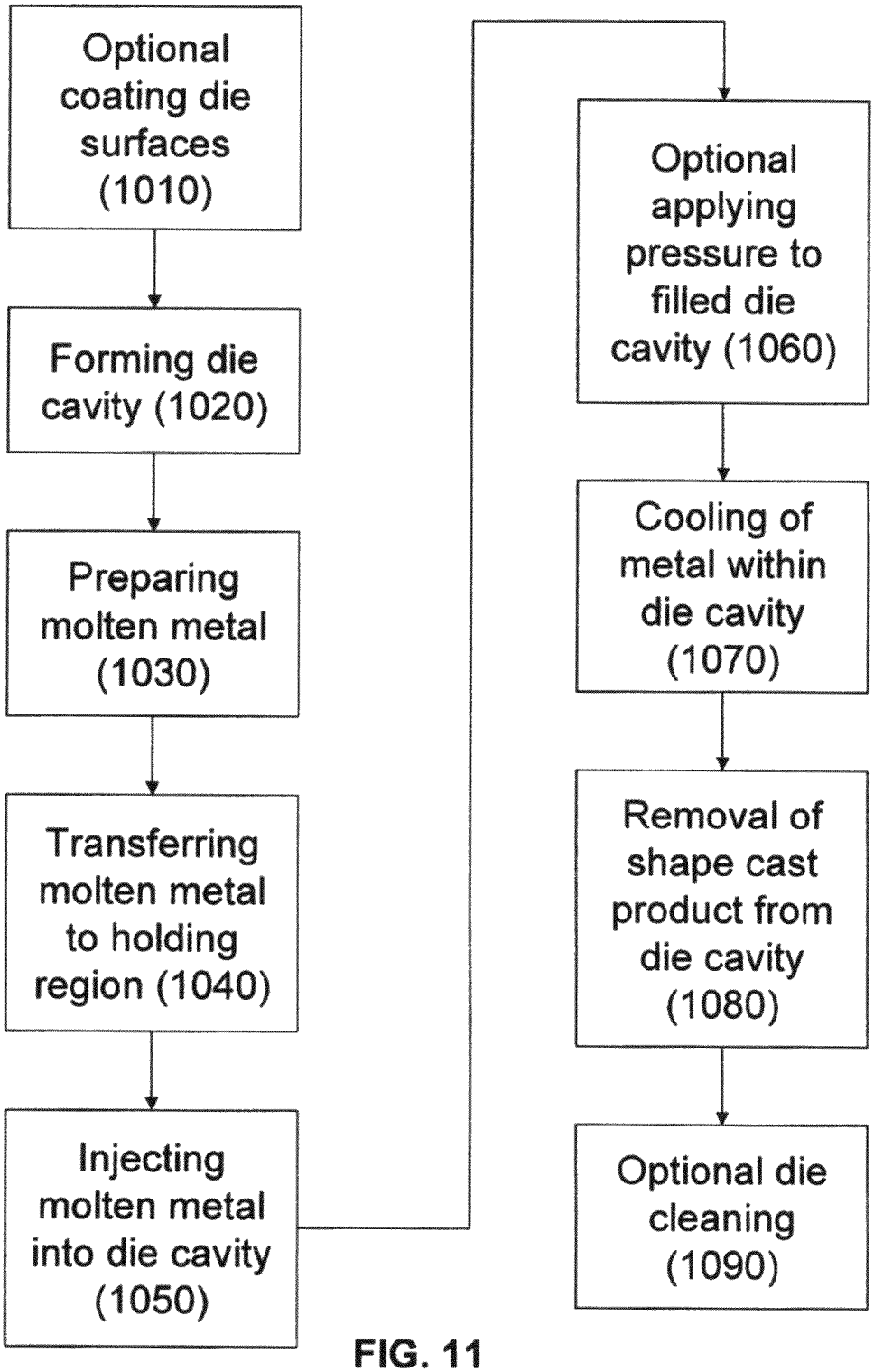
FIG. 11 is a flow-diagram illustrating one embodiment of a method for producing shape cast products in accordance with one embodiment of the present disclosure.
Figure 11A:
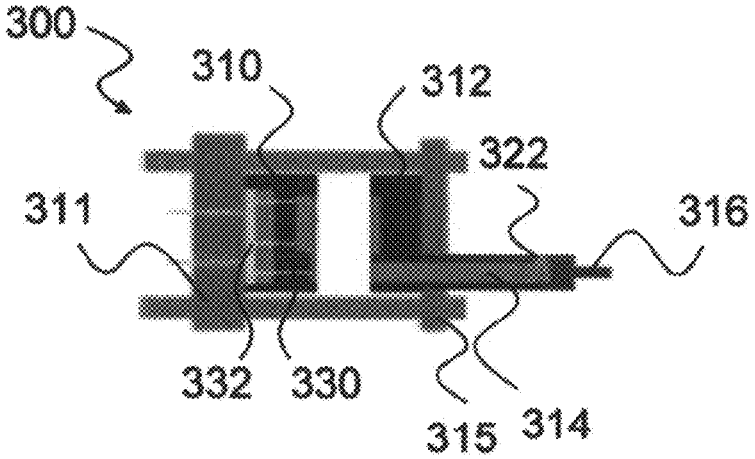
FIGS. 11A-11I are schematic views illustrating a process flow for producing shape cast products according to one embodiment of the present disclosure.

In FIG. 11A, an ejector die 310, mounted on a moving platen 311, can be situated on one side of the die casting machine 300 while a cover die 312, mounted on a fixed platen 315, can be situated on an opposite side of the die casting machine 300. The die halves 310, 312 are mounted such that when the two halves 310, 312 are brought together they form a die cavity 320 as shown in FIG. 11C. A shape cast product may be produced when an aluminum alloy in melt form cools and solidifies in the die cavity 320 so as to produce the shape cast product in accordance with the design of the die cavity 320.

Still referring to FIG. 11A, an ejector plate 332 may include at least one ejector pin 330 to facilitate the removal of the shape cast product from the die cavity 320. In one embodiment, a shot sleeve 314 (sometimes referred to as a cold chamber) may include an aperture 322 (sometimes referred to as a pour hole) and an injection piston 316 for driving the molten material within the shot sleeve 314. In some instances, the shot sleeve 314 may be mounted to the cover die 312. The shot sleeve 314 facilitates a shape casting process (120) by holding the molten material for injection into the die cavity 320. These and other features of the shape casting process (120) will become more apparent in the below description and accompanying figures.

Process Flow

In one embodiment, the process flow for a shape casting process (120) includes at least one of the following steps as shown in FIG. 11, among others:

(1) Optionally coating die surfaces (1010);
(2) Forming a die cavity (1020);
(3) Preparing molten metal (1030);
(4) Transfer of the molten metal to a holding region (1040);
(5) Injecting the molten metal into the die cavity (1050);
(6) Optional applying pressure to the filled die cavity (1060);
(7) Cooling of the metal within the die cavity (1070);
(8) Removal of the shape cast product from the die cavity (1080);
(9) Optional die cleaning (1090)

Each of these steps is described in further detail below.

(1) Optionally coating die surfaces (1010)

Figure 11B:
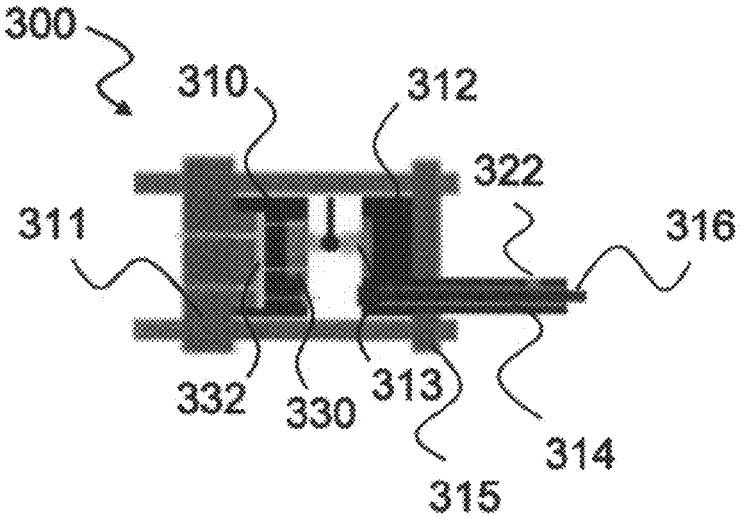
Figure 11C:
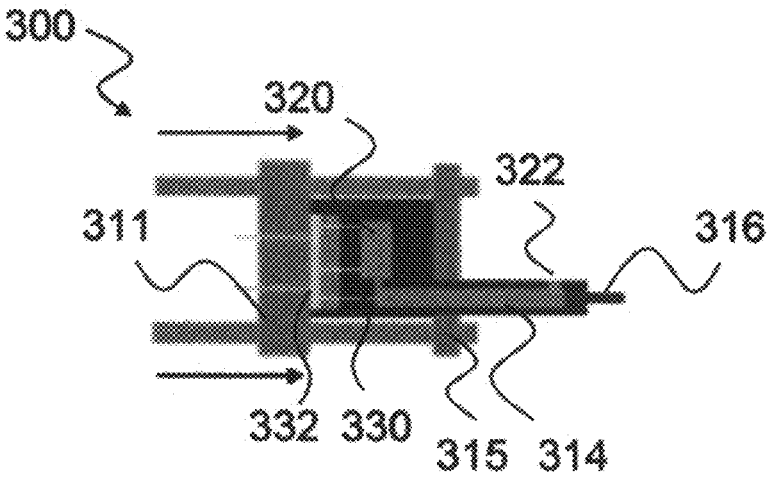

In one embodiment, a method optionally includes coating at least one surface of an ejector die 310 and/or a cover die 312 with a release agent 313 (e.g., graphite or silicon emulsion diluted with water) as illustrated in FIG. 11B. In some embodiments, air-spray may also be used for applying the release agent 313 to the die halves 310, 312. In one embodiment, the release agent 313 may also be a lubricant made of mostly ambient water plus additives. In some embodiments, the release agent 313 may be a dry, wax-based powder lubricant or a powder-based synthetic silicone. As illustrated in FIG. 11B, the release agent 313 may lubricate the ejector pins 330 when they are fully extended as the ejector plate 332 is actuated towards the cover die 312.

(2) Forming a Die Cavity (1020)

In one embodiment, a method includes forming a die cavity by closing the die halves 310, 312 by moving the ejector die 310 against the cover die 312 (e.g., fixed die) as illustrated by the arrows of FIG. 11C. Specifically, the moving platen 311 facilitates the movement of the ejector die 310 towards the cover die 312. In some instances, the die halves 310, 312 may be secured to each other using other suitable locking mechanisms including the likes of hydraulics and mechanical mechanisms, to name a few. The locking mechanism may help to ensure that molten metal disposed within the die cavity 320 does not escape from the region where the two die halves 310, 312 are brought together. In one embodiment, the closing step and the locking step may be integrated as a single step. As illustrated in FIG. 11C, the ejector plate 332 and the ejector pins 330 may be refracted.

(3) Preparing Molten Metal (1030)

Figure 11D:
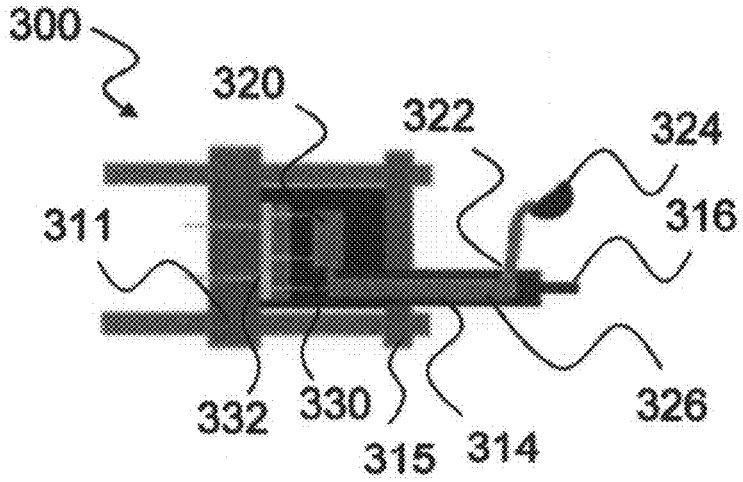

In one embodiment, a method includes preparing a molten metal 326 (e.g., a molten Al—Ni or Al—Ni—Mn alloy) in a crucible furnace (not shown) for casting a shape cast product, as illustrated in FIG. 11D. In one embodiment, the molten metal 326 may be transferred from the crucible furnace to the shot sleeve 314 via a hand ladle 324 or a robotic ladle 324. In one embodiment, the molten metal 326 comes from the alloy feedstock (110), such as any of the aluminum alloys described herein. In one embodiment, the crucible furnace may be a gas-fired crucible furnace with a capacity of about 550 pounds. In one embodiment, the crucible furnace may be an electrically-heated crucible furnace with a capacity of about 600 pounds. In some embodiments, other suitable crucible furnaces and/or heating apparatuses may be used for preparing the molten metal.

(4) Transfer of the Molten Metal to a Holding Region (1040)

In one embodiment, a method includes transferring the prepared molten metal 326 within the crucible to a holding region, in this case a shot sleeve 314. In one embodiment, the transfer may be carried out via an aperture 322 (or sometimes referred to as a pour hole) near the top of the shot sleeve 314. Once received therein, the molten metal 326 may flow freely within and throughout the length of the shot sleeve 314. Flowing and the like means the ability of a material to move fairly freely within an area or region. For example, the molten metal 326 may flow freely within the shot sleeve 314. In one embodiment, the molten metal 326 may be initially introduced to the die casting machine 300 for the shape casting process (120) via the shot sleeve 314.

In one embodiment, the molten metal 326 may be transferred via an electrically-heated launder or trough (not shown). In some embodiments, the molten metal 326 may be transferred by manually pouring, hand-ladling, or robotically ladling the molten metal 326 through the aperture 322 in the top of the shot sleeve 314. In some embodiments, the molten metal 326 may be drawn into the shot sleeve 314 via a siphon tube (not shown) mounted to the bottom of the shot sleeve 314. In some instances, the molten metal 326 may be provided to the shot sleeve 314 using other suitable methods including hydraulic systems, mechanical systems, and vacuum systems, to name a few.

In some embodiments, the amount of molten metal 326 within the shot sleeve 314 (e.g., the percentage fill of the shot sleeve 314) may not be greater than about 80% by volume, or not greater than about 50%, or not greater than about 40%, or not greater than about 35%, or not greater than about 30%, or not greater than about 25%, or not greater than about 15%, or not greater than about 10%. In some embodiments, overfilling the shot sleeve 314 may present challenges in operating an injection piston 316, maintaining an injection speed thereof, and properly filling a die cavity 320, among other potential issues. The injection piston 316, the injection speed, and the die cavity 320 will be discussed in further detail below.

In some instances, the shot sleeve 314 may include passages for electric cartridge heaters or other forms of heating apparatus for additional heating as necessary. The ability to control the temperature of the molten metal 326 will become more apparent in the below description and accompanying figures.

(5) Injecting the Molten Metal into the Die Cavity (1050)

Figure 11E:
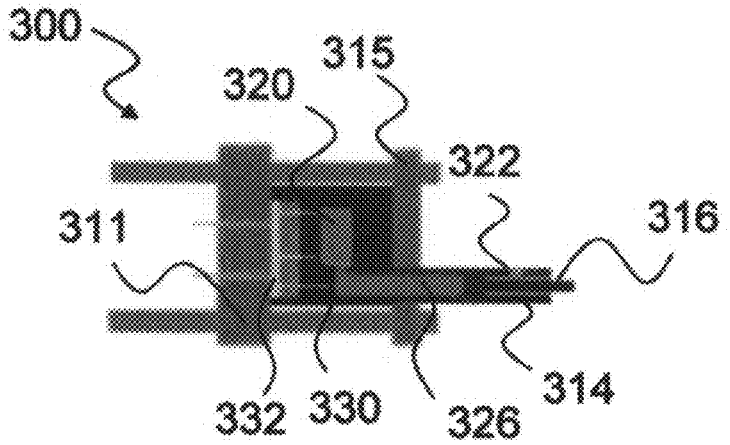
Figure 11F:
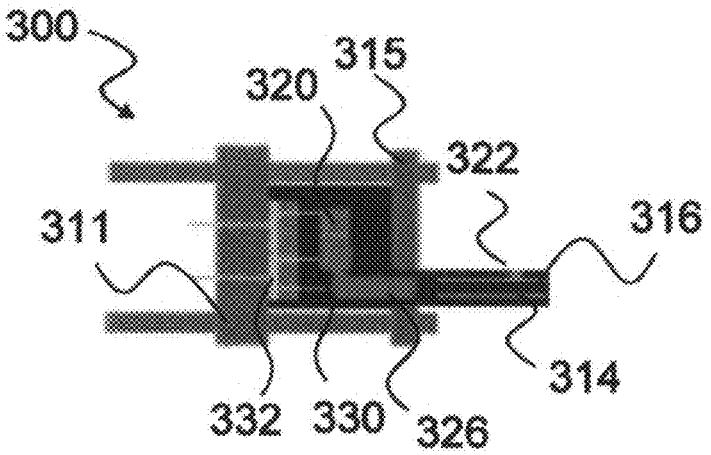

In one embodiment, a method includes injecting the molten metal 326 into the die cavity 320 by moving an injection piston 316 within the shot sleeve 314, as illustrated in FIGS. 11E-11F. In one embodiment, this may be made possible because the die cavity 320 is in fluid communication with the shot sleeve 314 (e.g., molten metal 326 may be flow from the shot sleeve 314 into the die cavity 320). In some embodiments, external forces exerted on the molten metal 326 may be provided by the injection piston 316. In these instances, the external force from the injection piston 316 may be transferred to the molten metal 326 within the shot sleeve 314 via at least one passageway (e.g., runner 354, gate system 356). This will become more apparent in subsequent figures and discussion.

In one embodiment, the movement of the piston 316 can take place in two stages (e.g., two shot) as illustrated in FIGS. 11E-11F. The first stage (or sometimes called the slow shot), as shown in FIG. 11E, may be carried out with slow movements (e.g., injection speed of not greater than about 1 m/s (meter/second)). In some embodiments, the speed of the piston 316 at the first stage may be not greater than about 0.1 m/s, or not greater than about 0.2 m/s, or not greater than about 0.3 m/s, or not greater than about 0.4 m/s, or not greater than about 0.5 m/s, or not greater than about 0.6 m/s, or in the range of from about 0.8 m/s to about 0.9 m/s. The slow movement of the piston 316 may be used to accumulate the molten metal 326 at one end of the shot sleeve 314 closest to the die cavity 320 as shown in FIG. 11E. The speed of the piston 316 at the first stage may be at any other suitable velocity depending on a variety of factors including the design of the die cavity 320 and the attributes of the die casting machine 300, among others.

The second stage (or sometimes called the fast shot), as partially shown in FIG. 11F, may be accomplished at faster speeds (e.g., from about 2 m/s to about 5 m/s). In some embodiments, the speed of the piston 316 at the second stage may be in the range of from about 2 m/s to about 5 m/s. For example, the injection speed for filling a die cavity designed for a thin walled mobile electronic device cover may be at least about 2 m/s, or in the range of from about 2.4 m/s to about 2.8 m/s. In some embodiments, the molten metal 326 may be rapidly driven or forced into the die cavity 320 by the fast shot. In some embodiments, it may be necessary to carry out the fast shot at an even higher piston velocity (e.g., up to about 5 m/s) because the molten metal 326 may solidify before it has had the chance to completely fill the die cavity 320. Similar to above, the speed of the piston 316 at the second stage may be at any other suitable speeds depending on other factors including the design of the die cavity 320 and attributes of the die casting machine 300, among others factors.

In some embodiments, for a two-shot injection process, an initiation phase (e.g., acceleration of the piston 316) may be included between the slow shot and the fast shot. For example, the initiation phase, as measured from the end of a dry stroke (e.g., an empty die cavity 320), may be in the range of from about −50 mm to about −65 mm. In some embodiments, the initiation phase may be in the range of from about −65 mm to about −75 mm. In some instances, the acceleration of the piston 316 during the initiation phase may facilitate application of a larger amount of force on the molten metal 326. In some embodiments, the initiation phase may be optional.

In one embodiment, there may only be one piston phase (e.g., the filling of the die cavity 320 as shown in FIGS. 11E-11F may be integrated as a single phase). In other embodiments, there may be three or more stages (e.g., three or more phases).

In one embodiment, the piston 316 may have a diameter of about 40 mm. In some embodiments, the piston 316 may have a diameter in the range of from about 30 to about 35 mm. In some embodiments, the size of the piston 316 may dictate the volume of molten metal 326 that may be forced through the shot sleeve 314 and how fast the molten metal 326 may be moving within the shot sleeve 314. In general, the larger the diameter of the piston 316, the greater the volume of molten metal 326 may be forced through the shot sleeve 314. In some embodiments, the diameter of the piston 316 may vary depending on the die casting machine.

The time to fill the die cavity 320 may be in the range of from about 1 ms (millisecond) to about 100 ms, or from about 3 ms to about 10 ms, or from about 40 ms to about 60 ms. In some embodiments, smaller and/or thinner parts may take less time to fill because the parts have generally decreased volume, and therefore need not as much time to fill the space as larger and/or thicker parts, which may take longer to fill because of the generally increased volume. In one embodiment, the amount of time it takes for a die cavity 320 to be filled with the molten metal 326 may be in the range of from about 6 ms to about 7 ms (e.g., for thin walled shape cast products). In one embodiment, the fill time for a die cavity 320 may be in the range of from about 30 ms to about 80 ms (e.g., for medium or thick walled shape cast products). The fill time for a die cavity 320 may vary depending on wall thickness and the design of the shape cast product, among other variables. In one embodiment, the fill time of the die cavity 320 may be determined mostly by the fast shot or the injection shot. In one embodiment, the piston 316 may be driven by external hydraulic systems or any other suitable electrical, mechanical and/or actuating systems.

(6) Applying Pressure to the Filled Die Cavity

Applying Pressure to the Filled Die Cavity (1060)

Figure 11G:
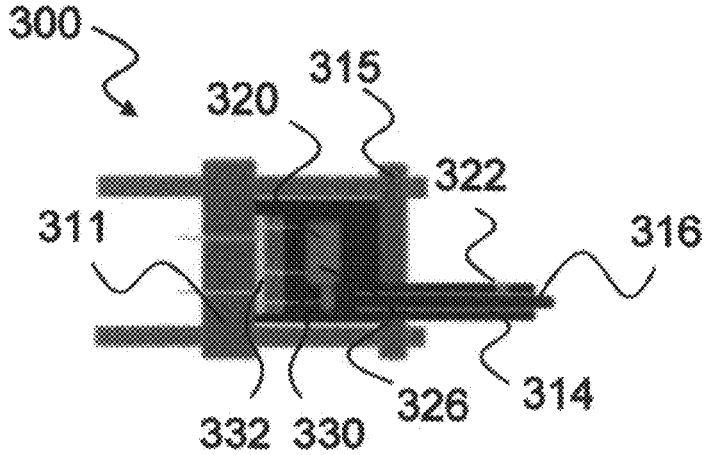

In one embodiment, a method includes applying pressure (e.g., from about 200 bar to about 1600 bar) to the molten metal 326 via the piston 316 during a third stage (or sometimes called an intensification stage), after the molten metal 326 has substantially filled the die cavity 320, as illustrated in FIG. 11G. In some embodiments, the pressure being applied may be in the range of from about 600 bar to about 1200 bar, or from about 800 bar to about 1000 bar. In some embodiments, lower pressure may be applied to smaller and/or thinner parts because these parts have generally decreased volume, and therefore need not as high of pressure as larger and/or thicker parts, which may require higher pressure to fill because of the generally increased volume.

Figure 11H:
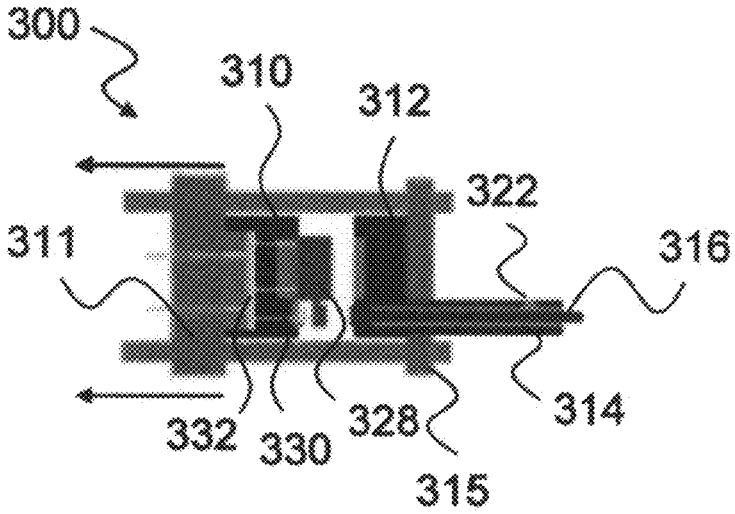

In general, the purpose of the pressure is to force the molten metal 326 from the shot sleeve 314 into any shrinkage and/or voids that may form in the die cavity 320 during solidification of the molten metal 326, as illustrated in FIG. 11H. In other words, as the molten metal 326 solidifies and cools in the die cavity 320, it may shrink due to metal contraction as a result of the decrease in temperature. The high pressure exerted by the piston 316 may force more of the molten metal 326 into the die cavity 320 to fill the voids that may be created as a result of the metal shrinkage phenomenon. In some embodiments, the intensification stage may be optional.

With reference to steps (5) (i.e., reference number 1050) and (6) (i.e., reference number 1060), an example of a shot profile of the piston 316 may include: (a) a slow shot to accumulate molten metal 326 at one end of the shot sleeve 314, (b) a fast shot initiation, (c) a fast shot to inject the molten metal 326 into a die cavity 320, and (d) an intensification phase to apply high pressure to the molten metal 326 during cooling and/or solidification. In some embodiments, the slow shot step (a) may be further sub-divided to a first phase (e.g., to cover the aperture 322) and an intermediate phase (e.g., to accumulate the molten metal 326). In one embodiment, the fast shot initiation step (b) may be combined with the fast shot injection step (c) similar to the slow/fast two shots combination as discussed above. The transition from a slow shot step (a) to a fast shot initiation step (b) may be gradual, instantaneous, delayed, or lengthy, as appropriate.

(7) Cooling of the Metal within the Die Cavity (1070)

In one embodiment, a method includes cooling of the molten metal 326 within the die cavity 320, as illustrated in FIG. 11H, which generally results in solidification of the molten metal 326 to form a shape cast product. The cooling time generally depends on the size of the shape cast product. For example, parts 328 with thinner wall thicknesses may cool faster similar to that of a die casting process while parts 328 with thicker wall thicknesses may cool slower similar to that of a permanent mold casting process. In one embodiment, the cooling time may be at least about 1 second, or at least about 3 seconds, or at least about 5 seconds, or at least about 7 seconds. Increasing the cooling time may produce molten metal 326 that may become harder and/or more resistant to distortion (e.g., less prone to change shape). In some embodiments, the cooling period may be in the range of from about 2 seconds to about 7 seconds for thinner parts and from about 7 seconds to about 10 seconds for thicker parts. In some embodiments, the cooling time may be up to about 2 minutes for parts 328 with large wall thicknesses.

(8) Removal of the Shape Cast Product from the Die Cavity (1080)

In one embodiment, a method includes, after a shape cast product 328 has cooled, removing the shape cast product 328 from the die cavity 320. In one embodiment, the shape cast product 328 may be removed by retracting the ejector die 310 from the cover die 312 to expose the die cavity 320. In one embodiment, the die cavity 320 may be designed such that the shape cast product 328 may be immobile (e.g., held by the ejector die 310) until the ejector plate 332 moves forward bringing along with it the ejector pins 330, for expelling the shape cast product 328 from the die cavity 320 as illustrated in FIG. 11H. In this instance, although the moving platen 311 is being retracted as shown by the arrows, the ejector plate 332 may nevertheless move in an opposite direction for ejecting the shape cast product 328 from the die cavity 320 via the ejector pins 330. In some embodiments, the ejector plate 332 and the ejector pin 330 are optional and the consumer electronics parts 328 can be removed manually or automatically.

In some embodiments, a trimming process may be used to remove flash, overflows, vents, and runners from a shape cast product 328. In some embodiments, a trimming process may be used to reduce any distortion that may have occurred to the shape cast product 328 during any of the previous steps during a shape casting process (120). In some embodiments, features including the likes of holes and cutouts, among others, may also be accomplished using a punching process.

(9) Optional Die Cleaning (1090)

Figure 11I:
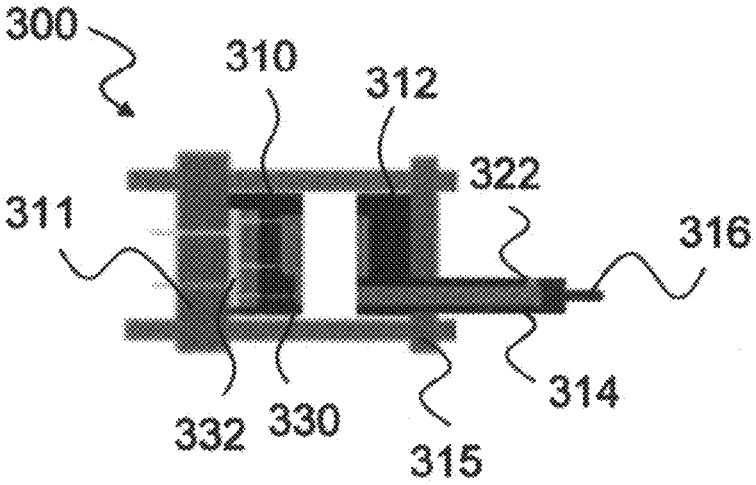

In one embodiment, a method optionally includes cleaning and/or flashing (e.g., via a sudden intense burst of energy) of the die halves 310, 312 to remove any debris, residues, or particulates that may have accumulated on the surfaces of the die halves 310, 312 in preparation for casting the next part as illustrated in FIG. 11I.

In some embodiments, the processing steps as described above may be repeated by coating the die halves 310, 312 with a release agent 313 similar to that of step (1) (i.e., reference number 1010) and as shown in FIG. 11B in preparation for casting the next shape cast product 328. In some embodiments, the processing steps as described above may be carried out concomitantly to one another. For example, the closing/locking step (2), i.e., the forming a die cavity step (reference number 1020) and the preparing molten metal step (3) (i.e., reference number 1030) may be separately carried out at or around the same time. In one example, the coating step (1) (i.e., reference number 1010) and the die cleaning step (9) (i.e., reference number 1090) may also be separately carried out at or around the same time.

The total cycle time for this casting step (120) generally depends on a plurality of variables including die design and attributes of the die casting machine, among other factors. In one embodiment, the total cycle time (e.g., from step (1) to step (9) (i.e., reference numbers 1010 to 1090)) can be as little as a few seconds for parts 328 with thinner wall thicknesses, or as long as from about 2 minutes to about 3 minutes for parts 328 with thicker wall thicknesses. In some embodiments, the total cycle time can be in the range of from about 15 seconds to about 25 seconds, or from about 25 seconds to about 30 seconds, or from about 60 seconds to about 120 seconds.

Surface Defects in the as-Cast Condition

As described above, in some instances it may be useful for the casting process to result in shape cast products having little or no visually apparent surface defects, such as cold-shuts, lap-lines, flow-lines and mottled discolorations, among others. Cold-shut is a surface defect where two melt fronts, during filling of the die cavity, come together but do not fuse completely. A seam may be apparent in the surface contour. There may be no color change, but a difference in reflected light may be generally apparent. In some cases, a cold shut may result in formation of a void. In some embodiments, cold-shut may be found in areas that are slow to fill, or that experience swirls during filling. Lap-lines are substantially similar to a cold-shut but less pronounced.

Flow-lines, sometimes also referred to as lube-lines, are surface defects involving dark/light streaks and color changes. A seam may not necessarily be apparent on the surface contour. The cause may be due to die spray residue, but may also be due to micro-structural segregation during solidification. Flow-lines may be found in the gate area, at corners of the gate, or where flow goes around a die feature, among others. In some embodiments, a part in as-cast condition may show dark gray or black lube-lines or flow-lines, which may be attributed to residue from the release agent 313. In some instances, this type of contamination may be reduced or eliminated by suitable finishing steps, as described in further detail below. In some instances, a streak is a more pronounced form of a flow-line in the in gate area. Mottled discolorations are dark blotches, which may be due to oxide-film forming on the surface or micro-structural segregation during solidification. Mottled discolorations may occur in the vent area or other stagnant areas of the line. In one example, mottled discoloration may exist at a vent end of a die casting. This type of surface defect may be associated with a cooler melt that is compressing into stagnant areas of a cast component. Large over-flows may be incorporated to flush-through the melt. In other words, auxiliary cavities (e.g., overflow structures 360) along the vented edge of the die cavity 320 may flush stagnant molten metal 326 out of the die cavity 320 and force them into the auxiliary cavities. In some instances, a higher die temperature in the vent area of the die cavity 320 may help limit discoloration at the vent end of a die casting. In other instances, localized heating may also be beneficial.

The speed of the piston 316 may determine the speed of the molten metal 326 at the entrance (e.g., gate) of the die cavity 320. This gate velocity may be defined as the speed of the molten metal 326 entering the die cavity 320 through the gate 358. In some embodiments, the gate velocity may be in the range of from about 30 m/s to about 40 m/s, or from about 40 m/s to about 60 m/s, or from about 60 m/s to about 80 m/s, or from about 80 m/s to about 90 m/s. In some embodiments, a slower gate velocity may be correlated with slower molten metal 326 flow through the gate 358 of the die cavity 320. These embodiments may be useful to avoid erosion of the die steel in the gate area. In some embodiments, a faster gate velocity may be correlated with faster molten metal 326 flow through the gate 358 of the die cavity 320. These embodiments may be useful to avoid defects such as cold shuts and lap lines in the product or the as-cast part. The die cavity 320 filling time and the gate velocity may vary depending on the design of the die halves 310, 312, the thickness of the part, and attributes of the die casting machine, among other factors and/or variables.

Fan Gate Configuration

Figure 12A:
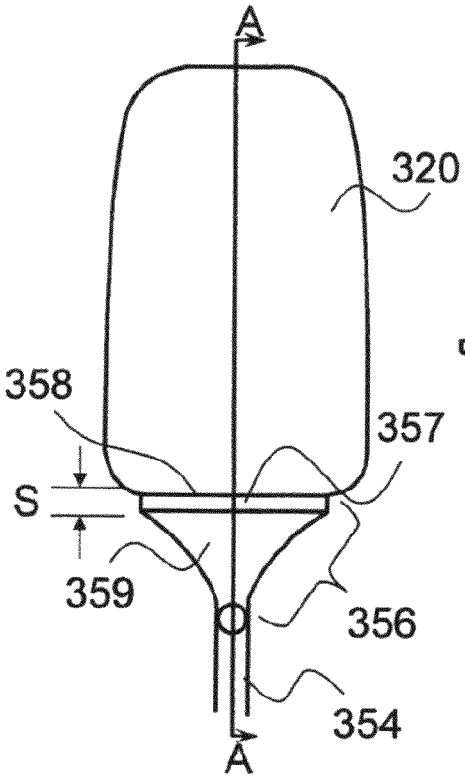
FIG. 12A is a perspective view of one embodiment of a fan gate configuration according to the present disclosure.
Figure 12B:
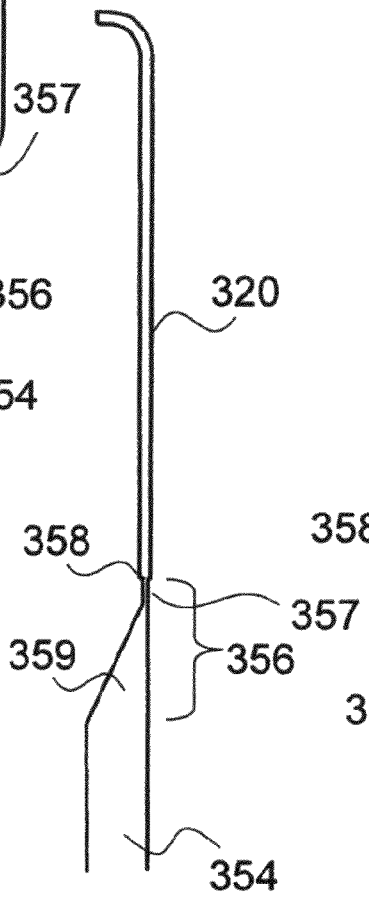
FIG. 12B is a side, cross-sectional view of the fan gate configuration of FIG. 12A and having a gate land.
Figure 12C:
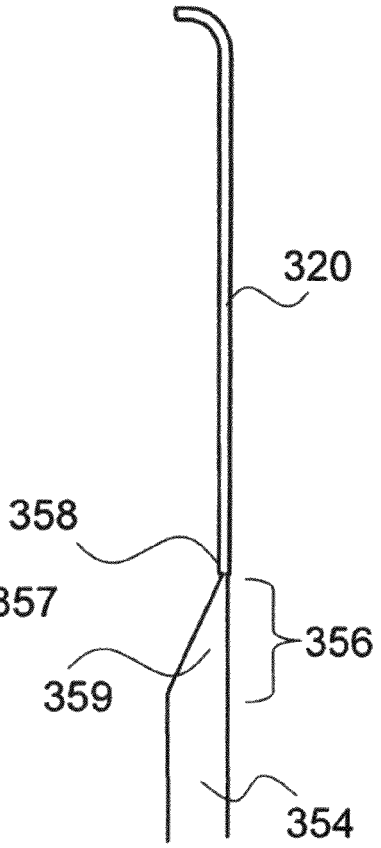
FIG. 12C is a side, cross-sectional view of another embodiment of a fan gate configuration without a gate land.

The system gate may contribute to the production of shape cast parts having an appropriate finish. One example of a gate system is a fan gate, embodiments of which are illustrated in FIGS. 12A-12C. As illustrated, the shape of the gate system 356 has a fan-like shape (e.g., triangular/trapezoidal). In one embodiment, the edge of the gate system 356 may be used to identify the edge of the shape cast product 328. As shown in FIGS. 12A-12B, the gate system 356 includes a fan gate 359 and a gate land 357. As shown in FIG. 12C, the gate system 356 includes only a fan gate 359.

In general, molten metal 326 may travel from the shot sleeve 314 through the runners 354 and the gate system 356 before entering into the die cavity 320 during the production of a shape cast product 328. The runners 354 are paths or passageways that facilitate the flow of molten metal 326. A runner 354 can take on any shapes, sizes and/or angles as necessary or as feasible. In one embodiment, as the molten metal 326 flows through the runner 354, it may transition into a region referred to as a gate system 356. Once within the gate system 356, the molten metal 326 may enter the die cavity 320 through a gate 358. In one embodiment, a gate system 356 may have a substantially triangular/trapezoidal shape. In some embodiments, the gate system 356 can take on other polygonal shapes and sizes.

In one embodiment, the gate system 356 has a width as measured from the runner 354 to the gate 358 of at least about 15 mm. In some embodiments, the width of the gate system 356 may be not greater than about 10 mm, or not greater than about 5 mm, or not greater than about 4 mm, or not greater than about 3 mm, or not greater than about 2 mm, or not greater than about 1 mm. In some embodiments, a gate system 356 having a shorter width means that there would be less distance for the molten metal 326 to travel from the runner 354 to the gate 358 thereby decreasing the likelihood that the molten metal 326 would experience a large amount of heat loss (e.g., lower temperature drops as the molten metal 326 moves from the runner 354 to the gate 358). In other words, in some embodiments, the distance traveled by the molten metal from an initial path (e.g., the runner 354) to the casting cavity may be directly proportional to (e.g., equivalent to) the width of the gate system. In contrast, a gate system 356 having a longer width means that there would be more distance for the molten metal 326 to travel from the runner 354 to the gate 358 thereby increasing the likelihood that the molten metal 326 would experience a large amount of heat loss (e.g., higher temperature drops as the molten metal 326 moves from the runner 354 to the gate 358).

Figure 13A:
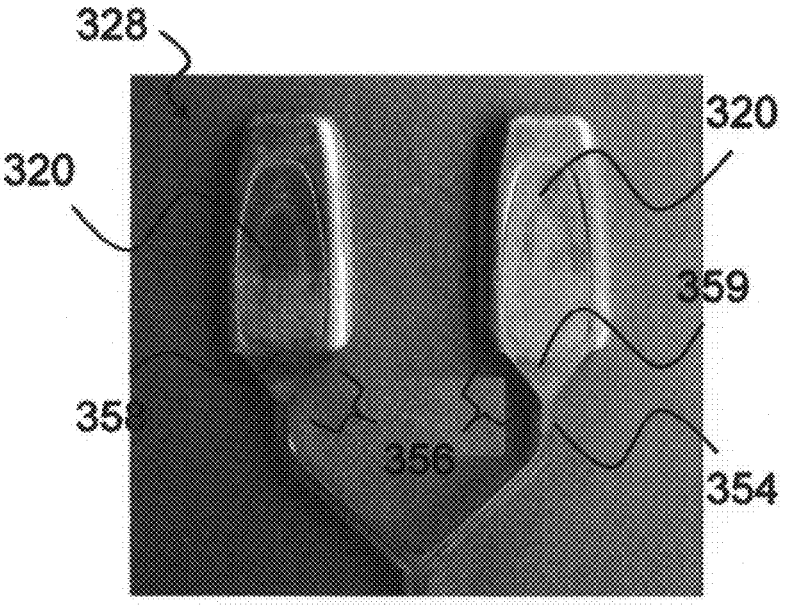
FIGS. 13A-13C are top-down, perspective, and side-view photographs, respectively, of mobile electronic device covers in the as-cast condition and produced using a fan gate configuration according to one embodiment of the present disclosure.
Figure 13B:
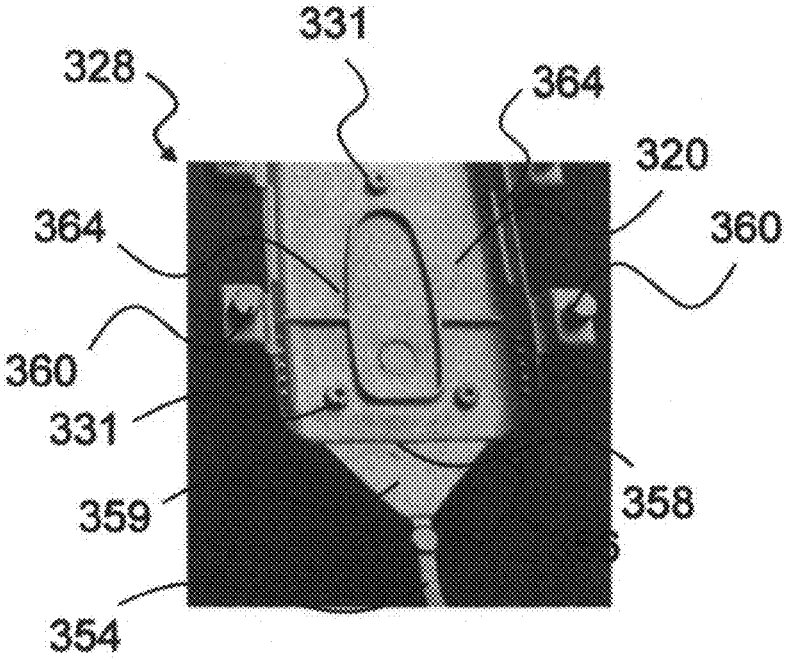
Figure 13C:
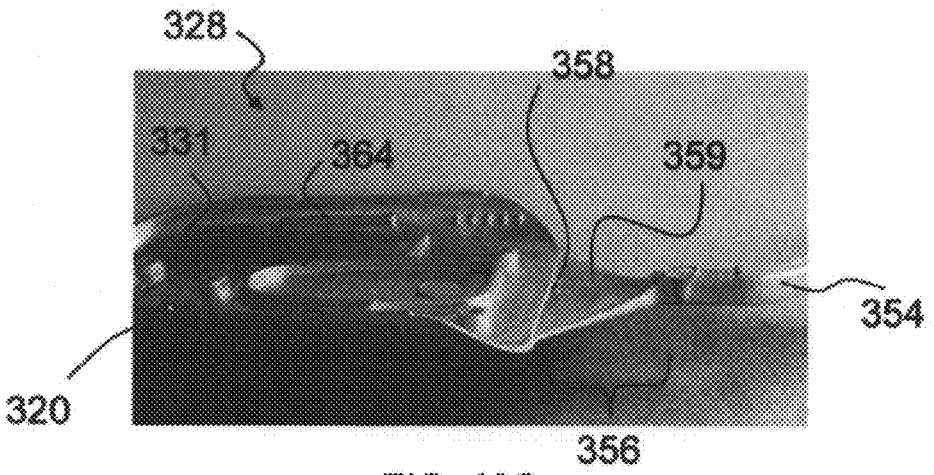

FIGS. 13A-13C are top-down, perspective and side-view photographs, respectively, of mobile electronic device covers 328 in an as-cast condition produced by a shape casting process (120) according to one embodiment of the present disclosure. FIG. 13A is a top-down photograph of the exterior surface of two side-by-side mobile electronic device covers 328 in an as-cast condition showing the runner 354 coupled to the fan gate 359 and the gate 358 of the die cavity 320. In general, the exterior surface results from a shape casting process (120) where the molten metal 326 makes physical contact with the surface of a cover die 312. FIG. 13B is a perspective view photograph of an interior surface of a mobile electronic device cover 328 in an as-cast condition having screw bosses 331, ribs 364, and overflow structures 360. In general, the interior surface results from the molten metal 326 physically contacting the surface of the ejector die 310.

In some embodiments, the screw boss 331 may be used to receive an ejector pin 330. In some embodiments, the overflow structure 360 may also be configured to receive an ejector pin 330. In some embodiments, overflow structures 360 may facilitate the removal of oxide films that may form within the molten metal 326 during early stages of cavity fill. In other words, any melt fronts that may be rich in oxide film may flow into the overflow structures 360 and thus be flushed out of the die cavity 320. Subsequently, the overflow structures 360 may be trimmed or removed by trim presses (not shown) as shown in FIG. 13A (compare FIG. 13A where the overflow structures 360 have been removed versus FIG. 13B where the overflow structures 360 are still present). In some embodiments, runners 354 may also be similarly trimmed (not shown). In some embodiments, the overflow structures 360 may be replaced with ejector pads (not shown) for receiving at least one ejector pin 330.

In this example, the interior surface of the mobile electronic device cover 328 in an as-cast condition shows the runner 354 coupled to the fan gate 359, which is adjacent to the gate 358 of the die cavity 320. FIG. 13C is a side view photograph of FIG. 13B showing the shape of the gate system 356 being substantially similar to that of FIG. 12C with the exception that the cross-section of the fan gate 359 of FIG. 13C may be slightly more concave with respect to the runner 354 as compared to the fan gate 359 of FIG. 12C.

Figure 14A:
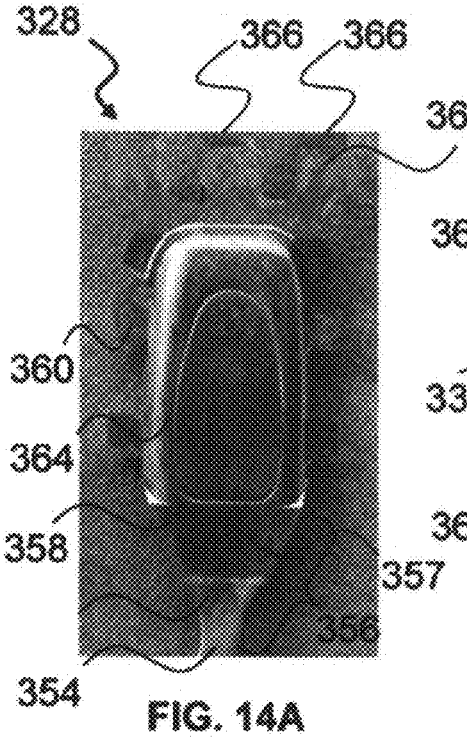
FIG. 14A is a photograph of a mobile electronic device phone cover in as-cast condition produced using a fan gate configuration according to one embodiment of the present disclosure.
Figure 14B:
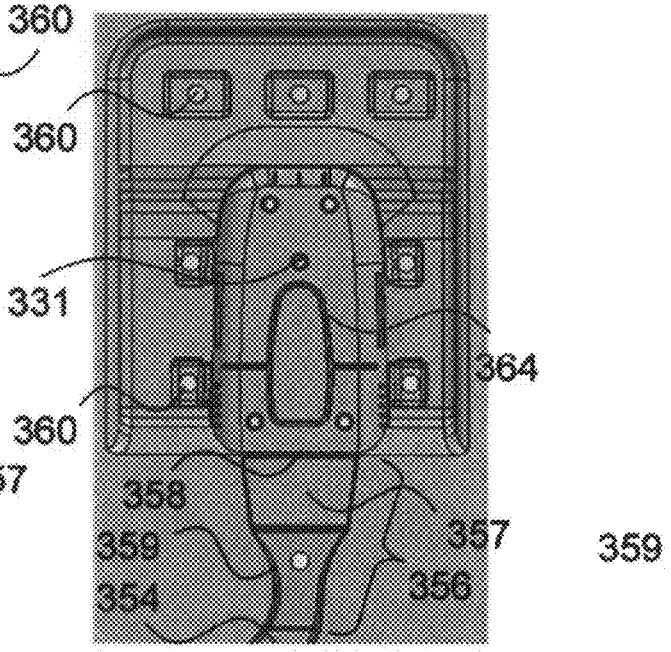
FIG. 14B is a CAD drawing of the fan gate configuration used for die casting the mobile electronic device cover of FIG. 14A.

FIG. 14A is a photograph of an exterior surface of a mobile electronic device cover 328 in the as-cast condition produced by a shape casting process (120) using a fan gate. FIG. 14B is a computer-aided design (CAD) drawing of an ejector die 310 of the mobile electronic device cover 328 of FIG. 14A. Similar to above, the ejector die 310 may include at least one screw boss 331, a plurality of ribs 364, and at least one overflow structure 360. In this example, the ejector die 310 also includes a plurality of vents 366. In some embodiments, the vents 366 may facilitate removal of gases that may be trapped within the die cavity 320 as the die cavity 320 fills with molten metal 326. In some embodiments, the vents 366 may be designed to prevent spitting of molten metal 326 from the plane between where two die halves 310, 312 meet. The vents 366 may also be trimmed and removed from the part similar to that shown in FIG. 13A (e.g., overflow structures 360 and vents 366 have been trimmed) as compared with FIG. 14A (e.g., overflow structures 360 and vents 366 have not been trimmed).

In FIGS. 14A-14B, the gate system 356 includes a fan gate 359 and an extended gate land 357. In one instance, the extended gate land 357 may be included in a gate system 356 to reduce/restrict the formation of streaks of a part in as-cast condition. That is, the gate system 356 may be considered a transition path, and this transition path may include a fan gate configuration. In this embodiment, the fan gate configuration includes the gate land 357 and the fan gate 359 itself.

In one embodiment, the fan gate 359 angles out (e.g., tapers) as it meets the extended gate land 357 (FIGS. 14A-14B). In one embodiment, the fan gate 359 angles as it meets the gate 358 (FIGS. 13A-13C). In some embodiments, the angling of the fan gate 359 into the gate 358 or gate land 357 may need to be maintained below a certain angle (e.g., less than about 45°). Otherwise, the melt front may not quickly expand and fluid vortices may be created within the fan gate 359, resulting in defects of the part within the die cavity 320.

In one embodiment, the runner 354 may have a cross-sectional area (e.g., width times depth) of at least about 10 $mm^2$. In some embodiments, the cross-sectional area may be at least about 15 $mm^2$, or at least about 20 $mm^2$, or at least about 25 $mm^2$, or at least about 35 $mm^2$, or at least about 50 $mm^2$, or at least about 75 $mm^2$, or at least about 100 $mm^2$. In some embodiments, the cross-sectional area may be at least about 200 $mm^2$. In one embodiment, the cross-sectional area of the runner 354 may be indicative of the ability of the molten metal 326 to maintain a high temperature. For example, a relatively thin runner 354 (e.g., a runner 354 having a relatively thin cross-sectional area) may not be able to maintain a flow of molten metal 326 at a relatively high temperature because the core temperature of the molten flow may be dissipated as it would be relatively easy for the core of the molten metal 326 to make contact with the sidewalls of the runner 354. In contrast, a relatively thick runner 354 (e.g., a runner 354 having a relatively thick cross-sectional area) may be able to maintain a flow of molten metal 326 at a relatively higher temperature because the core temperature of the molten flow may not dissipate as readily since it would not be as easy for the core of the molten metal 326 to make contact with the sidewalls of the runner 354. Thus, a flow of molten metal 326 from a runner 354 having a larger cross-sectional area may be able to maintain and deliver the flow at a relatively higher temperature into the die cavity 320 versus a flow of molten metal 326 from a runner 354 having a smaller cross-sectional area.

Tangential Gate Configuration

Figure 15A:
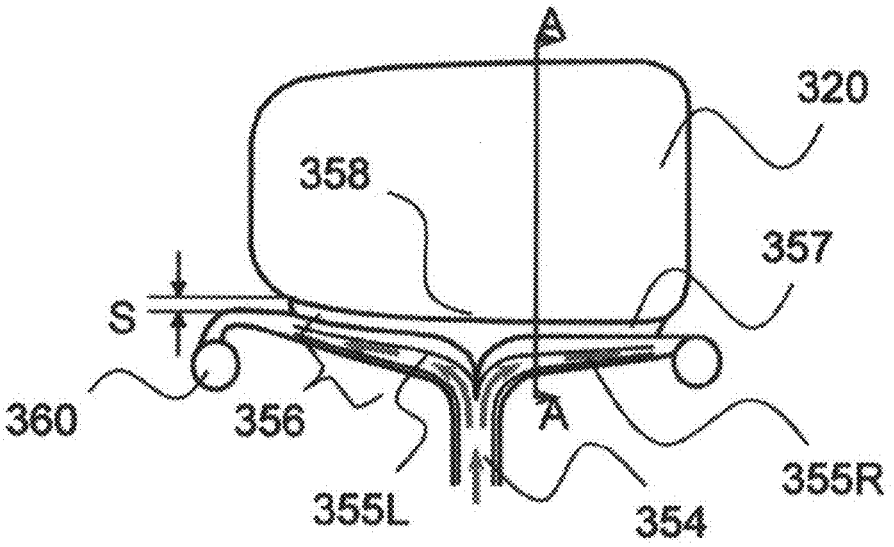
FIG. 15A is a perspective view of one embodiment of a tangential gate configuration according to the present disclosure.
Figure 15B:
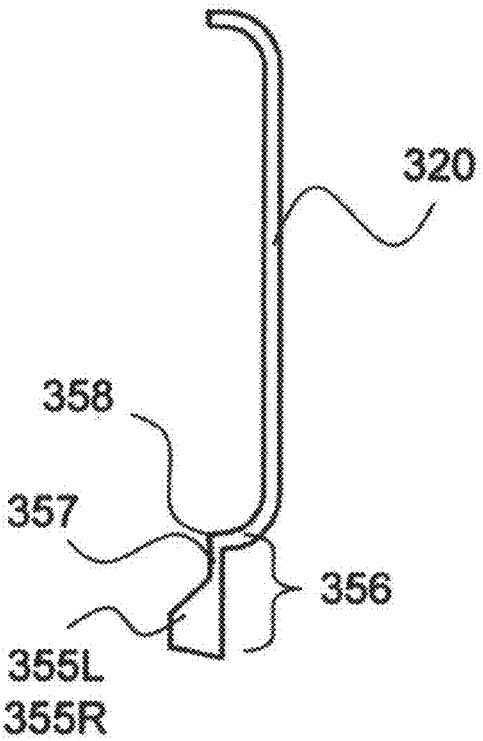
FIG. 15B is a side, cross-sectional view of the tangential gate configuration of FIG. 15A and having a gate land.
Figure 15C:
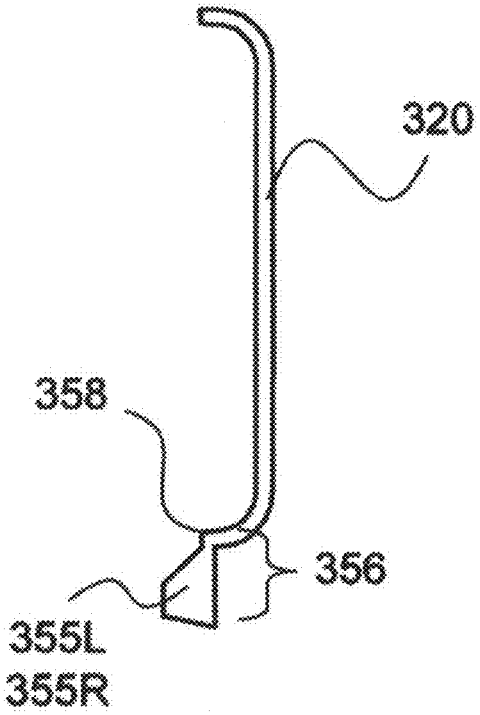
FIG. 15C is a side, cross-sectional view of another embodiment of a tangential gate configuration without a gate land.

In some embodiments, the design of the gate system 356 is a tangential gate configuration. FIG. 15A is a drawing of one embodiment of a tangential gate configuration, FIG. 15B is a cross-section of FIG. 15A through the line A-A, and FIG. 15C is a cross-section of another embodiment of FIG. 15A without a gate land 357. As illustrated in FIG. 15A, the main runner 354 may branch into a left tangential gate runner 355L and a right tangential gate runner 355R. In these instances, the branching of the runner 354 into two tangential gate runners 355L, 355R allows the molten metal 326 to flow tangentially with respect to the gate 358 (e.g., gated edge of the part). In one embodiment, the edge of the gate system 356 may also be used to identify the edge of the part (e.g., the shape cast product 328). As shown in FIGS. 15A-15B, the gate system 356 includes two branch runners 355L, 355R and a gate land 357. As shown in FIG. 15C, the gate system 356 includes two branch runners 355L, 355R but no gate land 357.

Figure 16A:
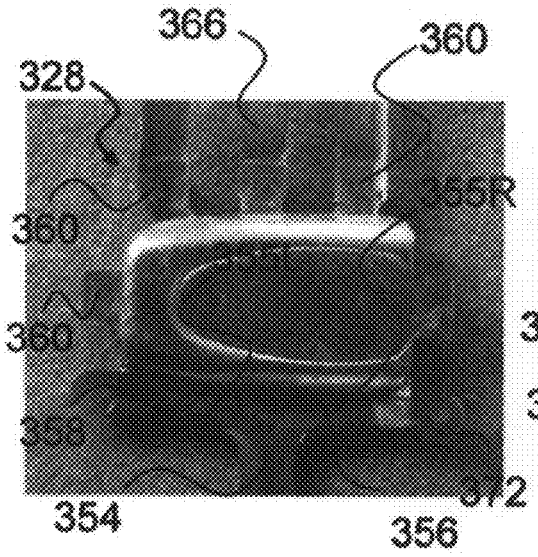
FIG. 16A is a photograph of a mobile electronic device cover in the as-cast condition produced using a tangential gate configuration according to one embodiment of the present disclosure.
Figure 16B:
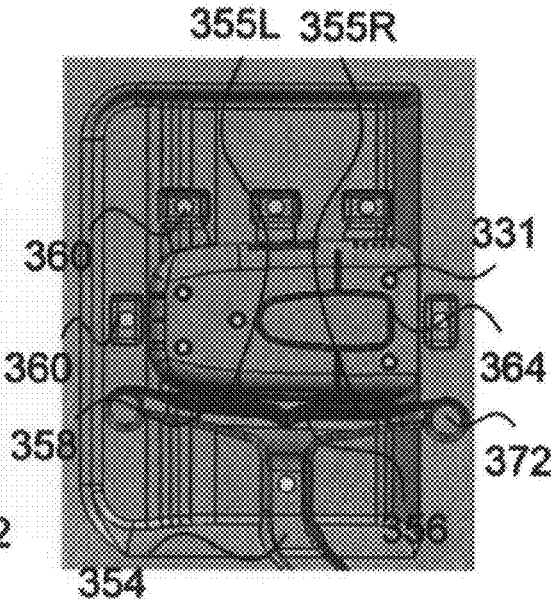
FIG. 16B is a CAD drawing of the tangential gate configuration used for die casting the mobile electronic device cover of FIG. 16A.

FIG. 16A is a photograph of an exterior surface of a cell phone cover 328 in the as-cast condition as produced by a shape casting process (120) using a tangential gate. FIG. 16B is a computer-aided design (CAD) drawing of an ejector die 310 of the cell phone cover 328 of FIG. 16A. Similar to above, the ejector die 310 may include screw bosses 331, ribs and bosses 364, overflow structures 360, and vents 366. In one embodiment, the ejector die 310 may include the division of a main runner 354 into two tangential gate runners 355L, 355R. In one embodiment, the ejector die 310 may also include at least one shock absorber 372, which may facilitate or buffer the flow of the molten metal 326 as it impacts the end of the tangential runner 355L, 355R.

In one embodiment, the main runner 354 may run tangentially along an edge of the die cavity 320 via the tangential runners 355L, 355R. In some embodiments, the gated edge of the branch runners 355L, 355R may incorporate or include a tapered side. In some examples, the gated edge may have minimum taper. In some instances, the tangential runners 355L, 355R may run parallel to the gated edge of the part 328. In other instances, the tangential runners 355L, 355R may run at some angle relative to the gated edge of the part 328. Tangential gates may be better at producing shape cast products that are subsequently free of visually apparent surface defects than fan gates.

Other Miscellaneous Gate Configurations

FIGS. 17A-17B and 18A-18B illustrate a variety of gate configurations that may be used for producing a consumer electronics part by a shape casting process (120) in some embodiments of the present disclosure.

Figure 17A:
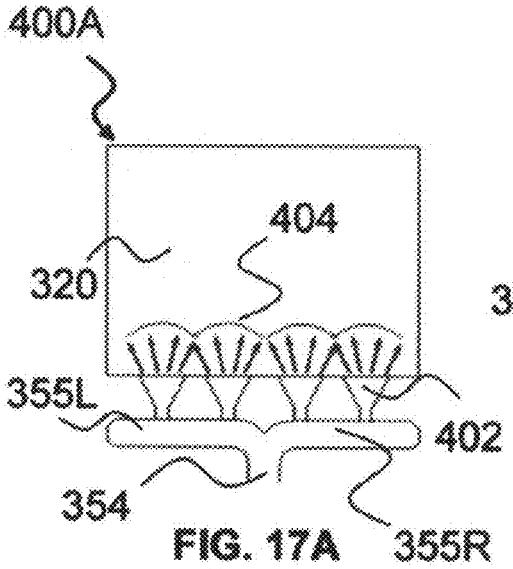
FIG. 17A is a drawing of one embodiment of a segmented fan gate configuration for a shape casting process according to the present disclosure.

FIG. 17A is an example of a fan gate configuration 400A similar to those of FIGS. 12A-12C, 13A-13C and 14A-14B. However, this fan gate configuration 400A includes multiple fan gates 402 with a main runner 354 branching into left and right runners 355L, 355R similar to that of the tangential gate configuration discussed above. Because of the multiple gates 402, this fan gate configuration 400A may also be referred to as a segmented fan gate configuration 400A. The multiple segmented gates 402 may be able to deliver multiple segmented melt fronts 404 as the molten metal 326 enters the die cavity 320 from the gate system 356.

Figure 17B:
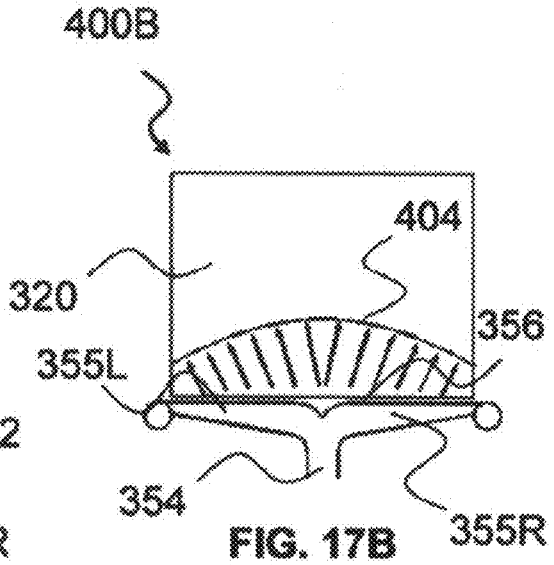
FIG. 17B is a drawing of one embodiment of a tangential gate configuration for a shape casting process according to the present disclosure.

FIG. 17B is an example of a tangential gate configuration 400B similar to that of FIGS. 15A-15C and 16A-16B. In one embodiment, the tangential gate configuration 400B is able to deliver a single melt front 404 as the molten metal 326 enters the die cavity 320 from the gate system 356. Like the previous tangential gate configurations, the main runner 354 may branch into two tangential runners 355L, 355R and run tangent to the part cavity 320.

Figure 18A:
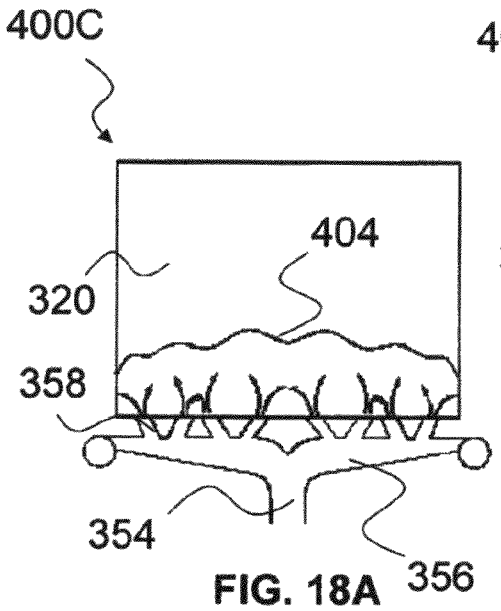
FIG. 18A is a drawing of one embodiment of a swirl gate configuration for producing a shape cast product according to one embodiment of the present disclosure.
Figure 18B:
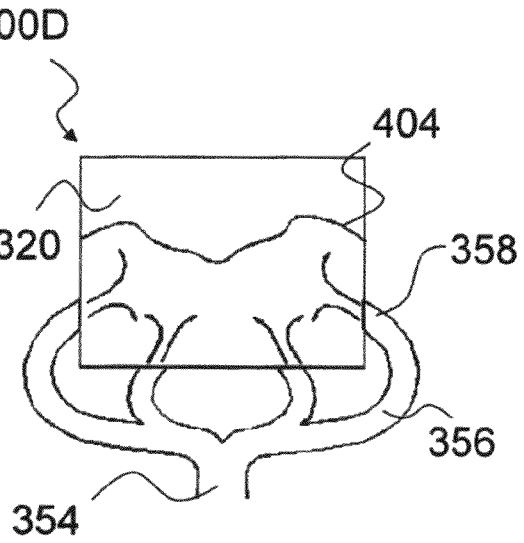
FIG. 18B is a drawing of another embodiment of a swirl gate configuration for producing a shape cast product according to one embodiment of the present disclosure.

FIGS. 18A-18B are examples of two different swirl gate configurations 400C, 400D. In FIG. 18A, a single, substantially wide gate system 356 is able to branch into multiple gates 358 that subsequently feed the molten metal 326 into the die cavity 320. In one embodiment, the melt front 404 being delivered into the die cavity 320 is able to randomly mix with an adjacent melt front 404 from a neighboring gate 358. In one embodiment, the resulting melt front 404 is able to swirl fill the part and eliminate any cold shuts and/or voids, among other surface defects. In FIG. 18B, the gate system 356 is not only wide but it also extends around the sides of the die cavity 320 and branch into multiple gates 358 that subsequently provides multiple feeding of the molten metal 326 into the die cavity 320. These multiple gates 358 may be equal in shape and/or size and be situated opposite each other. For example, a gate 358 may be situated on the left-hand side of the die cavity 320 while a similarly shaped/sized gate 358 may be situated on the opposite right-hand side of the die cavity 320. In one embodiment, the melt front 404 being delivered into the die cavity 320 may be able to uniformly and randomly mix with the other melt fronts 404 from neighboring gates 358, with a combined melt front 404 capable of swirl filling the part and eliminating any cold shuts and/or voids, among other surface defects. In some embodiments, the swirl gate configurations 400C, 400D may generate a uniformly random flow pattern for producing a shape cast product intended to have a marbled finish.

Gate Land Region

In some embodiments, the tangential runners 355L, 355R and the gate land 357 may bring about further cooling of the molten metal 326 as it is flowing from the shot sleeve into the die cavity 320. In one embodiment, the gate land 357 may couple to a bottom edge of a die cavity 320. In one embodiment, the gate land 357 may couple to a side of a die cavity 320. The cooling may be due to a drop in temperature as the molten metal 326 comes in physical contact with these different regions (e.g., the main runner 354, the tangential runners 355L, 355R, the gate land 357), which may not be temperature controlled. The change in temperature may cause different microstructure layers to be formed as the molten melt 326 cools, causing different layers to be formed on the surface of the part. In some embodiments, the formation of the different surface layers may lead to surface defects (e.g., products that are not aesthetically pleasing).

In some embodiments, it may be necessary to restrict the temperature drop of the molten metal 326 as it flows from the shot sleeve, through the main runner 354, through the gate system 356, before eventually passing through the gate 358 and into the die cavity 320. In one embodiment, it may be useful to have small distance between the shot sleeve and the gate 358 in order to reduce/restrict the temperature drop of the molten metal 326 as the metal travels through the main runner 354 and the gate system 356 (e.g., fan gate configuration, tangential gate configuration). In one embodiment, the length of the main runner 354 (e.g., as measured from the end of the shot sleeve to the beginning of the gate system 356) may be relatively short. In some embodiments, for a single die cavity 320, the length of the runner 354 may be not greater than about 50 mm, or not greater than about 40 mm, or not greater than about 30 mm, or not greater than about 20 mm, or not greater than about 15 mm, or not greater than about 10 mm, or not greater than about 5 mm. In some embodiments, the shorter the length of the runner 354, the lower the amount of heat loss the molten metal 326 may experience as it moves through the runner 354. The ability to maintain a flow of molten metal 326 at a pre-determined temperature without dramatic fluctuations may facilitate the casting of the desired microstructure.

In one embodiment, the spacing (S) as shown in FIG. 15A (e.g., the width of the gate land 357 as measured from the tangential runners 355L, 355R to the gate 358) may be not greater than about 10 mm, or not greater than about 5 mm, or not greater than about 4.5 mm, or not greater than about 4 mm, or not greater than about 3.5 mm, or not greater than about 3 mm, or not greater than about 2.5 mm, or not greater than about 2 mm, or not greater than about 1.5 mm, or not greater than about 1 mm, or not greater than about 1 mm, or not greater than about 0.5 mm. In one embodiment, the spacing (S) may be about 0 mm or substantially negligible. In some embodiments, the shorter the spacing (S), the lower the amount of heat loss the molten metal 326 may experience as it moves through the gate land 357. The ability to maintain a flow of molten metal 326 at a pre-determined temperature without dramatic fluctuations may facilitate the casting of a single microstructure on the surface of the part.

In one embodiment, the spacing (S) as shown in FIG. 12A (e.g., the width of the gate land 357 as measured from the fan gate 359 to the gate 358) may be not greater than about 10 mm, or not greater than about 5 mm, or not greater than about 4.5 mm, or not greater than about 4 mm, or not greater than about 3.5 mm, or not greater than about 3 mm, or not greater than about 2.5 mm, or not greater than about 2 mm, or not greater than about 1.5 mm, or not greater than about 1 mm, or not greater than about 1 mm, or not greater than about 0.5 mm. In one embodiment, the spacing (S) may be about 0 mm or substantially negligible. In some embodiments, the shorter the spacing, the lower the amount of heat loss the molten metal 326 may experience as it moves through the gate system 356. The ability to maintain a flow of molten metal 326 at a pre-determined temperature without dramatic fluctuations may facilitate the casting of a single microstructure on the surface of the part.

Degree of Transition

Figure 19:
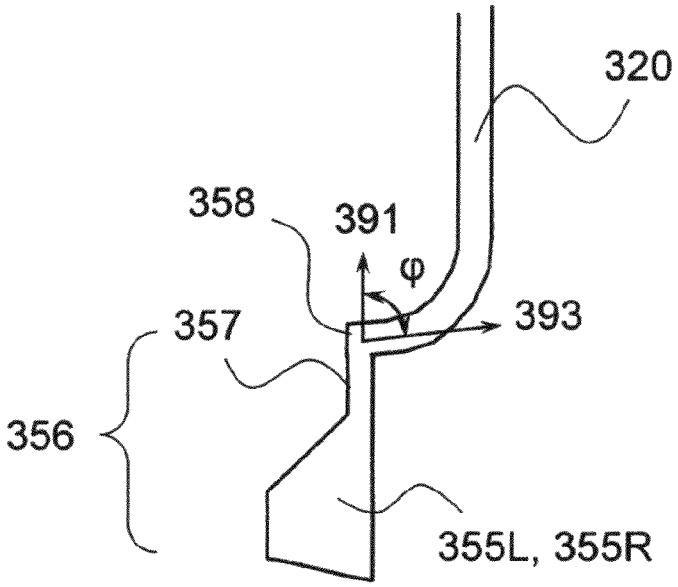
FIG. 19 is a cross-sectional, side view of a tangential gate configuration for casting a shape cast product in accordance with the present disclosure.

Reference is now made to FIG. 19, which illustrates a cross-sectional view of a tangential gate configuration for casting a shape cast product according to one embodiment of the present disclosure. As shown, the molten metal 326 may flow from the shot sleeve (not shown) along the tangential runners 355L, 355R before entering the die cavity 320. In one embodiment, a gate system 356 includes the tangential runners 355L, 355R so that the molten metal 326 may flow through the gate system 356 and into the die cavity 320 through a gate 358. The gate 358 may be defined as the intersection between an edge of the die cavity 320 (e.g., a part in as-cast condition) and an edge of the gate system 356.

In some embodiments, there may be various degrees of transition (ϕ) between the gate land 357 and the die cavity 320. As used herein, "degree of transition" is the angle of transition (ϕ) between the plane 391 of the gate land 357 and the plane 393 of the gated edge of the part cavity 320. In some instances, angle of transition or degree of transition may be used interchangeably.

In one embodiment, the molten metal 326 may enter the die cavity 320 from the gate land 357 at an angle (ϕ). In one embodiment, as the molten metal 326 is flowing from the gate land 357 through the gate 358 and into the die cavity 320, the degree of transition or angle of change (ϕ) allows the molten metal 326 to experience added turbulence. The additional turbulence disrupts the flow of the molten metal 326 and allows additional mixing of the molten metal 326. In one embodiment, the additional turbulence from the angle change (ϕ) may lead to a more uniform mixing of the molten metal 326 thereby resulting in parts that are substantially free of surface defects.

In one embodiment, the degree of transition or angle of change (ϕ) forces the flowing molten metal 326 to make turns within its flow path. In other words, the molten metal 326 may encounter turbulence while it transitions from one region (e.g., gate land 357) to another (e.g., die cavity 320). The turbulence mixes up any semi-solid particles that may be present within the molten metal 326 so as to allow parts to be cast without any substantial streaks, voids or other surface defects.

In one embodiment, the angle or degree of transition (ϕ) as the molten metal 326 flows from the gate land 357 into the die cavity 320 may be at least about 30 degrees. In some embodiments, the angle of transition (ϕ) is at least about 35 degrees, or at least about 40 degrees, or at least about 45 degrees, or at least about 50 degrees, or at least about 55 degrees, or at least about 60 degrees, or at least about 65 degrees, or at least about 70 degrees, or at least about 75 degrees, or at least about 80 degrees. The angle of transition generally should not exceed about 90 degrees, since under cut and other issues may be encountered, which may increase the complexity of the die. About 90 degrees means an angle that is substantially perpendicular, and, in some instances, may slightly exceed exactly 90 degrees so long as the above-referenced issues are not experienced. The angle of transition (ϕ), as shown in FIG. 19, is at about 90 degrees. In one embodiment, the angle of transition is in the range of from about 80 degrees to about 90 degrees.

Surface Morphology

As discussed above, surface defects may include cold-shuts, lap-lines, flow-lines and mottled discolorations, among others. FIG. 20A is an illustration of an as-cast cell phone cover 328 having flow-lines near the gate area 358. FIG. 20B is an illustration of an as-cast cell phone cover 328 having dark mottled discoloration near the overflow region 360.

Microstructure Control

As described above, three different microstructures may be produced based on finishing requirements: (1) a layered microstructure with a small outer surface thickness (e.g., for products having a restricted amount of visually apparent surface defects), (2) a layered microstructure with a blended amount of alpha aluminum phase and eutectic (e.g., for marbled products), or (3) a homogeneous microstructure. The casting processes described herein can be tailored to achieve the desired microstructure. The factors that affect the microstructure on the surface of a part 328 in as-cast condition include under cooling, maintaining/handling of the melt composition, gate configuration and monitoring/controlling the temperature of the die, among others. Fan or swirl gates may be useful at producing a marbled product whereas a tangential gate may be useful in producing the other microstructure.

Under Cooling

In some embodiments, under cooling during casting may occur, such as when the cooling rate of the molten metal 326 is faster than the solidification kinetics at equilibrium. In other words, under cooling may occur when the molten metal 326 cools at a faster rate than equilibrium cooling. In one embodiment, with under cooling, solidification of the molten metal 326 may occur at a lower temperature than indicated by the phase equilibrium. In one embodiment, under cooling may occur at the surface where a relatively hot molten metal 326 comes in contact with relatively cold die halves 310, 312.

In some embodiments, in an under cooled situation, the melt composition for an Al—Ni binary alloy or an Al—Ni—Mn ternary alloy may need to be richer (e.g., higher weight percentages) than an equilibrium eutectic composition in order to achieve the desired microstructure, i.e., a hypereutectic composition. During equilibrium cooling conditions, a nearly complete eutectic microstructure may be achieved with a eutectic composition. For example, during equilibrium cooling conditions, an Al—Ni composition of about 5.66 wt. % Ni, the balance being aluminum, incidental elements and impurities, would be expected to produce a eutectic microstructure. However, equilibrium cooling conditions may be difficult to achieve during die casting; e.g., under cooling may be prevalent on the surface of the consumer electronics part where the hot molten metal makes first contact with the relatively much cooler die cavity. Therefore, it may be useful to use non-eutectic compositions to achieve the desired end microstructure. Indeed, non-equilibrium cooling of an alloy at a eutectic composition may produce a layered microstructure having a relatively large outer layer, and therefore the use of eutectic compositions may be disfavored for certain shape casting applications. Thus, in some instances the alloy composition is adjusted to the hypereutectic range, and in view of the expected cooling conditions of the casting process so as to produce a layered microstructure, which may be tailored to the selected finishing style. In other embodiments, the alloy composition is adjusted to the hypoeutectic range to produce a homogeneous microstructure.

In one example, to achieve a layered microstructure having a thin outer layer, and with a cooling rate of about 70° C./s, a hypereutectic Al—Ni composition may be selected, such as from about 5.8 wt. % Ni to about 6.6 wt. % Ni, the balance being aluminum, incidental elements and impurities. For higher cooling rates, an even more hypereutectic composition may be used to achieve the desired layered microstructure. In one example, for a binary alloy cast with a cooling rate of about 250° C./s, the alloy composition may include from about 6.3 wt. % Ni to about 6.8 wt. % Ni, the balance being aluminum, incidental elements and impurities. Similar adjustments may be made for the ternary Al—Ni—Mn alloys.

Melt Composition

In some embodiments, controlling and/or maintaining the temperature of the molten metal 326 (e.g., the melt) may be useful during a shape casting process (120). This may be useful as the melt temperature has a tendency to drift lower throughout the shape casting process (120). Melt temperatures that are too low may create cold-shuts and/or lap-lines in the parts in the as-cast condition, while melt temperatures that are too high may cause soldering and/or sticking to occur. In one embodiment, the molten metal 326 may be superheated to facilitate casting processes. For example, the melt may be maintained at a temperature of at least 50° C. above its liquidus point (i.e., >50° C. of superheat. In some embodiments, the melt may have a superheat of at least about 60° C., or at least about 70° C., or at least about 80° C., or at least about 90° C., or at least about 100° C., or at least about 120° C., or at least about 140° C., or more.

In one example, when casting a binary Al—Ni alloy, the melt temperature may be maintained at about 771° C.±10° C., providing about 133° C.±10° C. of superheat. In other instances, the melt temperature may be maintained at about 754° C.±10° C. for binary Al—Ni alloys. As another example, when casting a ternary Al—Ni—Mn alloy, the melt temperature may be maintained at about 782° C.±10° C., providing about 144° C.±10° C. of superheat. In other instances, the melt temperature may be maintained at about 765° C.±10° C. for ternary Al—Ni—Mn alloys. In some embodiments, the melt temperatures may be maintained at other superheat levels depending on the amount of heat loss through the various stages of the shape casting process (120), such as due to heat loss incurred due to the flow of the melt through the shot sleeve 314, the runner 354, and/or the gate system 356, before entering the die cavity 320.

In some embodiments, excessively high melt temperature may promote sharply contrasting flow-lines in the gate area of anodized cast products for both the Al—Ni and the Al—Ni—Mn alloys. For example, for both Al—Ni and Al—Ni—Mn alloys having a eutectic or near eutectic composition, the melt temperature may not exceed about 788° C.±10° C. In some embodiments, for both Al—Ni binary and Al—Ni—Mn ternary alloys, cold-shuts and/or lap-lines may occur when the melt temperature is below about 760° C.±10° C. In some embodiments, the range of melt temperatures for near-eutectic alloys may be maintained at from about 760° C. to about 790° C.

In some embodiments, a high degree of melt cleanliness may be required to avoid the formation of "comet tails" during a mechanical-polishing finishing step. FIG. 21A is a photograph of a mobile electronic device cover 328 after it has been mechanically polished. A plurality of comet tails may be seen near the gate area 358. FIG. 21B is a scanning electron microscope (SEM) micrograph at 200 times magnification of a comet tail of FIG. 21A showing the blemish in added detail. The SEM micrograph suggests that one of the sources of the problem may be a dirty melt (e.g., $Al_2O_3$) created by continuously re-melting run-around scrap. Comet tails may be caused by metal oxides that are present in the molten metal 326, for example. Spot analysis indicates that the contaminating particles in the melt composition include aluminum, oxygen, carbon, iron, copper, sodium, magnesium and nickel, among others.

Die Temperature

As described above, under cooling affects the microstructure of the shape cast product. In some instances, it is useful to reduce the change in temperature (e.g., $\Delta T$) across the length and the width of the die casting cavity 320 for better die temperature control, and to reduce the amount of under cooling. Die and melt temperatures vary depending on the size of the die, and the type of aluminum alloy being utilized as the molten metal, among other factors and variables. One method of restricting the amount of under cooling is to increase die temperature. Another method is to fabricate the die using a low thermally-conductive material, or coat the die surface with such a material. Casting dies may be made from steel (e.g., H13), which can be hardened to resist erosion. A surface treatment may be applied, such as nitriding or a PVD-applied metal-nitride (e.g., CrN and TiN), among other surface treatment processes. In some embodiments, ceramic, wax-based and/or silicon-based coatings may be used as a low thermally-conductive material.

In one embodiment, the die temperature may be increased to reduce under cooling effects. In some embodiments, the die halves 310, 312 may be maintained at temperatures of from about 220° C. to about 280° C. In other embodiments, the die halves 310, 312 may be maintained at other suitable temperatures. In some embodiments, the heating may be carried out with hot oil or hot water through surrounding channels and/or cavities. In some embodiments, the heating may be carried out with an electric cartridge heater, electric furnaces or other suitable medium. Increasing die temperatures may tend to reduce or eliminate visually apparent surface defects.

III. Methods, Systems and Apparatus for Finishing Shape Cast Products

Figure 23:
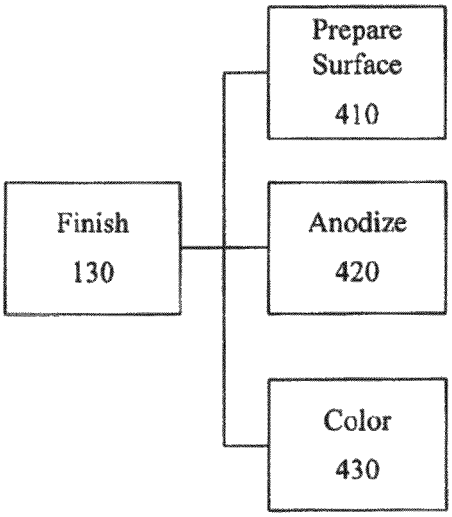
FIG. 23 is a chart illustrating one embodiment of various finishing processes useful in accordance with the present disclosure.

Referring now to FIGS. 1 and 23, after the shape casting process (120), the shape cast product is usually finished (130) to produce the decorative shape cast product. The finishing step (130) may include one or more of surface preparation (410), anodizing (420) and/or coloring (430) steps, as described in further detail below. The use of one or more of these finishing steps may result in the production of durable, decorative shape cast products. These shape cast products may have a body having an intended viewing surface. The body may include an aluminum alloy base (e.g., an Al—Ni or Al—Ni—Mn alloy) and an oxide layer, formed from the aluminum alloy base (via anodizing of the aluminum alloy base), and overlaying the aluminum alloy base. The oxide layer may be relatively uniform due to the use of the Al—Ni and/or Al—Ni—Mn alloys. The oxide layer may be associated with an intended viewing surface of the shape cast product. The oxide layer may include a plurality of pores, which may be sealed and/or include a colorant at least partially disposed in (e.g., filling) at least some of these pores, as described in further detail below. In embodiments where a coating is used, the coating may overlay at least a portion of the oxide layer, and may at least partially assist in creating the visually attractive decorative shape cast product. In some embodiments, the coating is a silicon polymer coating. The intended viewing surface of the decorative shape cast products may be substantially free of visually apparent surface defects, due to, for example, at least one of the selected alloy composition, the selected microstructure, the selecting casting process, and/or the selected finishing steps, used to create the decorative shape cast product.

In one embodiment, the oxide layer comprises Al, Ni, and O, such as when an Al—Ni or Al—Ni—Mn alloy is anodized. In these embodiments, the oxide layer may include at least one of S, P, Cr, and B, such as when being anodized in a sulfuric acid, phosphoric acid, chromic acid, and/or boric acid, respectively. In some embodiments, the oxide layer comprises Mn. In some embodiments, the oxide layer consists essentially of Al, Ni, O and at least one of S, P, Cr, and B and optionally Mn. In some embodiments, the oxide layer consists essentially of Al, Ni, O and at least one of S and P and optionally Mn. In one embodiment, the oxide layer consists essentially of Al, Ni, O and S and optionally Mn. These embodiments may be useful for producing durable decorative shape cast products that are dyed, and which may be substantially free of visually apparent surface defects or which may have a marbled appearance. In another embodiment, the oxide layer consists essentially of Al, Ni, O and P and optionally Mn. These embodiments may be useful for producing durable decorative shape cast products that are coated, and which may be substantially free of visually apparent surface defects.

In some embodiments, the decorative shape cast product is free of non-oxide layers between the base and the oxide layer. For example, since the oxide layer is produced by anodizing the aluminum alloy base, there will be no transition zone between the oxide layer and the aluminum alloy base, such as might be present in other production methods, such as when pure aluminum is deposited on top of the aluminum alloy base (e.g., via vapor deposition), after which the deposited pure aluminum is then anodized.

In one approach, a method includes one or more of the steps of producing a shape cast aluminum alloy product from an Al—Ni or an Al—Ni—Mn alloy, removing at least some of the outer layer from the shape cast product, anodizing the shape cast product, and applying a colorant to the oxide layer of the thin walled shape cast aluminum alloy product, wherein after the applying step at least some of the colorant is at least partially disposed within the pores of the oxide layer. For non-marbled products, after the applying step, the intended viewing surface is substantially free of visually apparent surface defects. In these embodiments, after the applying step, the variability of the color of the intended viewing surface may be not greater than +/−5.0 Delta E.

In one embodiment, the producing step comprises die casting the shape cast product, as described above. In one embodiment, the shape cast product has a layered microstructure, as described above. In one embodiment, the shape cast product has a homogeneous microstructure, as described above. In one embodiment, the shape cast product has a fairly regular distribution of alpha aluminum phase and eutectic microstructure, as described above.

In one embodiment, the removing step comprises chemically etching the shape cast product, as described below. In one embodiment, the removing step comprises removing not greater than 500 microns of material from the shape cast product, as described in further detail below. In some embodiments, the removing step is not necessary (e.g., for some marbled products and/or for some coated products). In one embodiment, the anodizing comprises forming an oxide layer from a portion of the shape cast aluminum alloy product. That is, the aluminum alloy base is anodized to produce the oxide layer.

In one embodiment, the applying colorant step comprises contacting the oxide layer with a dye and in the absence of electric current. In other words, the colorant of the instant disclosure does not need to be applied via electrocoloring. In one embodiment, the oxide layer is immersed in a bath containing the dye, as described in further detail below. In one embodiment, the applying step comprises depositing a coating precursor on a surface of the oxide layer, and converting the coating precursor to a coating, where after the converting step the coating substantially covers the oxide layer. In one embodiment, the coating precursor is a precursor to a silicon polymer and where the covering step comprises applying radiation or heat to the coating precursor to produce a coating containing the silicon polymer. In marbled embodiments, after the applying step, the intended viewing surface of the shape cast product has a substantially marbled appearance, where the alpha aluminum phase comprises a first color due to the colorant, where the eutectic microstructure comprises a second color due to the colorant, and where the second color is different than the first color, where the combination of the first color of the alpha aluminum phase and the second color of the eutectic microstructure at least partially contributes to the marbled appearance.

These and other useful features for finishing the presently described shape cast products are provided in further detail below.

A. Surface Preparation

Figure 24:
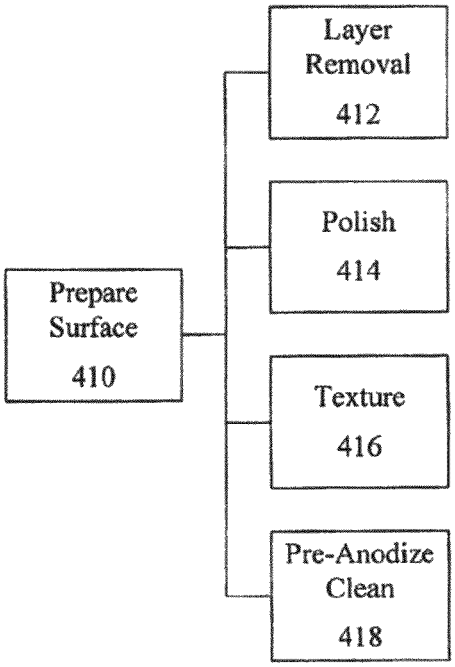
FIG. 24 is a chart illustrating one embodiment of various surface preparation processes useful in accordance with the present disclosure.

In one embodiment, and with reference to FIG. 24, the finishing step (130) may include a surface preparation step (410), which may include one or more of a layer removal step (412), a polishing step (414), a texturizing step (416) and/or a pre-anodizing clean step (418). For shape cast products having a layered microstructure (e.g., as illustrated in FIG. 5*a*), a layer removal step (412) may be utilized to achieve products having a restricted amount of visually apparent surface defects. For shape cast products having a layered microstructure, but with a tailored amount of alpha aluminum phase, the layer removal step (412) may not be required (e.g., for a marbled finish). Also, for shape cast products having a homogeneous microstructure (e.g., as illustrated in FIG. 5*b*), the layer removal step (412) may not be required.

For shape cast products intended to restrict the amount of visually apparent surface defects, the surface preparation step (410) may include the layer removal step (412). The layer removal step (412) may be useful since these products may be colored via dyeing (e.g., immersion in a heated bath of colorant), which dyeing may highlight the surface details (good or bad) of the cast product. In the case of an outer layer 500 having alpha aluminum (FIG. 5*a*), which may lie several microns beneath the upper surface of the outer layer 500, such dyeing processes may reveal an unappealing pattern of the cast product. Thus, in this embodiment, the layer removal step (412) may include removing at least a portion of an outer portion 500 of a cast product, as described above. The layer removal step (412) may be accomplished via any suitable process, such as chemical etching or mechanical abrasion. Mechanical abrasion may be accomplished via any suitable technique, but may be time and/or cost intensive. In the case of chemical etching, the etchant may be selected so a non-selective etch may be performed on the outer portion 500 of a cast product. The chemical etch may be performed in an environment and for a time that facilitates tailored removal of at least a portion of the outer layer 500, and, in at least some instances, with little or no removal of the second portion 510. In one embodiment, the layer removal step (412) removes at least about 50% (by volume) of the outer portion 500 of the cast product. In other embodiments, the removal step (412) removes at least about 75%, or at least about 85%, or at least about 95%, or at least about 99% of the outer layer of the cast product. In one embodiment, the layer removal step (412) removes less than about 50% (by volume) of the second portion. In other embodiments, the layer removal step (412) removes less than about 25%, or less than about 20%, or less than about 15%, or less than about 10%, or less than about 5%, or less than about 3%, or less than about 1% of the second portion. One useful layer removal chemical is NaOH, which may be at a suitable concentration for facilitating the layer removal step (412). In one embodiment, a cast product is exposed to approximately 5% NaOH solution that has a temperature of from about 104° F. to about 160° F. In this embodiment, the cast product may be exposed for a duration in the range of from about 12 to about 25 minutes, depending on the amount of material to be removed. In other embodiments, the cast product may be exposed to etching solutions having higher concentrations for a duration in the range of from about 2 to about 25 minutes. In one embodiment, between about 25 microns (about 1 mil) and 500 microns (about 12 mil) of an outer surface of a cast product may be non-selectively (e.g., uniformly) removed. In one embodiment, from about 100 microns to about 250 microns of material is removed (50-125 microns per side). In one embodiment, a shape cast product is exposed to a 5% NaOH bath utilizing HOUGHTO ETCH AX-1865 at a temperature of about 145° F. for about 18 minutes, and achieving a removal of about 200 microns (100 microns per side).

For most finishes, the surface preparation step (410) generally includes a post-cast polishing step (414), irrespective of microstructure (layered or homogeneous). This polishing step (414) may facilitate production of a smooth and/or mirrored outer surface of the cast product, and may facilitate later processing steps. This polishing step (414) is generally a mechanical polishing step, which may be accomplished via suitable conventional methods, systems and/or apparatus. After mechanical polishing, the surface may be cleaned with a suitable cleaner (e.g., methyl-ethyl-keytone (MEK)) to facilitate removal of residual polishing compound.

Prior to the polishing (414), a chemical clean-up step can be used to remove any debris on the outer surface of the product. One type of chemical clean-up is exposure of the shape cast product to an non-etchant type chemical (e.g., a 50% nitric acid bath, at room temperature for about 30 seconds).

In some instances, the surface preparation step (410) may include a texturizing step (416), irrespective of microstructure (layered or homogeneous). This texturizing step (416) may produce a tailored and repeated topography on an outer surface of the cast product. In one embodiment, the texturizing step (416) includes producing a substantially uniform topography on all, or nearly all, of the outer surface of the cast product. In another embodiment, the texturizing step (416) includes producing a first texture having a first topography on a first portion of the cast product, and a second texture having a second topography on a second portion of the cast product, where the second topography is different than the first topography (e.g., as viewed via the human eye and/or sensed via the human touch). Thus, cast products may realize a tailored topography. The texturizing step (416) may be accomplished by subjecting the outer surface of a cast product to selective forces, such as blasting. In one embodiment, the outer surface of a cast product may be blasted with a selected material, such as a metal or metal oxide powder (e.g., iron, alumina), beads (e.g., glass), or natural media (e.g., corn husks, walnut shells) to produce a textured outer surface on the cast product. Other suitable texture producing media may be utilized. Due to the texturizing step (416), minor surface defects in cast products due to the casting process, such as heat-checking and/or wash-out, may be hidden, which may facilitate increased product usage rates. In other embodiments, non-directional, high surface area textures, similar to those formed by blasting, may be produced by electrochemical graining. In these instances, approximately 1% weight solution of nitric or hydrochloric acid may be used at a temperature range of from about 70° to about 130° F., and voltage may be applied using an AC power supply from about 10 to about 60 volts for a period of from about 1 to about 30 minutes. In other embodiments, the texturizing step (416) is accomplished during casting, such as via a die having the desired texture pattern. Lasers, embossing and other processes may be used to produce texture.

For most finishes, the surface preparation step (410) generally includes a pre-anodizing clean step (418), irrespective of microstructure (layered or homogeneous). This pre-anodizing clean (418) may facilitate removal of debris, chemicals or other readily removable unwanted constituents from the surface of the cast product prior to anodizing. In some instances, the clean (418) may be accomplished via exposure to suitable chemicals and in an environment and for a time suitable to facilitate removal of the readily removable unwanted constituents via the chemicals. In one embodiment, the cleaning chemical is a non-etchant alkaline style cleaner, such as A31K manufactured by Henkel Surface Technologies, 32100 Stephenson Hwy, Madison Heights, Mich. 48071. In one embodiment, the cast product is exposed to a non-etchant alkaline cleaner at a temperature in the range of from about 140° F. to about 160° F. and for a period of not greater than about 180 seconds. In other embodiments, etching style and/or acidic style cleaners may be used.

B. Oxide Layer Formation

Referring back to FIG. 23, as noted the finishing process usually includes an anodizing step (420), which may facilitate enhanced durability of the cast product and/or facilitate adhesion of later applied materials by producing an oxide layer of tailored thickness and pore size. Anodizing may also result in unacceptable shading (e.g., an unacceptable grayness and/or brightness, as described above) of the cast product if improper aluminum alloys are used. Al—Ni—Mn alloys and Al—Ni alloys, and in some instances some Al—Si alloys, may be anodized and still realize an acceptable shading relative to decorative shape cast products. The produced oxide layers may also be uniform, which may promote color and/or gloss uniformity as described above.

Figure 25:
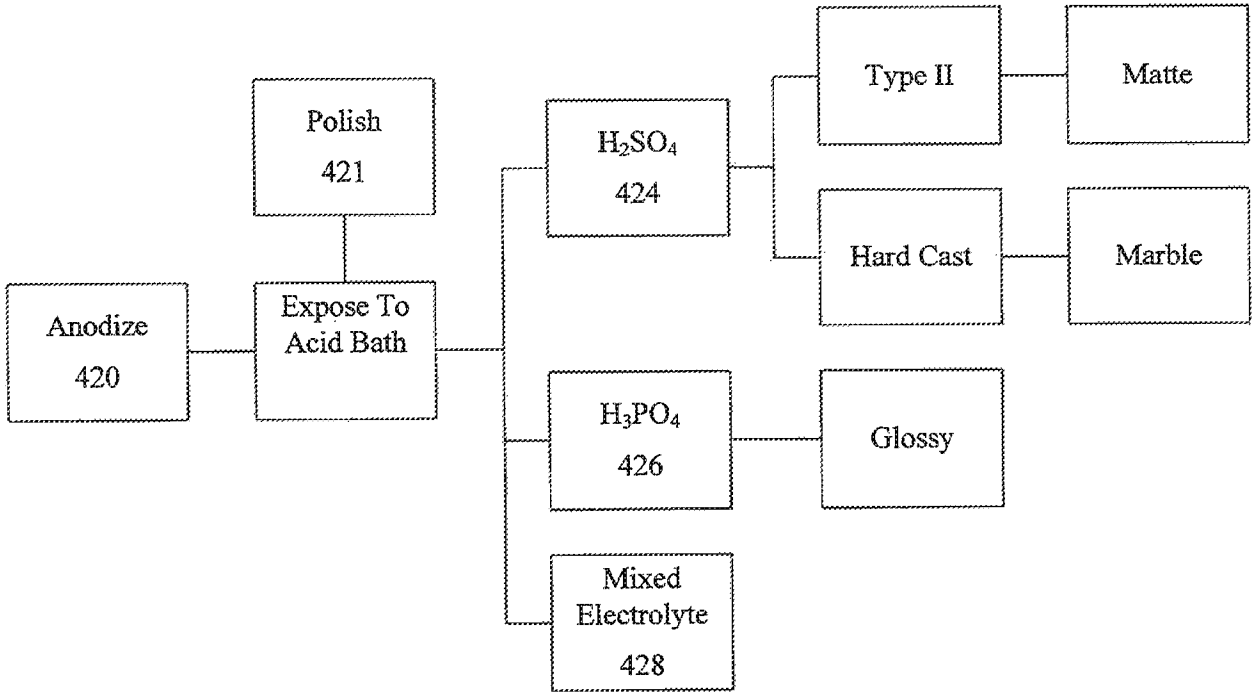
FIG. 25 is a chart illustrating one embodiment of various anodizing processes useful in accordance with the present disclosure.

Referring now to FIG. 25, one embodiment of an anodizing step (420) includes one or more of a pre-polishing step (421) and anodizing in one or more of a sulfuric acid solution (424), a phosphoric acid solution (426), and a mixed electrolyte solution (428).

For some finishes, the anodizing step (410) may include a pre-polishing step (421), which is generally a chemical polish. This polishing step may facilitate brightening of an outer surface of a cast product. In one example, the chemical polish may create a high image clarity surface. In another example, the chemical polish may generate a bright surface (e.g., having a high ISO brightness). In one embodiment, the chemical polish/brightening step is carried out before an anodizing operation. In one embodiment, the chemical polishing is accomplished after surface preparation (410) and via exposure of the cast product to an acidic solution, such a solution of phosphoric acid and nitric acid. In one embodiment, the chemical polishing is accomplished via exposure of the cast product to an acid solution containing about higher amounts of phosphoric acid (e.g., about 85%) and lower amounts of nitric acid (e.g., from about 1.5% to about 2.0%) at elevated temperature (e.g., from about 200° F. to about 240° F.) for a period of less than about 60 seconds. Other variations may be employed. In one embodiment, the chemical polishing solution is DAB80 manufactured by Potash Corporation, 1101 Skokie Blvd., Northbrook, Ill. 60062. Finishes using silicon polymers may also use this polishing step (421), but it is often unnecessary. In other embodiments, a chemical polish/brightening bath may incorporate at least one of phosphoric acid, nitric acid, sulfuric acid, or combinations thereof, among other etchants. The etching process may be controlled by adjusting at least one of the chemical compositions within the chemical polish/brightening bath.

For some finishes, such as those produced via dyeing, the anodizing step (420) may include anodizing via a sulfuric acid solution (424) so as to produce an electrochemically oxidized sulfur containing zone, referred to herein as an "Al—O—S zone", in the cast product. In embodiments where the casting alloy is Al—Ni or Al—Ni—Mn, nickel, and sometimes manganese, would be included in this zone due to its use in the alloys. For shape cast products having a layered microstructure, the Al—O—S zone may be associated with (e.g., at least a part of) a middle portion (e.g., 510 of FIG. 5*a*) of the cast product, which middle portion may be at or near the outer surface of the cast product due to, for example, the surface preparing step (410), described above. In some embodiments, the Al—O—S zone may be associated with the outer layer (500 of FIG. 5*a*) and/or the third portion (e.g., 520 of FIG. 5*a*) of the cast product. Finishes using silicon polymers may be anodized in a sulfuric acid solution (424), but this is generally undesired as sufficient surface adhesion of the resultant coating layer may not be realized. For shape cast products having a homogeneous microstructure, the Al—O—S zone may be associated with the outer surface of the shape cast product.

For some finishes, such as those produced via dyeing, the Al—O—S zone may include pores that facilitate movement of the colorant into the pores of the oxide layer, and/or the Al—O—S zone may have a thickness that enhances the durability of the cast product. The Al—O—S zone generally has a thickness of at least about 2.5 microns (about 0.1 mil). In some embodiments, the Al—O—S zone has a thickness of at least about 3.0 microns, or at least about 3.5 microns, or at least about 4.0 microns. In some embodiments, the Al—O—S zone has a thickness of not greater than about 20 microns, or not greater than about 10 microns, or not greater than about 7 microns, or not greater than about 6.5 microns, or not greater than about 6 microns. An Al—O—S zone with an oxide thickness in the range of from about 2.5 microns to about 6.5 microns may be useful in producing intended viewing surfaces that are both durable and have color uniformity. In one embodiment, the anodizing step may comprise Type II anodizing, such as via exposure of the cast product to an approximately 20% sulfuric acid bath for from about 5 minutes to about 30 minutes, at a temperature of from about 65° F. to about 75° F., and with a current density of from about 8 to about 24 ASF (amperes per square foot). Other Type II anodizing conditions may be used. The pore of these types of oxide layers generally have a columnar geometry and a size of about 10-20 nanometers.

For other finishes, such as those intended to have a marbled finish, the Al—O—S zone of the cast product may be produced via Type III anodizing processes so as to achieve a hard coat (i.e., higher durability). In one embodiment, the Type III anodizing includes exposure of the cast product to an approximately 20% sulfuric acid solution for about 15 to 30 minutes, at a temperature of from about 40° F. to about 55° F., and with a current density of from about 30 ASF to about 40 ASF (amperes per square foot). In this embodiment, the Al—O—S zone generally has a thickness of at least about 5 microns (about 0.2 mil). In some embodiments, the Al—O—S zone has a thickness of at least about 10 microns, or at least about 12.5 microns, or at least about 15 microns, or at least about 17.5 microns, or at least about 20 microns. In some embodiments, the Al—O—S zone has a thickness of not greater than about 35 microns, or not greater than about 30 microns, or not greater than about 20 microns. The pore of these types of oxide layers generally have a size of about 10 to 20 nanometers.

For some finishes, such as those employing silicon polymers, the anodizing step (420) may include anodizing via a phosphoric acid solution (426) so as to produce an electrochemically oxidized phosphorous-containing zone, referred to herein as an "Al—O—P zone", in the cast product. In embodiments where the casting alloy is Al—Ni or Al—Ni—Mn, nickel, and sometimes manganese, would be included in this zone due to its use in the alloys. In this embodiment, anodizing via phosphoric acid (426) may be used to promote adhesion of materials that are later deposited on the surface of the cast product. In this regard, the phosphoric anodizing step (426) may produce a relatively small Al—O—P zone (e.g., several angstroms in thickness), which may serve to promote adhesion. This Al—O—P zone may also facilitate adhesion of the later applied color layer due to the irregular-shaped pores of the oxide layer.

For shape cast products having a layered microstructure, the Al—O—P zone may be associated with (e.g., at least a part of) a middle portion (e.g., 510 of FIG. 5*a*) of the cast product, which middle portion may be at or near the outer surface of the cast product due to, for example, the surface preparing step (410), described above. In some embodiments, the Al—O—P zone may be associated with the outer layer (500 of FIG. 5*a*) and/or the third portion (e.g., 520 of FIG. 5*a*) of the cast product. For shape cast products having a homogeneous microstructure, the Al—O—P zone may be associated with the outer surface of the shape cast product. In one embodiment, a cast product is exposed to a bath of from about 10% to about 20% phosphoric acid for not greater than about 30 seconds (e.g., from about 5 to about 15 seconds), at a temperature of from about 70° F. to about 100° F., and at from about 10 volts to about 20 volts. In one embodiment, the bath has a phosphoric concentration of at least about 16%. In other embodiments, the bath has a phosphoric concentration of at least about 17%, or at least about 18%, or at least about 19%, or at least about 20%. In these embodiments, the Al—O—P zone generally has a thickness of not greater than about 1000 angstroms, but at least about 5 angstroms. In some embodiments, the Al—O—P zone has a thickness of not greater than at least about 500 angstroms, or not greater than about 450 angstroms, or not greater than about 400 angstroms, or not greater than about 300 angstroms. In some embodiments, the Al—O—P zone has a thickness of at least about 100 angstroms, or at least about 150 angstroms, or at least about 200 angstroms.

In some embodiments, the anodizing step (420) may include anodizing in a mixed electrolyte (428), such as via the mixed electrolyte methods disclosed in commonly-owned U.S. patent application Ser. No. 12/197,097, filed Aug. 22, 2008, and entitled "Corrosion Resistant Aluminum Alloy Substrates and Methods of Producing the Same", which published as U.S. Patent Application Publication No. 2009/0061218 on Mar. 5, 2009, now U.S. Pat. No. 8,309,237, and which is incorporated herein by reference in its entirety.

C. Coloring of the Shape Cast Product

Figure 26:
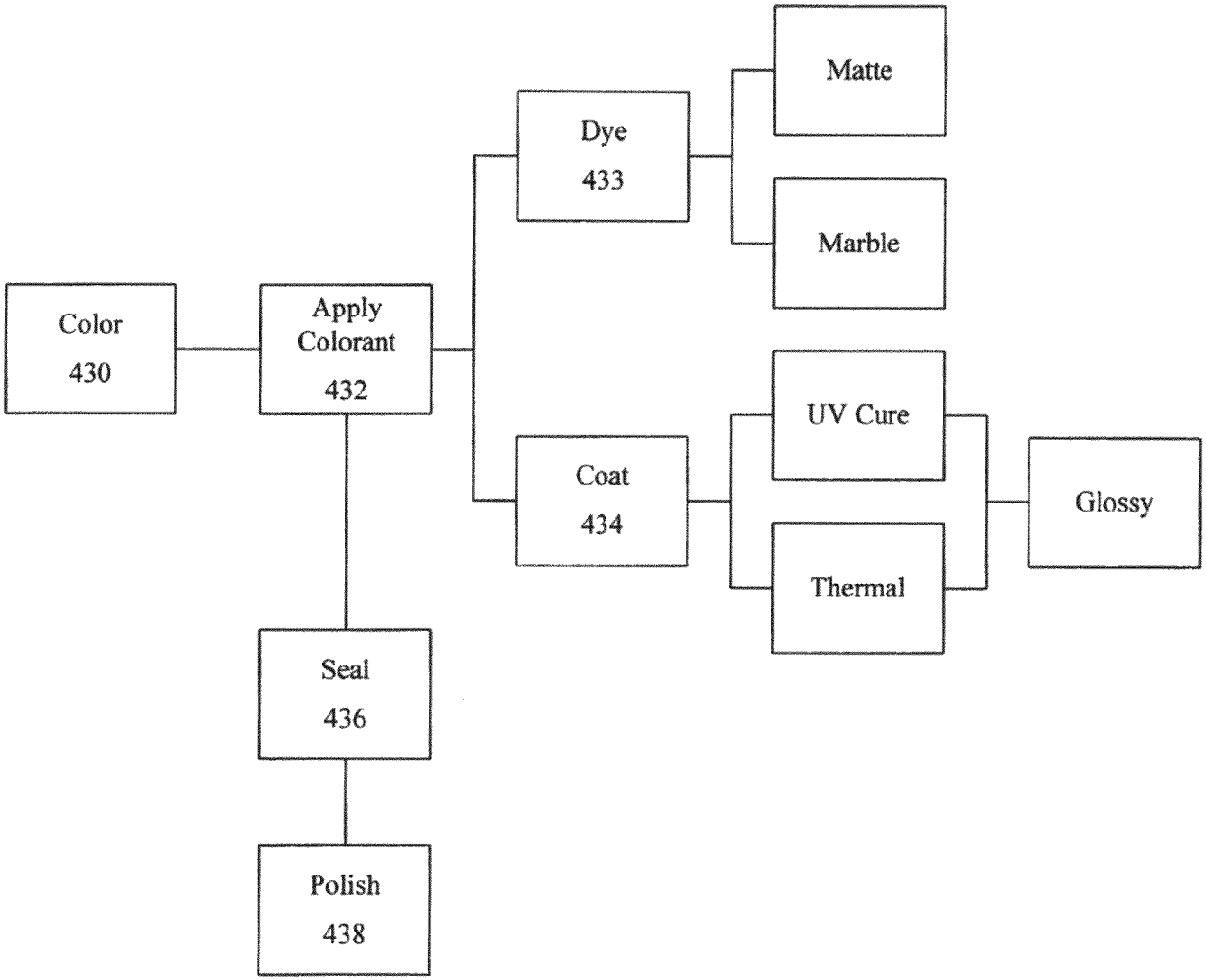
FIG. 26 is a chart illustrating one embodiment of various coloring processes useful in accordance with the present disclosure.

Referring back to FIG. 23, as noted the finishing process may include a coloring step (430), to color and/or finalize the cast product into the decorative shape cast product. Referring now to FIG. 26, one embodiment of a coloring step (430) includes one or more of a applying a colorant to the cast product (432), sealing the cast product (436), and polishing the cast product (438), after which the cast product is generally in final form and may be ready for use by a consumer.

In one embodiment, the applying colorant step (432) includes dyeing (433) the cast products (e.g., after the anodizing step). The use of a dyeing step (433) to color a product may be useful in conjunction with an anodizing step utilizing sulfuric acid (424). The dyeing step (433) may be accomplished via any suitable dyeing processes, such as immersion in a bath containing the appropriate dye color. Suitable dyes for this purpose include those produced by Clariant Corporation of Charlotte, N.C., U.S.A., or Okuno Chemical Industries Co., Ltd., of Osaka, Japan, among others. In one embodiment, the cast product is immersed in a bath containing a dye for a suitable duration (e.g., from about 1 minutes to about 15 minutes). In some embodiments, elevated temperatures (from about 120 to about 140° F.) may accelerate the immersion process and/or improve the amount of dye that is absorbed into the pores.

In another embodiment, the applying colorant step (432) includes applying a coating (434) to the cast products (e.g., after the anodizing step) to provide a colored or clear coated outer coating on the surface of the cast product. The use of a coating step (434) may be useful in conjunction with an anodizing step utilizing phosphoric acid (426) (e.g., for a silicon polymer coated products). The use of a coating step (434) to color a product may be useful in conjunction with an anodizing step utilizing a mixed electrolyte (428). The coating step (434) may be accomplished via any suitable coating processes, such as spraying, brushing and the like. Some examples of suitable types of coating that may be used for the coating step (434) include polymeric coatings and ceramic coatings. These types of could be further classified as organic, inorganic or hybrid (organic/inorganic composite) coatings. Examples of organic coatings that may be used include acrylates, epoxies, polyurethanes, polyesters, vinyl, urethane acrylates, and the like. Examples of inorganic coatings that may be used include titanium dioxide, fused silica, silanes, silicate glass, and the like. Examples of hybrid coating that may be used include fluoropolymers, organically modified polysiloxanes, organically modified polysilazanes and the like.

In one embodiment, the coating step (434) includes the use of a UV curable coatings, such as those available from Strathmore Products, Inc., Kalcor Coatings, and Valspar, among others. In one embodiment, the coating is in the form of a colloid containing a silicon polymer, such as a siloxane or a silazane, which have a silicon backbone (e.g., —Si—O—Si—or —Si—N—Si—). In other embodiments, the coating step (434) includes the use of a thermally cured coatings, such as those available from PPG and Valspar, among others. These coatings may be of any color (pigment) and, in some instances, may be a clear coat.

In some embodiments, the coating step (434) may produce an outer coating on the surface of the cast product. This outer coating may have a thickness in the range of 2 or 2.5 microns (about 0.1 mil) to about 100 microns. The thickness of the coating is application dependent, but the coating should be thick enough to facilitate durability of the product, but not so thick as to decrease the metal look and/or feel of the product, and/or not so thick as to increase the potential for cracking of the coating.

For some applications, the coating will have a thickness in the range of 3 microns to 8 microns. In one embodiment, the outer coating has a thickness of at least about 5 microns. For other applications, the outer coating may have a thickness of at least about 10 microns, or at least about 15 microns, or at least about 20 microns, or at least about 25 microns. In one embodiment, the coating step (434) is accomplished within at least about 48 hours of any anodizing step (420) to facilitate sufficient adhesion of the coatings to the outer surface of the cast product.

In some embodiments, it is useful for the decorative shape cast product to look and feel like metal. To facilitate the look of a metal product, the oxide layer may be of a tailored thickness. For example, with respect to dyed products, the oxide layer may be sufficiently thick so that it is durable, but also sufficiently thin such that light may propagate through the oxide layer and be absorbed and/or reflected by the underlying metal base such that the final decorative shape cast product realizes a metallic look (e.g., non-plastic). For dyed products, this oxide thickness is generally in the range of 2.0 to 25 microns, as described above but is often less than 7 microns (e.g., in the range of 2.5 to 6.5 microns). For coated products, the oxide layer is generally sufficiently thin (not greater than a 1000 angstroms) such that a metallic look is generally facilitated. With respect to a metallic feel, the decorative shape cast products generally have a thermal conductivity that approaches that of aluminum metal (e.g., about 250 W/mK). This differentiates such products over purely plastic device covers, which generally have a low thermal conductivity (generally less than about 1 W/mK), thus facilitating a "cooler" feel in at least some of the decorative shape cast products described herein.

The utilized coating should be adherent to the surface of the shape cast product. In one embodiment, a shape cast product having a coating passes a cross-hatching test in accordance with ASTM D3359-09. In one embodiment, a shape cast product having a coating realizes at least a 95% adhesion when tested in accordance with ASTM D3359-09. In other embodiments, a shape cast product having a coating realizes at least a 96% adhesion, or at least a 97% adhesion, or at least a 98% adhesion, or at least a 99% adhesion, or at least a 99.5% adhesion, or more, when tested in accordance with ASTM D3359-09.

The coloring step (430) may include a sealing step (436) to facilitate sealing of the surface of the cast product. The sealing step (436) is generally utilized in conjunction with a dyeing step (433) and may serve to seal the pores of the anodized and dyed cast product. Suitable sealing agents include aqueous salt solutions at elevated temperature (e.g., boiling water) or nickel acetate.

The coloring step (430) may include a polishing step (438). This polishing step (438) may be any mechanical-type abrasion. This polishing step (438) may be used to bring out the final color, luster and/or shine of the decorative shape cast product.

d. Final Product Qualities

After finishing (130), the decorative shape cast products may realize a unique combination of properties, including visual attractiveness, strength, toughness, corrosion resistance, abrasion resistance, UV resistance, chemical resistance, and hardness, among others.

With respect to visual attractiveness, the decorative shape cast products may be substantially free of surface defects, as described above, except for marbled products where the surface defects are found to be visually attractive due to the marbled look facilitated by the tailored distribution of eutectic microstructure and alpha aluminum phase. The decorative shape cast products may also achieve good color uniformity, as described above.

With respect to strength and toughness, the decorative shape cast products may realize any of the tensile strength and/or impact strength properties described above. In some instances, the strength and/or toughness may be increased due to the presence of a coating layer and/or precipitation hardening that may occur due to heating of the shape cast product during application of the colorant.

With respect to corrosion resistance, the decorative shape cast products may pass ASTM B117, which exposes the decorative shape cast products to a salt spray climate at an elevated temperature. The test may include placing test specimens in an enclosed chamber and with exposure to a continuous indirect spray of neutral (pH 6.5 to 7.2) 5% salt water solution in a chamber having a temperature of at least about 35° C. This climate is maintained under constant steady state conditions. The test specimens are usually are placed at a 15-30 degree angle from vertical, but automotive components may be tested in the "in-car" position. This orientation allows the condensation to run down the specimens and reduces condensation pooling. Overcrowding of samples within the cabinet should be avoided. An important aspect of the test is the utilization of a free-falling mist, which uniformly settles on the test samples. Samples should be placed in the chamber so that condensation does not drip from one to another. In one embodiment, a decorative shape cast product passes ASTM B117 when it contains no pits on the intended viewing surface after at least 2 hours of exposure. In other embodiments, the decorative shape cast product passes ASTM B117 when it contains no pits on the intended viewing surface after at least about 4 hours of exposure, or after at least about 8 hours of exposure, or after at least about 12 hours of exposure, or after at least about 16 hours of exposure, or after at least about 20 hours of exposure, or after at least about 24 hours of exposure, or after at least about 36 hours of exposure, or after at least about 48 hours of exposure, or more.

With respect to abrasion resistance, the decorative shape cast product may be capable of passing the Taber abrasion test in accordance with ASTM D4060-07. This test may be useful for products produced via a coating deposition process, where the coating layer is associated with the intended viewing surface of the shape cast product. In one embodiment, the shape cast product realizes an abrasion resistance of at least about 25 cycles. In one embodiment, the test is a rotary abrasion test. In another embodiment, the test is a linear abrasion test.

With respect to UV resistance, the intended view surface of the decorative shape cast product may realize a Delta-E of less than about 0.7 after 24 hours of exposure to a QUV-A bulb having a nominal wavelength of 340 nm, when tested in accordance with ISO 11507. The Delta-E measurement may be completed by Color Touch PC, by TECHNIDYNE. In other embodiments, the intended view surface of the decorative shape cast product may realize a Delta-E of less than about 0.7 after 48 hours of exposure, or after 96 hours, or after 1 week, or more. In some embodiments, the decorative shape cast product also passes the adhesion test, described above, after such UV exposure.

With respect to chemical resistance, the decorative shape cast product may show no material visual change on the intended viewing surface following exposure to artificial sweat when tested in accordance with EN 1811 to nickel extraction. To evaluate the visual change, a reference, non-exposed sample may be used. Several viewing angles may be utilized to evaluate whether the intended viewing surface of the decorative shape cast product manifests a material visual change.

With respect to hardness, the decorative shape cast product may achieve a rating of at least about 2H as measured in accordance with the pencil hardness test of ASTM D3363-09. In other embodiments, the decorative shape cast product may achieve a rating of at least about 3H, or at least about 4H, or at least about 5H, or at least about 6H, or at least about 7H, or at least about 8H, or at least about 9H, as measured in accordance with the pencil hardness test of ASTM D3363-09.

Any of the above properties may be achieved and in any combination.

EXAMPLES

Example 1

Vacuum-Die Casting (VDC) of Shape Cast Products Having a Nominal Wall Thickness of about 2-4.5 Mm for Evaluation of the Castability of the Al—Ni—Mn Alloys In this example, two alloys are evaluated, Al—Ni—Mn and Al—Si—Mg, using a vacuum-die casting technique. The Al—Si—Mg alloy is included for comparison purposes. Various compositions of the Al—Ni—Mn alloy are provided in Table 4, while the composition of the Al—Si—Mg alloys are provided in Table 4.

TABLE 4

COMPOSITIONS OF THE AL—NI—MN ALLOYS USING VDC.

| Measurement | Si | Fe | Mn | Ni | Ti | B |
|---|---|---|---|---|---|---|
| 1 | 0.11 | 0.114 | 1.788 | 4.06 | 0.058 | 0.005 |
| 2 | 0.11 | 0.114 | 1.79 | 4.04 | 0.054 | 0.004 |
| 3 | 0.12 | 0.114 | 1.8 | 4.1 | 0.049 | 0.002 |
| 4 | 0.12 | 0.125 | 1.787 | 4.06 | 0.005 | 0.001 |
| Average | 0.115 | 0.117 | 1.791 | 4.065 | 0.053 | 0.003 |

| Measurement | Si | Fe | Mn | Mg | Ni | Ti | B | Sr |
|---|---|---|---|---|---|---|---|---|
| 1 | 10.900 | 0.151 | 0.751 | 0.164 | 0.5800 | 0.0628 | 0.0008 | 0.0174 |
| 2 | 11.040 | 0.150 | 0.745 | 0.162 | 0.5780 | 0.0623 | 0.0007 | 0.0173 |
| 3 | 11.71 | 0.151 | 0.699 | 0.170 | 0.4290 | 0.0643 | 0.0014 | 0.0178 |
| 4 | 11.980 | 0.151 | 0.664 | 0.173 | 0.3140 | 0.0631 | 0.0008 | 0.0180 |
| Average | 11.408 | 0.151 | 0.715 | 0.167 | 0.475 | 0.063 | 0.001 | 0.018 |

Figure 27:
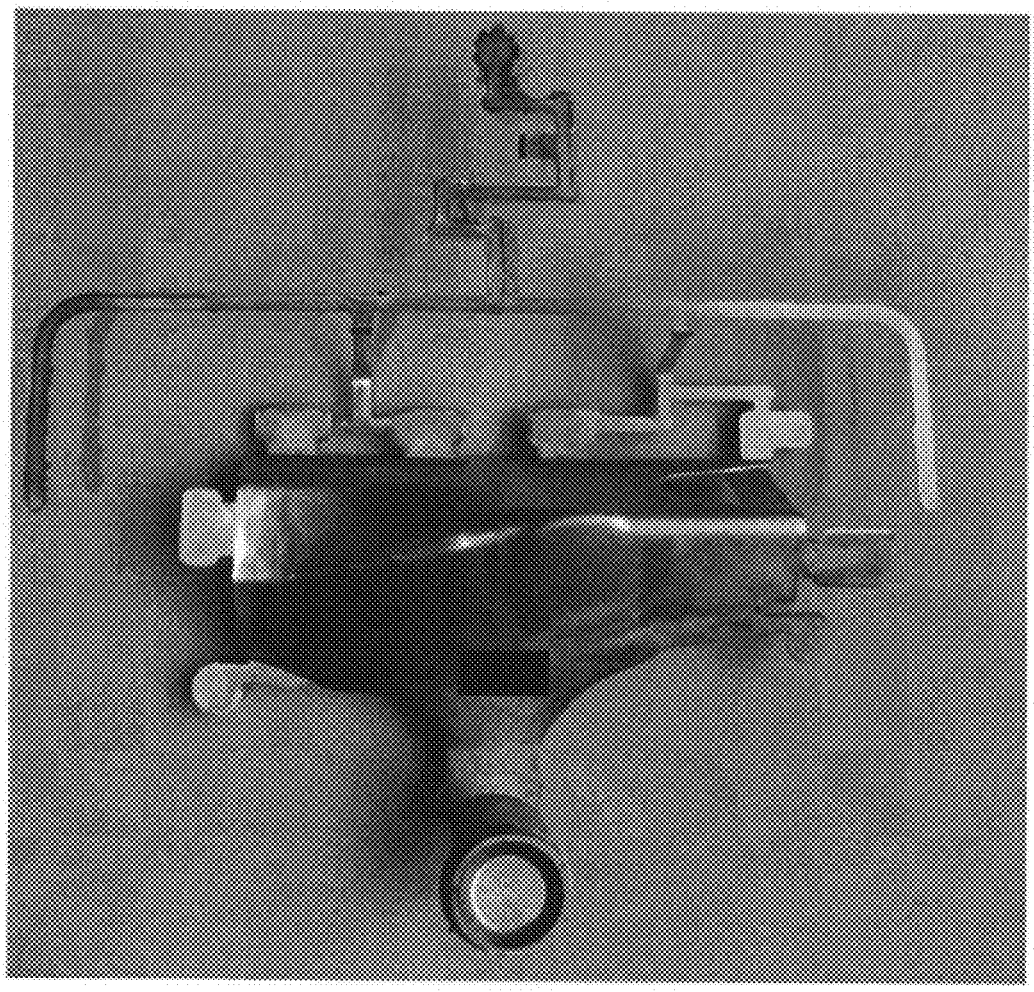
FIG. 27 is a photograph of shape cast product produced from an Al—Ni—Mn alloy.

FIG. 27 is a casting of an Al—Ni—Mn alloy. Although only the Al—Ni—Mn alloy is shown, both the Al—Ni—Mn and the Al—Si—Mg alloys exhibit adequate castability. The castings are subsequently cleaned to remove residual lubricant by glass bead blasting.

Figure 28:
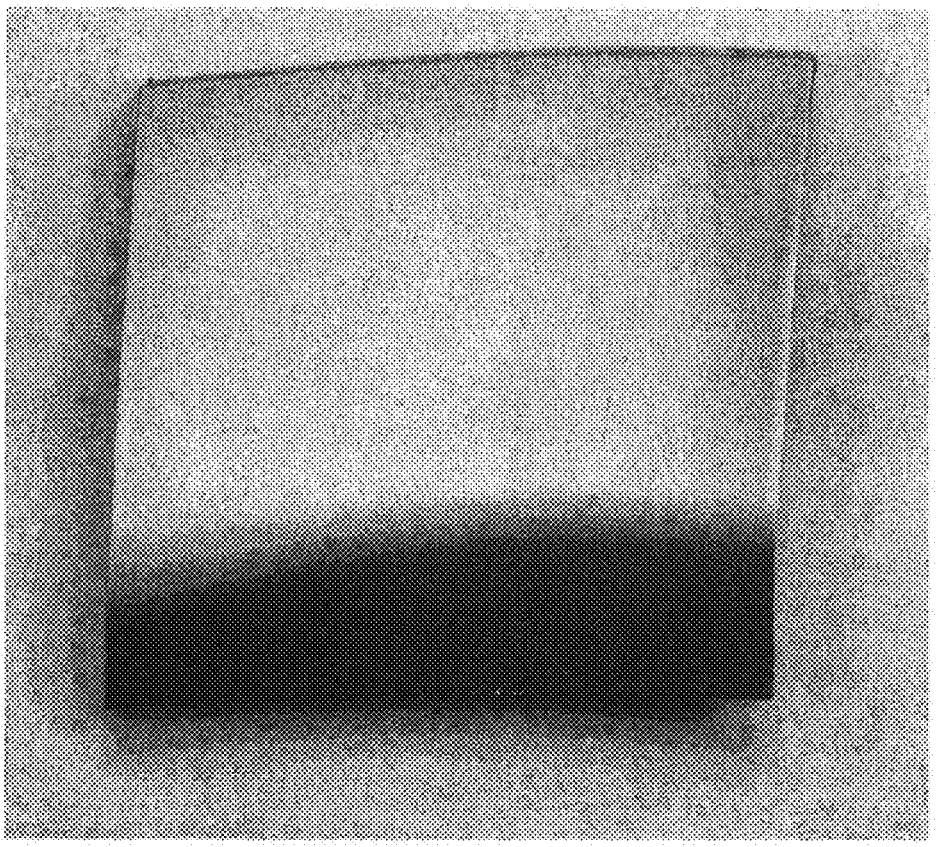
FIG. 28 is a photograph of a shape cast product produced from an Al—Ni—Mn alloy after blasting with glass beads.

FIG. 28 is casting appearance of an Al—Ni—Mn alloy after glass bead blasting. The Al—Ni—Mn casting part exhibits a higher surface uniformity than that of the Al—Si—Mg alloy (not shown). Furthermore, the Al—Ni—Mn alloy also exhibits higher impact energy, and in the as-cast condition (F temper), than the Al—Si—Mg alloy as indicated by the results of the Charpy impact energy test in Table 5, below.

TABLE 5

CHARPY IMPACT ENERGY OF THE ALLOYS (ASTM E23-07, UN-NOTCHED SPECIMEN).

| Alloy | Energy (J) |
|---|---|
| Al—Ni—Mn alloy, F temper, Measurement 1 | 6.8 |
| Al—Ni—Mn alloy, F temper, Measurement 2 | 8.1 |
| Al—Ni—Mn alloy, F temper, Measurement 3 | 5.4 |
| Average-Al—Ni—Mn alloy | 6.8 |
| Al—Si—Mg alloy, F temper, Measurement 1 | 4.1 |
| Al—Si—Mg alloy, F temper, Measurement 2 | 2.7 |
| Al—Si—Mg alloy, F temper, Measurement 3 | 2.7 |
| Average-Al—Si—Mg alloy | 3.2 |

Figure 29:
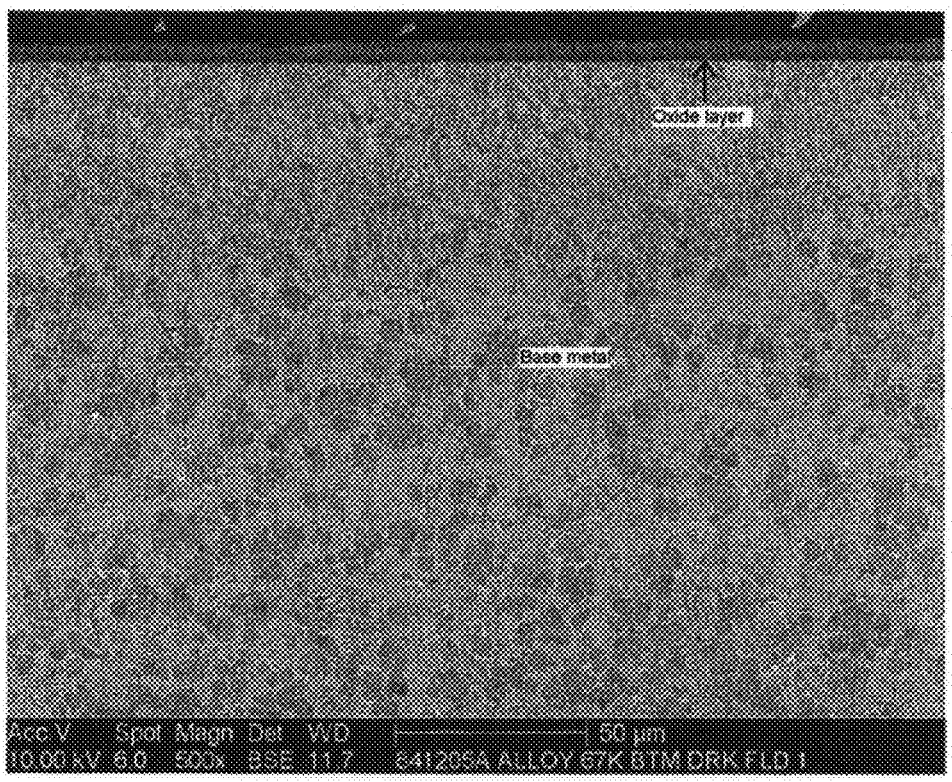
FIG. 29 is a micrograph of an anodized shape cast product produced from an Al—Ni—Mn alloy and having a uniform oxide layer.

The castings are also evaluated for their anodizability. In this instance, the surface of the Al—Si—Mg casting turns black after anodizing while the Al—Ni—Mn alloy casting exhibits a lighter color (not illustrated). FIG. 29 is a micrograph illustrating the microstructure of a shape cast product produced from an Al—Ni—Mn alloy after anodizing. As shown, the thickness of the oxide layer is relatively uniform throughout the anodized Al—Ni—Mn alloy. This indicates that oxide growth is generally not interrupted (e.g., by the alpha aluminum or intermetallic phases).

Figure 30A:
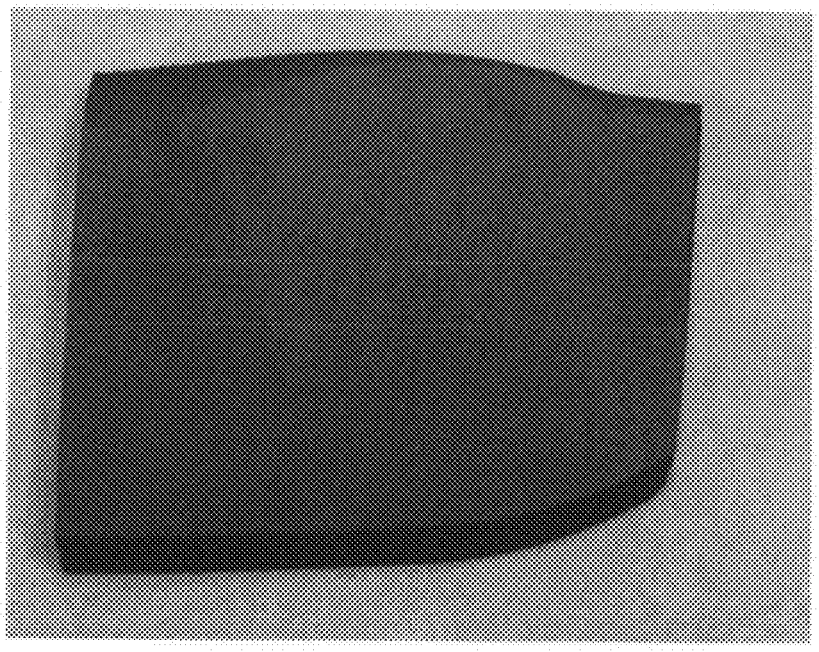
FIG. 30A is photograph of a shape cast product produced from an Al—Ni—Mn alloy after anodizing and dyeing.
Figure 30B:
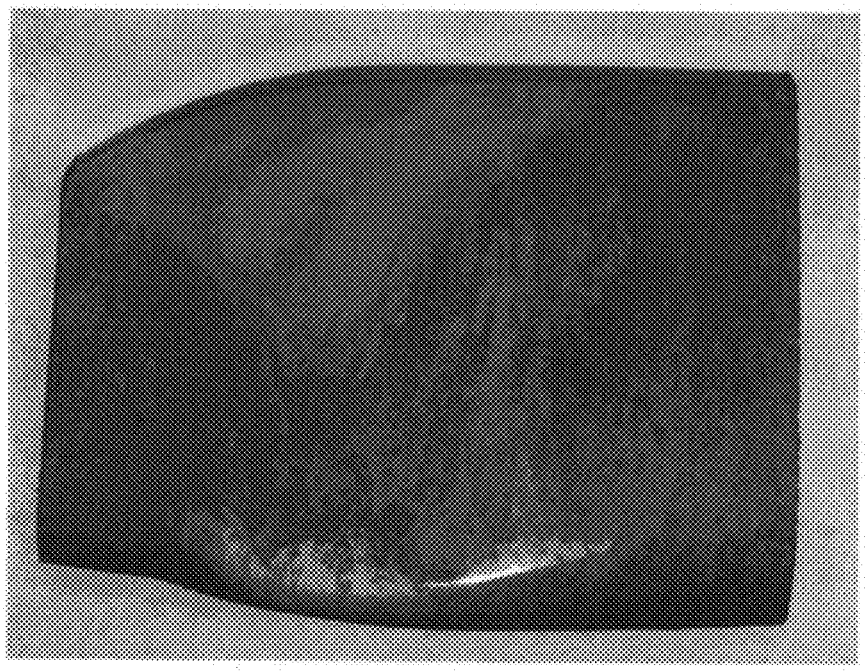
FIG. 30B is photograph of a shape cast product produced from an Al—Ni—Mn alloy after anodizing and dyeing.

Some anodized Al—Ni—Mn shape cast products are subjected to various dyes. The product of FIG. 30A has a uniform appearance with dark color anodizing. The product of FIG. 30B has a marbled appearance with light color anodizing. For non-marbled products, the flow lines may be reduced, and in some instances eliminated, via adjustment to alloy composition, casting parameters and/or via layer removal, among other adjustments, so as to provide a shape cast product having an intended view surface that is substantially free of visually apparent surface defects.

Figure 31A:
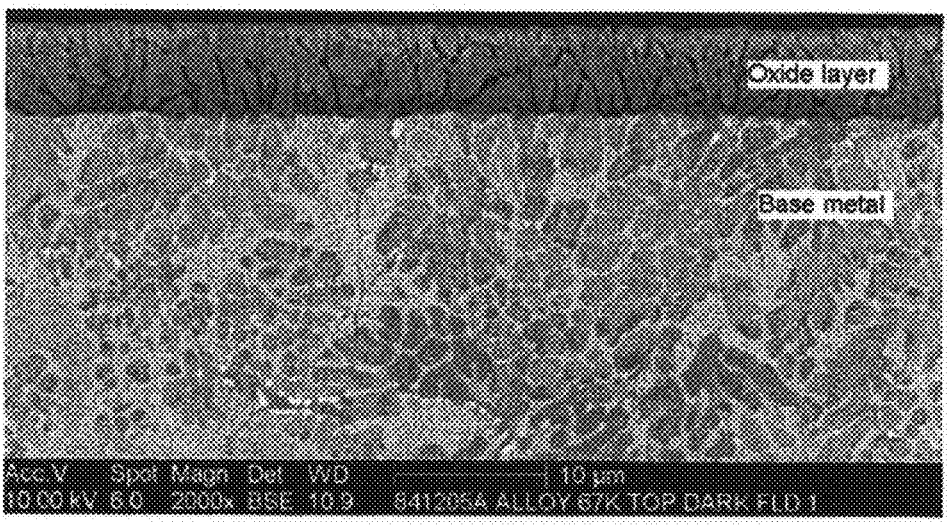
FIG. 31A is a micrograph of a shape cast product produced from an Al—Ni—Mn alloy after anodizing and polishing and having a uniform oxide layer.
Figure 31B:
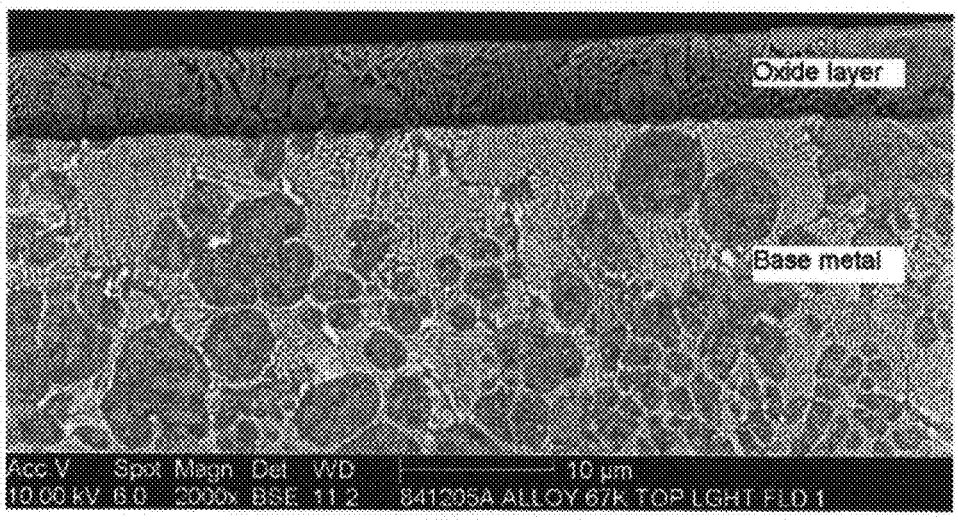
FIG. 31B is a micrograph of a shape cast product produced from an Al—Ni—Mn alloy after anodizing and polishing and having a uniform oxide layer.

FIGS. 31A and 31B are micrographs illustrating the microstructure of polished and anodized Al—Ni—Mn shape cast products having dark (FIG. 31A) and bright (FIG. 31B) appearances on the surface. The dark areas (FIG. 31A) have more alpha aluminum phase (dark regions) near the oxide surface, whereas the bright areas (FIG. 31B) have more eutectic microstructure (light regions), or are richer in eutectic phases, near the oxide surface in addition to having some aluminum phase. This indicates that alloy composition and/or casting parameters, among others, may be adjusted and tailored to produce a shape cast product having a tailored microstructure, depending on product finishing requirements.

Example 2

Lab-Scale Directional Solidification (DS) Casting to Evaluate the Eutectic Microstructure in the Al—Ni—Mn Alloy System In this example, various bookmolds are generated using directional solidification (DS) casting to produce various Al—Ni—Mn alloy of varying Ni content. The compositions of the Al—Ni—Mn alloys are given in Table 6, below

TABLE 6

COMPOSITIONS OF THE AL—NI—MN ALLOYS PRODUCED FROM DIRECTIONAL SOLIDIFICATION.

| Alloy | Si | Fe | Mn | Ni | Ti | B |
|---|---|---|---|---|---|---|
| 1 | 0.051 | 0.048 | 2.27 | 5.35 | 0.055 | 0.015 |
| 2 | 0.052 | 0.045 | 2.1 | 5.89 | 0.056 | 0.015 |
| 3 | 0.053 | 0.037 | 2.06 | 6.2 | 0.058 | 0.0144 |
| 4 | 0.053 | 0.034 | 2.01 | 6.84 | 0.054 | 0.013 |
| 5 | 0.054 | 0.035 | 1.96 | 7.29 | 0.052 | 0.0122 |

Figure 32:
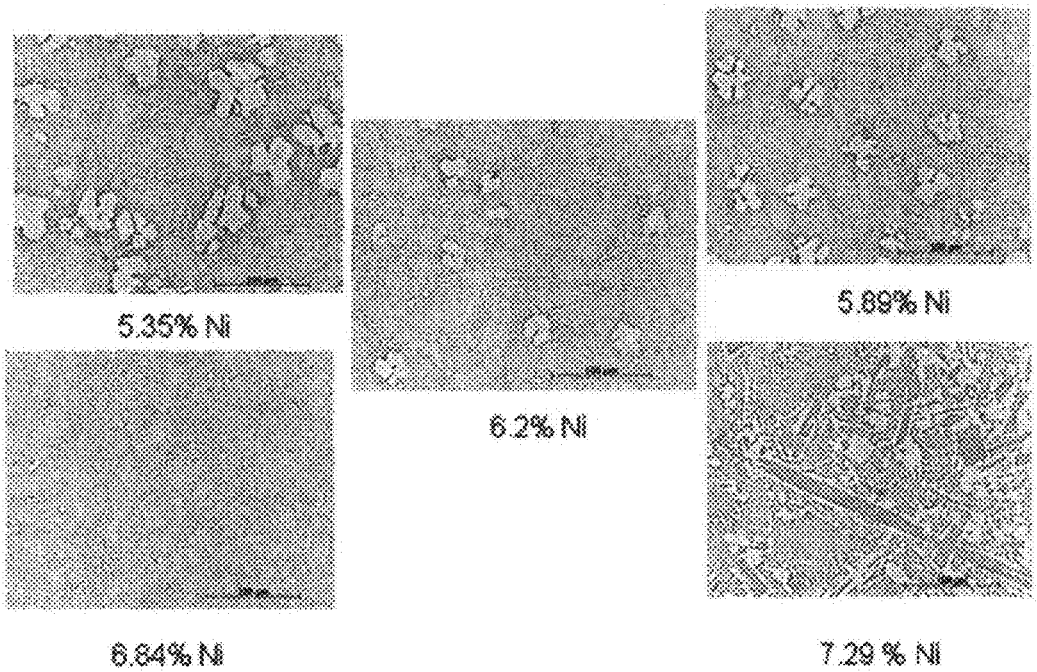
FIG. 32 illustrates various micrographs of shape cast products produced from various Al—Ni—Mn alloys.

The alloys are cast at a solidification rate of about 1° C. per second. As illustrated in FIG. 32, the amount of eutectic microstructure increases with Ni content, up to about 6.84 wt. % Ni (Alloy 4), after which the amount of eutectic microstructure decreases (Alloy 5).

Example 3

Evaluation of Conventional Die Casting (DC) of Al—Ni—Mn Alloys

Figure 33:
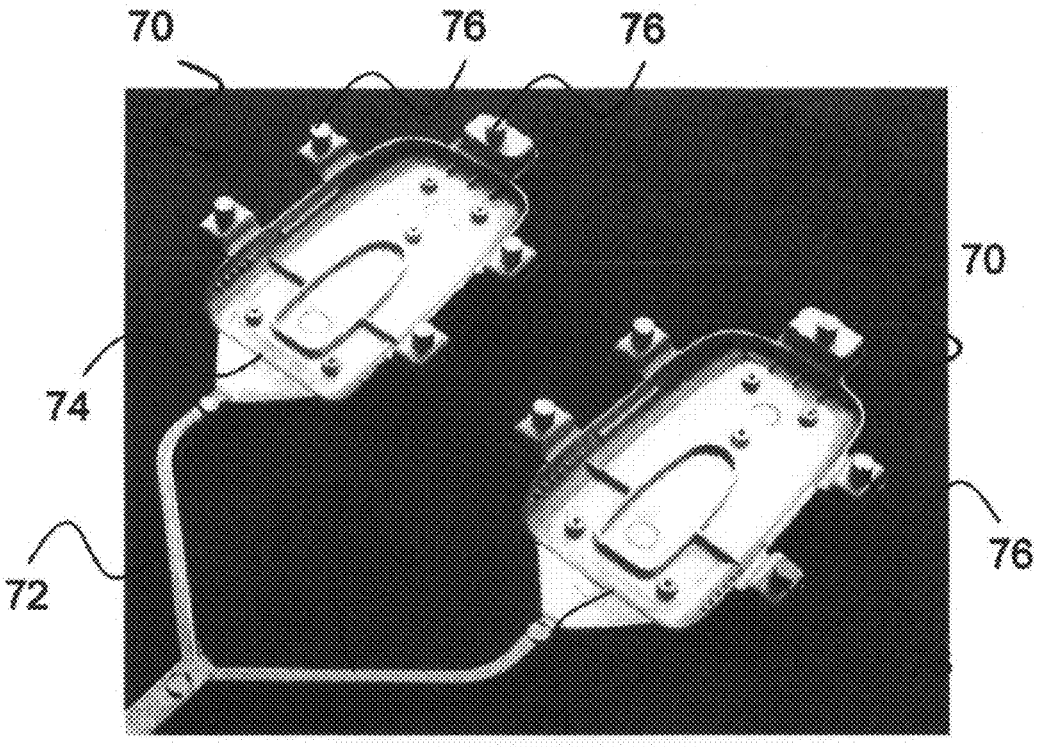
FIG. 33 is a photograph of two thin walled shape cast mobile electronic device covers produced from an Al—Ni—Mn alloy in accordance with the present disclosure.

In this example, traditional die casting (DC) techniques are employed for die casting a cell phone housing using an Al—Ni—Mn alloy. Examples of two shape cast cell phone housings are illustrated in FIG. 33. The cell phone housing 70 has a runner 72, gate 74 and overflow 76. In this instance, the cell phone housing 70 has a wall thickness of about 0.7 mm. The compositions of the Al—Ni—Mn casting alloys used to produce the cell phone housings are given in Table 7, below.

TABLE 7

COMPOSITIONS OF THE AL—NI—MN ALLOYS USED TO PRODUCED CELL PHONE HOUSINGS

| Casting # | Si | Fe | Mn | Ni | Ti | B |
|---|---|---|---|---|---|---|
| 66 | 0.085 | 0.028 | 1.82 | 6.46 | 0.024 | 0.0008 |
| 216 | 0.093 | 0.01 | 1.64 | 6.34 | 0.023 | 0.0004 |
| 355 | 0.092 | 0.047 | 2.04 | 6.55 | 0.026 | 0.001 |
| 524 | 0.09 | 0.022 | 1.7 | 6.31 | 0.021 | 0.0006 |
| 668 | 0.09 | 0.068 | 2.15 | 7.04 | 0.027 | 0.0016 |

Figure 34:
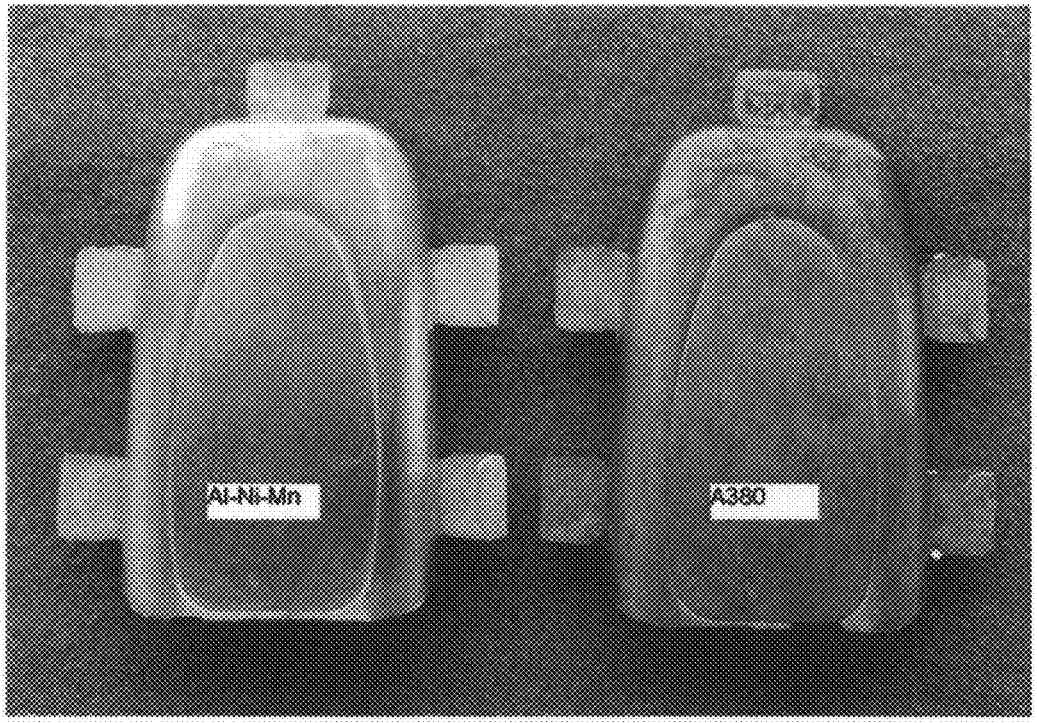
FIG. 34 is a photograph illustrating two thin walled shape cast mobile electronic device covers, one produced from an Al—Ni—Mn alloy and one from a conventional A380 alloy.

In these examples, the Ni content is targeted at about 6.3 wt. %, and then increased to evaluate the effect of increasing Ni. For comparison purposes, a cell phone housing 70 using an Al—Si—Mg alloy, A380, is also cast. FIG. 34 illustrates cell phone housings produced from an Al—Ni—Mn and an A380 alloys. The Al—Ni—Mn alloy exhibits good castability with less tendency to form cold shuts and pits than the A380 counterpart under same or similar casting parameters.

Tensile properties of the cell phone housing castings are shown in Table 8. From the results shown in the table, the Al—Ni—Mn alloy exhibits, on average, higher ultimate tensile strength (UTS) and higher elongation (%) in the as-cast condition (F temper) versus the Al—Si—Mg (A380) alloy, but lower tensile yield strength (TYS).

TABLE 8

TENSILE PROPERTIES OF THE AL—NI—MN AND AL—SI—MG ALLOYS USING DC.

| Specimen | TYS (MPa) | UTS (MPa) | E (%) |
|---|---|---|---|
| Al—Ni—Mn (F-Temper) (6.55 wt. % Ni)-Measurement 1 | 221 | 274 | 12 |
| Al—Ni—Mn (F-Temper) (6.55 wt. % Ni)-Measurement 2 | 191 | 294 | 6 |
| Al—Ni—Mn (F-Temper) (6.55 wt. % Ni)-Measurement 3 | 198 | 295 | 4 |
| Al—Ni—Mn (F-Temper) (6.55 wt. % Ni)-Average | 203.3 | 287.7 | 7.3 |
| Al—Ni—Mn (F-Temper) (7.04 wt. % Ni)-Measurement 1 | 220 | 317 | 4 |
| Al—Ni—Mn (F-Temper) (7.04 wt. % Ni)-Measurement 2 | 210 | 328 | 8 |
| Al—Ni—Mn (F-Temper) (7.04 wt. % Ni)-Measurement 3 | 201 | 316 | 2 |
| Al—Ni—Mn (F-Temper) (7.04 wt. % Ni)-Average | 210.3 | 320.3 | 4.7 |
| Al—Si—Mg (A380) (F-Temper)-Measurement 1 | 246 | 274 | 2 |
| Al—Si—Mg (A380) (F-Temper)-Measurement 2 | 224 | 284 | 0 |
| Al—Si—Mg (A380) (F-Temper)-Average | 235.0 | 279.0 | 1.0 |

Additionally, the Al—Ni—Mn castings also exhibited enhanced surface quality after anodizing (e.g., due to the formation of a uniform oxide layer), which could not be achieved with the A380 alloy casting.

Example 4

Evaluation of Conventional Die Casting (DC) of Al—Ni—Mn Alloys Having a Hypereutectic Composition In this example, traditional die casting (DC) techniques are employed for die casting various cell phone housings and at various hypereutectic alloy compositions to evaluate the effect of composition and cooling rate relative to surface defects and color. The compositions of the tested Al—Ni—Mn alloys are given in Table 9, below.

TABLE 9

COMPOSITIONS OF TEST AL—NI—MN ALLOYS

| Casting # | Mn | Ni | Ti | B |
|---|---|---|---|---|
| 56 | 1.7 | 7 | 0.02 | 0.01 |
| 199 | 1.9 | 6.9 | 0.03 | 0.01 |
| 336 | 1.9 | 6.6 | 0.02 | 0.01 |

Figure 35:
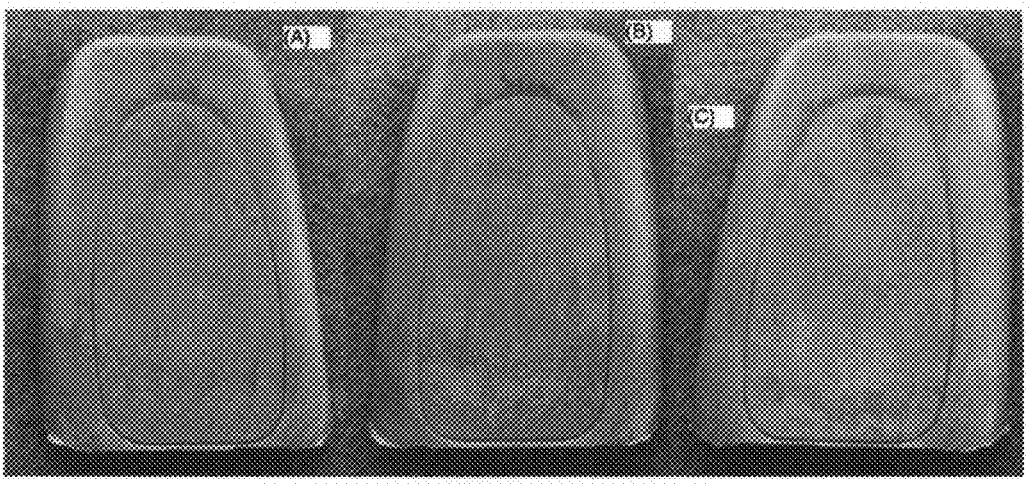
FIG. 35 is a photograph illustrating thin walled shape cast mobile electronic device covers produced from Al—Ni—Mn alloys after anodizing, and having a bright surface.

FIG. 35 is a photograph illustrating the various cell phone housings after anodizing. In FIG. 35, product (a) is that of the alloy cast at 1410° F., product (b) is that of alloy cast at 1445° F., and product (c) is that of a alloy cast at 1535° F. The castings illustrate that both alloy composition and melt temperature may affect surface defects and/or coloring. These examples illustrate that hypereutectic alloys cast closer to 1410° F. may provide a more uniform surface appearance.

Example 5

Castability of Al—Ni—Mn Alloys

Casting alloy A356 and an Al—Ni—Mn alloy having about 4 wt. % Ni and 2 wt. % Mn are tested for fluidity via spiral mold casting in accordance with Aluminum Foundry Society standards. The alloys are cast at about 180° F. (about 82.2° C.) above their liquidus temperature. Casting alloy A356 achieves a length of about 11 cm. The Al—Ni—Mn alloy achieves a length of about 14 cm, or a performance of about 27% better than the A356 alloy.

Casting alloys A380, A359 and an Al—Ni—Mn alloy having about 4 wt. % Ni and 2 wt. % Mn are tested for fluidity via spiral mold casting in accordance with Aluminum Foundry Society Standards. The alloys are all cast at the same melt temperature of 1250° F. (about 676.6° C.). Casting alloy A380 achieves an average length of about 8.5 cm, casting alloy A359 achieves an average length of about 10 cm, and the Al—Ni—Mn alloy achieves an average length of about 9.2 cm. The Al—Ni—Mn alloy has better fluidity than the A380 alloy and about the same fluidity of the A359 alloy.

Casting alloys A356, A359 and A380 and an Al—Ni—Mn alloy having about 4 wt. % Ni and 2 wt. % Mn are tested for their hot cracking tendency using a pencil probe test. All alloys achieves a hot cracking tendency of 2 mm, indicating that they have good castability.

Example 6

Grayness and Brightness of Alloys i. Testing in the as-Cast Condition

Three different alloys are cast as two thin walled shape cast products. The first product is produced from an Al—Ni alloy containing about 6.9 wt. % Ni. The second product is produced from an Al—Ni—Mn alloy containing about 7.1 wt. % Ni and about 2.9 wt. % Mn. The third product is produced from casting alloy A380. The as-cast products are subjected to color testing in accordance with CIELAB, and brightness testing in accordance with ISO 2469 and 2470 using a Color Touch PC, by TECHNIDYNE. The products containing the Al—Ni and Al—Ni—Mn alloys are less gray and are brighter than the Al—Si alloy A380, as illustrated in Tables 10 and 11, below.

TABLE 10

GRAYNESS OF SHAPE CAST PRODUCTS (AS-CAST CONDITION)

| Shape Cast Product | L-Value (ave.) | Improvement over A380 Product Units | Improvement over A380 Product Percent |
|---|---|---|---|
| Al—Ni Products | 68.45 | 9.81 | 16.7% |
| Al—Ni—Mn Product | 65.23 | 6.59 | 11.2% |
| Al—Si Product (A380) | 58.64 | — | — |

TABLE 11

BRIGHTNESS OF SHAPE CAST PRODUCTS (AS-CAST CONDITION)

| Shape Cast Product | ISO Brightness (ave.) | Improvement over A380 Product Units | Improvement over A380 Product Percent |
|---|---|---|---|
| Al—Ni Products | 39.45 | 11.14 | 39.4% |
| Al—Ni—Mn Product | 35.53 | 7.22 | 25.5% |
| Al—Si Product (A380) | 28.31 | — | — |

ii. Testing after Chemical Milling and Anodizing

Three different alloys are cast as thin walled shape cast products. The first product is produced from an Al—Ni alloy containing about 6.6 wt. % Ni. The second product is produced from an Al—Ni—Mn alloy containing about 6.9 wt. % Ni and about 2.9 wt. % Mn. The third product is produced from casting alloy A380. The shape cast products are subjected to chemical milling (etching) to remove about 0.008 inch (200 microns; 100 microns per side) of the outer surface of the cast products. The shape cast products are then polished, blasted with alumina, anodized to an oxide thickness of about 0.15 mil (about 3.8 microns), and then sealed. The anodized products are subjected to color testing in accordance with CIELAB and brightness testing in accordance with ISO 2469 and 2470 using a Color Touch PC, by TECHNIDYNE. The products containing the Al—Ni and Al—Ni—Mn alloys are less gray and are brighter than the Al—Si alloy A380, as illustrated in Tables 12-13, below. The products containing the Al—Ni and Al—Ni—Mn alloys also realize only a slight increase in grayness and a slight decrease in brightness relative to the as-cast condition.

TABLE 12

GRAYNESS OF SHAPE CAST PRODUCTS (ANODIZED CONDITION)

| Shape Cast Product | L-Value | Improvement over A380 Product Units | Improvement over A380 Product Percent |
|---|---|---|---|
| Al—Ni Products | 64.68 | 20.47 | 46.3% |
| Al—Ni—Mn Product | 59.15 | 14.94 | 33.8% |
| Al—Si Product (A380) | 44.21 | — | — |

TABLE 13

BRIGHTNESS OF SHAPE CAST PRODUCTS (ANODIZED CONDITION)

| Shape Cast Product | ISO Brightness | Improvement over A380 Product Units | Improvement over A380 Product Percent |
|---|---|---|---|
| Al—Ni Products | 31.91 | 19.65 | 160.3% |
| Al—Ni—Mn Product | 25.35 | 13.09 | 106.8% |
| Al—Si Product (A380) | 12.26 | — | — |

iii. Testing after Degreasing and Anodizing

Two different alloys are cast as thin walled shape cast products. The first product is produced from an Al—Ni—Mn alloy containing about 6.9 wt. % Ni and about 1.9 wt. % Mn. The second product is produced from casting alloy A380. The shape cast products are degreased and then anodized to have an oxide thickness of about 0.15 mil (about 3.8 micron), and then sealed. The anodized products are subjected to color testing in accordance with CIELAB, and brightness testing in accordance with ISO 2469 and 2470 using a Color Touch PC, by TECHNIDYNE. The product containing the Al—Ni—Mn alloy is less gray and is brighter than the Al—Si alloy A380, as illustrated in Tables 14 and 15, below. The product containing the Al—Ni—Mn alloy also realizes only a slight increase in grayness and a slight decrease in brightness relative to the as-cast condition.

TABLE 14

GRAYNESS OF SHAPE CAST PRODUCTS (ANODIZED CONDITION)

| Shape Cast Product | L-Value | Improvement over A380 Product Units | Improvement over A380 Product Percent |
|---|---|---|---|
| Al—Ni—Mn Product | 64.16 | 17.41 | 37.2% |
| Al—Si Product (A380) | 46.75 | — | — |

TABLE 15

BRIGHTNESS OF SHAPE CAST PRODUCTS (ANODIZED CONDITION)

| Shape Cast Product | ISO Brightness | Improvement over A380 Product Units | Improvement over A380 Product Percent |
|---|---|---|---|
| Al—Ni—Mn Product | 30.01 | 16.32 | 83.9% |
| Al—Si Product (A380) | 13.69 | — | — |

iv. Additional Testing of Low Ni Alloys in the as-Cast Condition

Various thin walled shape cast products are produced from two different low-Ni alloy types. The first set of products are produced from an Al—Ni—Mn alloy containing about 2.0 wt. % Ni and about 1.0 wt. % Mn. The second set of products are produced from an Al—Ni—Mn alloy containing about 3.0 wt. % Ni and about 2.0 wt. % Mn. The as-cast products (in the F temper) are subjected to mechanical testing in accordance with ASTM B557 and ASTM E23-07. The average results are provided in Table 16A, below.

TABLE 16A

MECHANICAL PROPERTIES OF LOW NI ALLOYS

| Shape Cast Product | TYS (MPa) | Impact Strength (Joules) |
|---|---|---|
| Al—2Ni—1Mn Product | 113 | 31 |
| Al—3Ni—2Mn Product | 166.5 | 27.5 |

These samples are also subject to color testing in accordance with CIELAB, and brightness testing in accordance with ISO 2469 and 2470 using a Color Touch PC, by TECHNIDYNE, as well as a comparative set of products from casting alloy A380. The products containing the Al—Ni—Mn alloys are less gray and are brighter than the Al—Si alloy A380, as illustrated in Table 16B, below.

TABLE 16B

| GRAYNESS AND BRIGHTNESS OF SHAPE CAST PRODUCTS (AS-CAST CONDITION) | | |
|---|---|---|
| Shape Cast Product | L-Value (ave) | ISO Brightness (ave) |
| Al—2Ni—1Mn Product | 59.2 | 27.3 |
| Al—3Ni—2Mn Product | 66.6 | 36.5 |
| Al—Si Product (A380) | 58.6 | 28.3 |

Example 7

Color Uniformity

Some of the above anodized products of Example 6 are subjected to color uniformity testing. A first reference area on a first surface portion of the shape cast product is chosen for a first CIELAB measurement. A second reference area on a second surface portion of the shape cast product is chosen for a second CIELAB measurement. Both the first and the second reference areas are circles having a diameter of approximately 0.5 inch. The two measured CIELAB values are compared to calculate the Delta-E relative to those portions of the shape cast products. The results are provided in Table 17, below.

TABLE 17

| COLOR UNIFORMITY OF SHAPE CAST PRODUCTS (ANODIZED CONDITION) | | | | | | |
|---|---|---|---|---|---|---|
| Shape Cast Product | Location | L-Value | a-Value | b-Value | ISO Brightness | Delta-E |
| Degreased and Anodized | | | | | | |
| Al—6.9Ni—1.9Mn Product | Area 1 | 64.16 | 0.28 | 4.62 | 30.01 | 0.24 |
| | Area 2 | 64.26 | 0.29 | 4.73 | 30.05 | |
| Al—Si Product (A380) | Area 1 | 47.06 | 0.80 | 5.42 | 13.88 | 6.37 |
| | Area 2 | 40.87 | 1.04 | 3.90 | 10.48 | |
| Chemical Milled (Etched) and Anodized | | | | | | |
| Al—6.6Ni Product | Area 1 | 65.45 | 0.09 | 2.78 | 32.76 | 0.37 |
| | Area 2 | 65.09 | 0.09 | 2.82 | 32.29 | |
| Al—6.9Ni—2.9Mn Product | Area 1 | 59.86 | 0.68 | 3.47 | 25.91 | 0.74 |
| | Area 2 | 59.19 | 0.59 | 3.18 | 25.38 | |
| Al—Si Product (A380-1) | Area 1 | 44.37 | 0.78 | 4.84 | 12.32 | 0.1 |
| | Area 2 | 44.3 | 0.76 | 4.9 | 12.26 | |

Figure 43A:
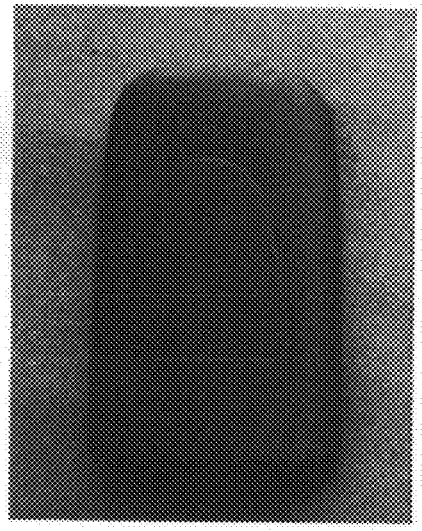
FIG. 43A is a photograph illustrating a thin walled shape cast mobile electronic device cover produced from an A380 alloy after anodizing and sealing.
Figure 43B:
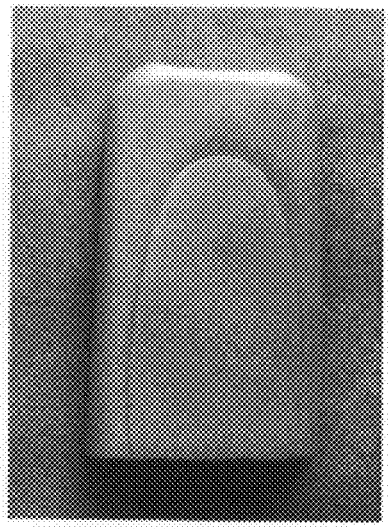
FIG. 43B is a photograph illustrating a thin walled shape cast mobile electronic device cover produced from an Al—Ni alloy after anodizing and sealing.

The L-value indicates the level of white-black (100=pure white, 0=pure black), the a-value indicate the level of red-green: (positive=red, negative=green), and the b-value indicates the level of yellow-blue (positive=yellow, negative=blue). In general, the intended viewing surfaces of the shape cast product produced from the Al—Ni and Al—Ni—Mn alloys have a better combination of brightness, grayness and color uniformity in the anodized condition than the shape cast products produced from the prior art A380 alloy. Furthermore, the intended viewing surfaces the shape cast products containing the A380 alloy include a plurality of visually apparent surface defects, whereas the intended viewing surfaces of the shape cast products containing the Al—Ni and Al—Ni—Mn alloys are substantially free of visually apparent surface defects, as illustrated in FIG. 43A (A380 product) and FIG. 43B (Al—Ni6.6 product).

Example 8

Production of Shape Cast Products Having a Matte Finish

Figure 36:
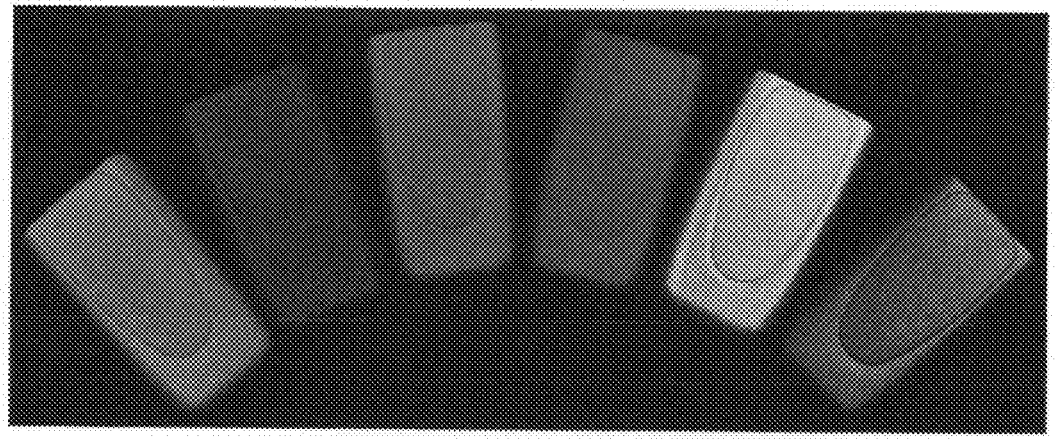
FIG. 36 is a photograph illustrating thin walled shape cast mobile electronic device covers produced from Al—Ni—Mn alloys after chemical etching, anodizing and dyeing.

An Al—Ni alloy is cast as a mobile electronic device cover. The Al—Ni alloy comprises about 6.6 wt. % Ni, about 0.07 wt. % Mn, about 0.04 wt. % Ti, and about 0.012 wt. % B, the balance being aluminum and impurities. The device cover has a nominal wall thickness of about 0.7 mm and is cast on a 250-tonne Toshiba HPDC press using a 2-cavity steel die. The microstructure of the as-cast Al—Ni alloy product has a relatively thin outer portion having alpha-alumina phase and a eutectic microstructure, and a second portion having a generally eutectic microstructure. The Al—Ni cast product is chemically etched via immersion in a 5% NaOH solution with a solution temperature of about 150° F. for about 18 minutes to remove about 200 microns (about 8 mils total), or 100 microns per side, which removes a significant amount of the outer portion of the original cast product having the alpha aluminum phase. The product is then mechanically polished to provide a smooth and mirrored surface, and then wiped clean via a MEK solution. The outer surface of the product is then blasted using alumina oxide at substantially normal angle (about perpendicular), at a distance of from about 6 to about 9 inches, and at pressure of from about 20 to about 40 psi. The product is then cleaned with a A31K, non-etching alkaline cleaner, at about 150° F. for about 2 minutes. The product is then chemically polished via DAB80, a phosphoric acid (about 85%) and nitric acid (about 2%) solution, at about 220° F. for about 40 seconds. The product is then anodized in an approximately 20% sulfuric acid bath for about 9 minutes, at a current density of about 12 ASF and a temperature of about 70° F., which produces a uniform Al—O—S zone (oxide layer) having a thickness of from about 2.5 microns to about 4 microns. The Al—O—S zone of the cast product is a bit smaller than normal Type II anodized cast products so as to facilitate a brighter end appearance. The product is then immersed in a color-specific Clariant dye (e.g., pink, blue, red, silver) for about 3 minutes, with a solution temperature of about 140° F. The product is then sealed in an aqueous salt solution for about 10 minutes at a solution temperature of about 190° F. The final product has a bright matte finish that meets consumer acceptance standards. The process is repeated with various other Al—Ni cast mobile electronic device covers, but with different dye colors. FIG. 36 is a photograph illustrating the produced mobile device covers, all having a bright matte finish that is substantially free of visually apparent surface defects.

Figure 41A:
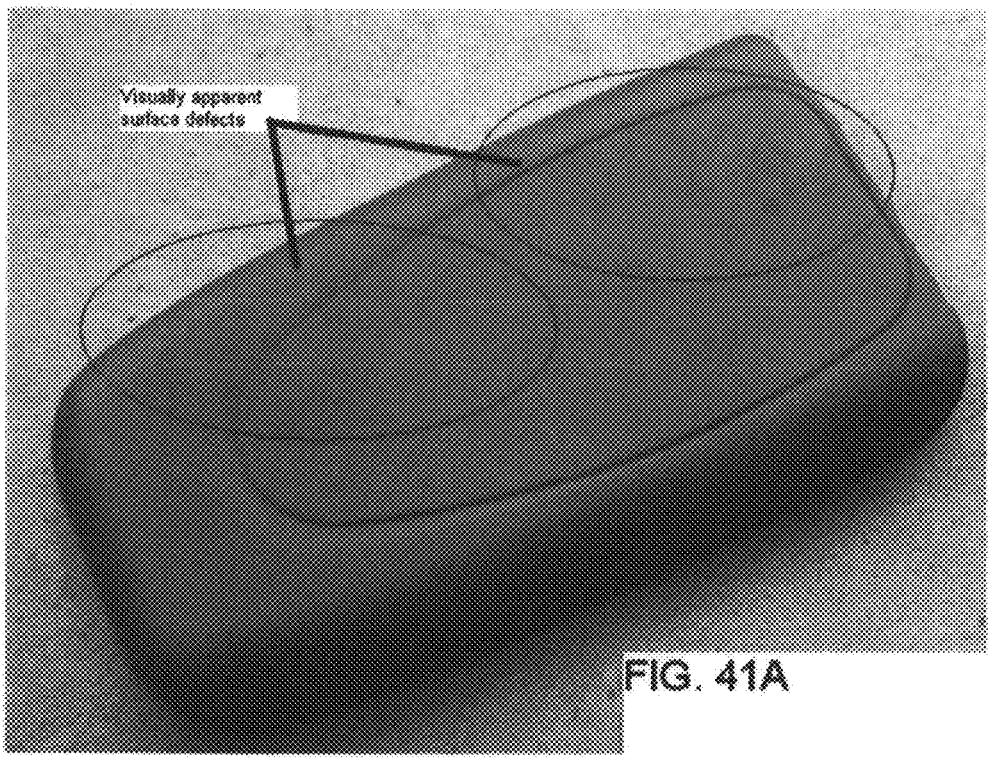
FIG. 41A is a photograph illustrating a thin walled shape cast mobile electronic device cover produced from an Al—Ni—Mn alloy, where the finishing process included texturizing, chemical polishing, anodizing, dyeing and sealing.
Figure 41B:
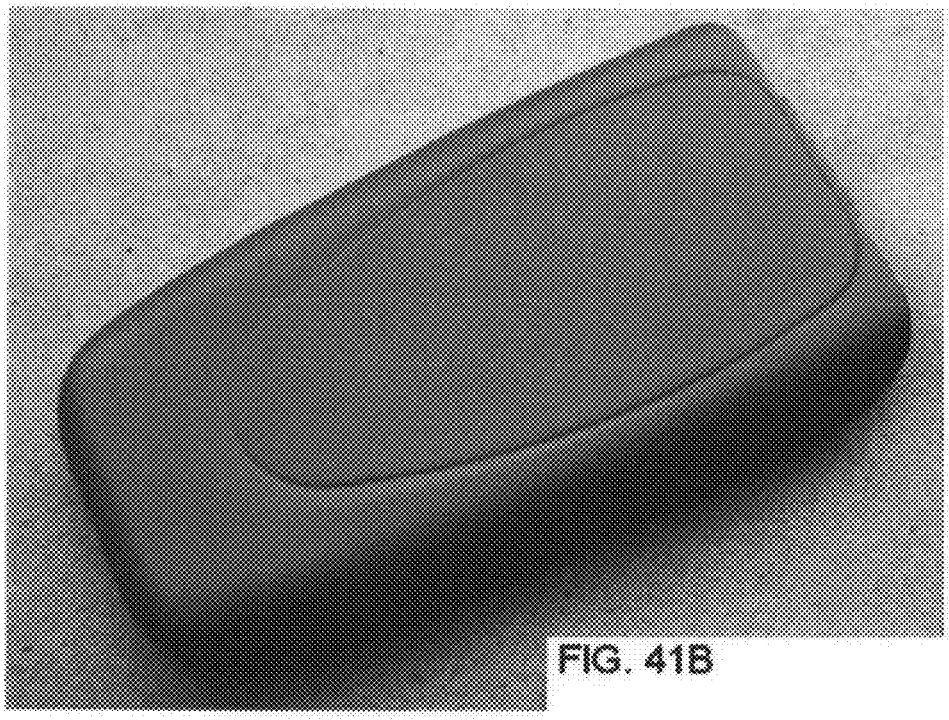
FIG. 41B is a photograph illustrating a thin walled shape cast mobile electronic device cover produced from an Al—Ni—Mn alloy, where the finishing process included chemical etching, mechanical polishing, texturizing, chemical polishing, anodizing, dyeing and sealing.

Two Al—3Ni-2Mn alloys are produced similar to as provided above, except that the first product is not chemically etched or mechanically polished. Both products are dyed in a red Clariant dye. As illustrated in FIGS. 41A and 41B, the product that is subjected to chemical etching contains only a minor amount of visually apparent surface defects (FIG. 41B), whereas the products that is not chemically etched contains a significant amount of visually apparent surface defects (FIG. 41A).

Example 9

Production of shape cast product having a glossy finish

Figure 37:
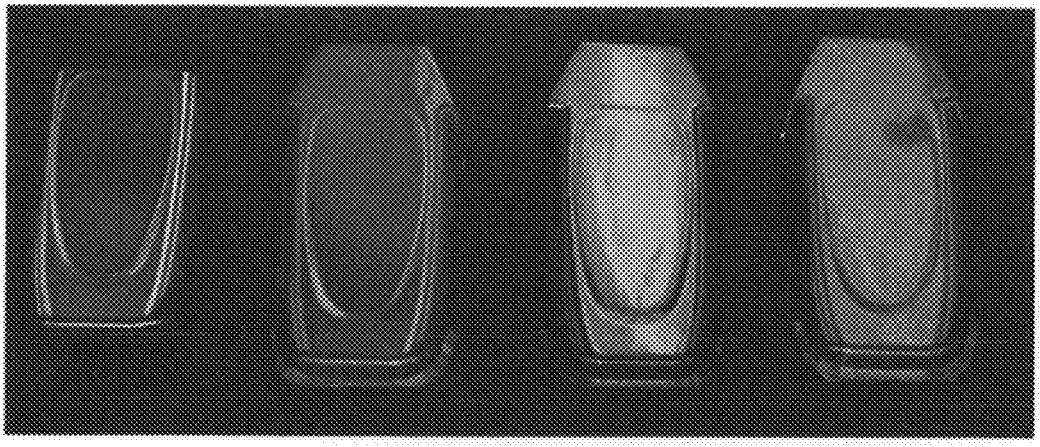
FIG. 37 is a photograph illustrating thin walled shape cast mobile electronic device covers produced from Al—Ni—Mn alloys after anodizing and application of a silicon polymer coating.

An Al—Ni—Mn alloy is shape cast as a mobile electronic device cover. The Al—Ni—Mn alloy comprises about 7.1 wt. % Ni, about 2.8 wt. % Mn, about 0.02 wt. % Ti and less than about 0.01 wt. % B, the balance being aluminum and impurities. The device cover has a nominal wall thickness of about 0.7 mm and is cast on a 250-tonne Toshiba HPDC press using a 2-cavity steel die. The cast product is mechanically polished to provide a smooth and mirrored surface, which is then wiped clean via a MEK solution. The product is then cleaned with A31K, a non-etching alkaline cleaner, at about 150° F. for about 2 minutes. The product was is then anodized in an approximately 20% phosphoric acid bath for about 10 seconds, at a voltage of about 15 volts, and a temperature of about 90° F., which produces an Al—O—P zone (oxide layer) having a thickness of only several angstroms. A PPG CERANOSHIELD coating of a tinted color is applied to the product, which is then UV cured. The applied coating has a thickness in the range of from about 7.0 microns to about 18 microns. The final product has a lustrous, glossy finish that meets consumer acceptance standards and the coating is adherent to the surface of the cast product. The process is repeated with various other Al—Ni—Mn cast mobile electronic device covers, but with different colors. FIG. 37 is a photograph illustrating the produced mobile device covers, all having a lustrous, glossy finish that is substantially free of visually apparent surface defects and the coating is adherent to the outer surface of the cast product.

Figure 42A:
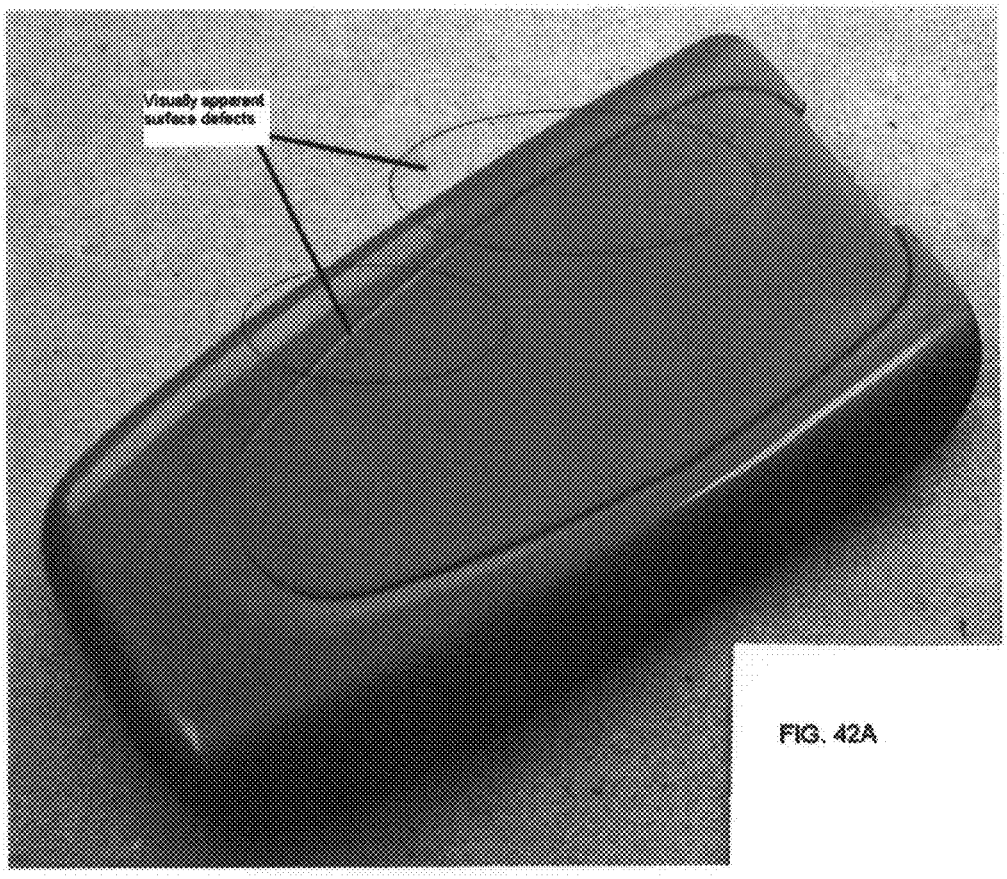
FIG. 42A is a photograph illustrating a thin walled shape cast mobile electronic device cover produced from an Al—Ni—Mn alloy, where the finishing process included mechanical polishing, anodizing, and coating.
Figure 42B:
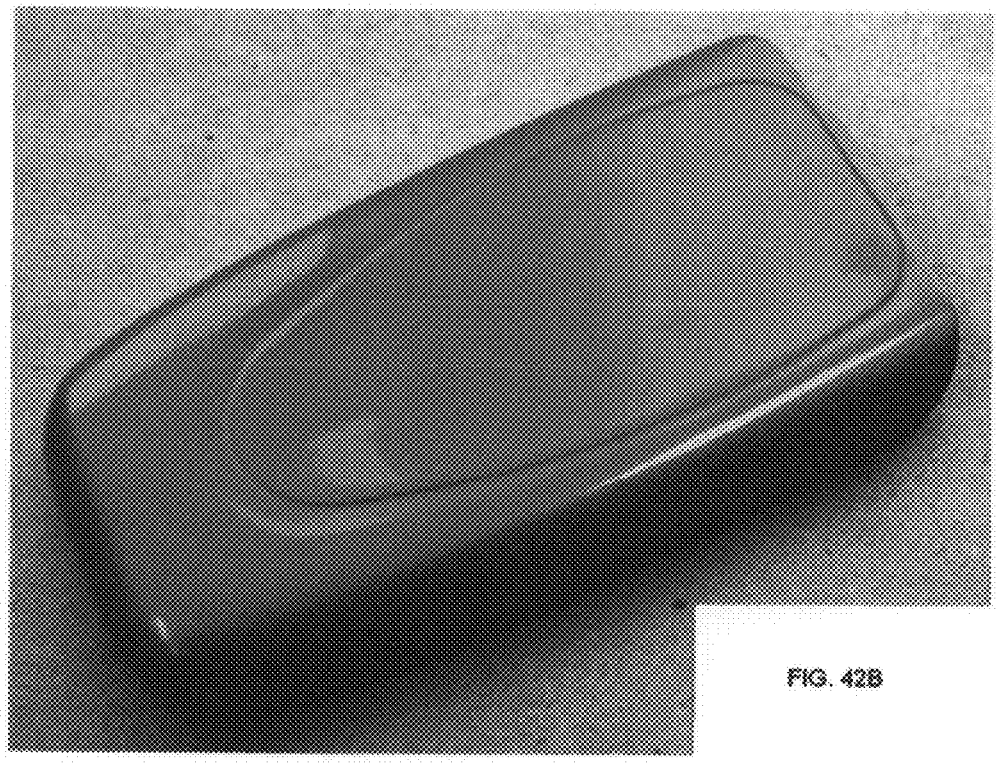
FIG. 42B is a photograph illustrating a thin walled shape cast mobile electronic device cover produced from an Al—Ni—Mn alloy, where the finishing process included chemical etching, mechanical polishing, anodizing, and coating.

Two Al—3Ni-2Mn alloys are produced similar to as provided above, except that the first product is not chemically etched or mechanically polished. Both products are coated with a red silicon polymer coating. As illustrated in FIGS. 42A and 42B, the product that is subjected to chemical etching is substantially free of visually apparent surface defects (FIG. 42A), whereas the products that is not chemically etched contains visually apparent surface defects (FIG. 42B).

Example 10

Production of Shape Cast Product Having a Marbled Finish

Figure 38:
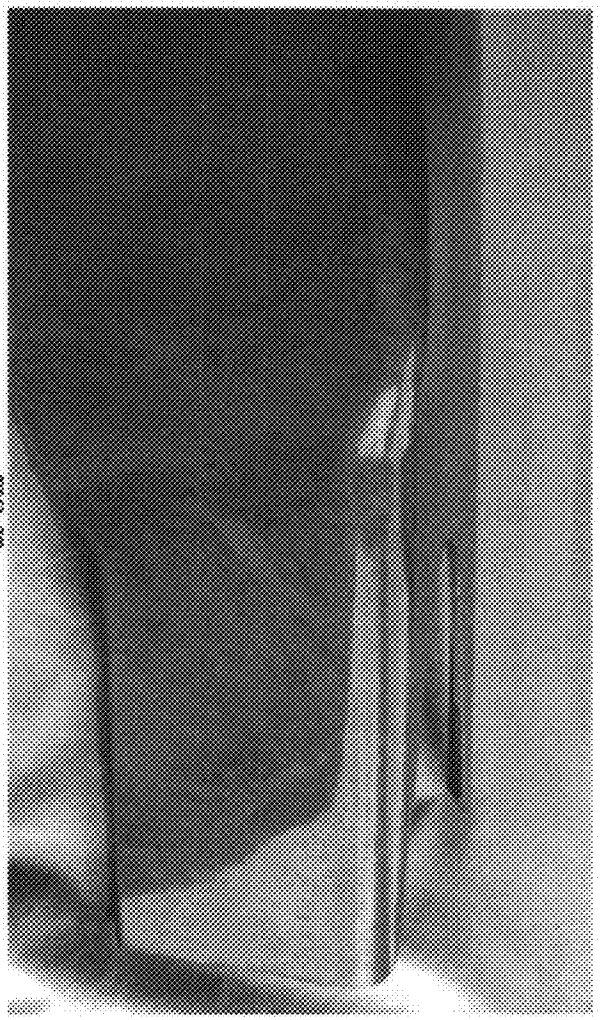
FIG. 38 is a photograph illustrating a thick wall shape cast automobile part produced from an Al—Ni—Mn alloy after anodizing and dyeing and having a marbled finish.

An Al—Ni—Mn alloy is cast as an automobile part. The Al—Ni—Mn alloy comprises about 4.0 wt. % Ni, about 2.0 wt. % Mn, about 0.06 wt. % Ti and about 0.02 wt. % B, the balance being aluminum and impurities. The automobile part has a nominal wall thickness of about 3.5 mm and is cast on a 750-tonne Mueller-Weingarten HPDC press with a modified Vacural processing using a 1-cavity steel die. The product is then mechanically polished to provide a smooth and mirrored surface, which is then wiped clean via a MEK solution. The product is then cleaned with A31K, a non-etching alkaline cleaner, at about 150° F. for about 2 minutes. The product is then anodized in an approximately 20% sulfuric acid bath for about 20 minutes, at a current density of about 36 ASF and a temperature of about 45° F., which produces a uniform Al—O—S zone (oxide layer) having a thickness of about 17.5 microns. The product is then immersed in an Okuno Blue TAC dye for about 10 minutes, with a solution temperature of about 140° F. The product is then sealed in an aqueous salt solution for about 10 minutes at a solution temperature of about 190° F. The product is then mechanically polished to a high gloss. The final product has a bright, marbled finish that is substantially free of visually apparent surface defects. FIG. 38 is a photograph illustrating the produced marble automobile part.

Example 11

Casting of a Mobile Electronic Device Cover

Four mobile electronic device covers are shape cast using an Al-6.7Ni-2.2—Mn casting alloy at various injection velocities and using a tangential gate configuration. The shape cast devices are then degreased and Type II anodized. Alloy 4, which had the highest injection velocity at 2.7-2.9 m/s, achieves the best appearance, having only minor visually apparent surface defects, whereas the parts made with the lower injection velocity have significantly more visually apparent surface defects.

Additional various Al—Ni and Al—Ni—Mn alloys are die cast into shape cast mobile electronic device covers. The operating parameters for casting these alloys are provided in Table 18, below.

TABLE 18

Operating parameters for casting Al—Ni and Al—Ni—Mn alloys

| Parameter | Typical value |
|---|---|
| First phase piston velocity (e.g., slow shot) | ~0.85 m/s to 0.90 m/s |
| Second phase initiation | ~−50 mm to −65 mm |
| Piston diameter | ~40 mm |
| Fast shot piston velocity (e.g., fast shot) | ~2.60 m/s to 2.70 m/s |
| Shot sleeve percent fill | ~25% |
| Melt temperature | ~771° C. for Al—Ni<br>~782° C. for Al—Ni—Mn |
| Die insert temperature | 260° C.-282° C. |

Figure 22A:
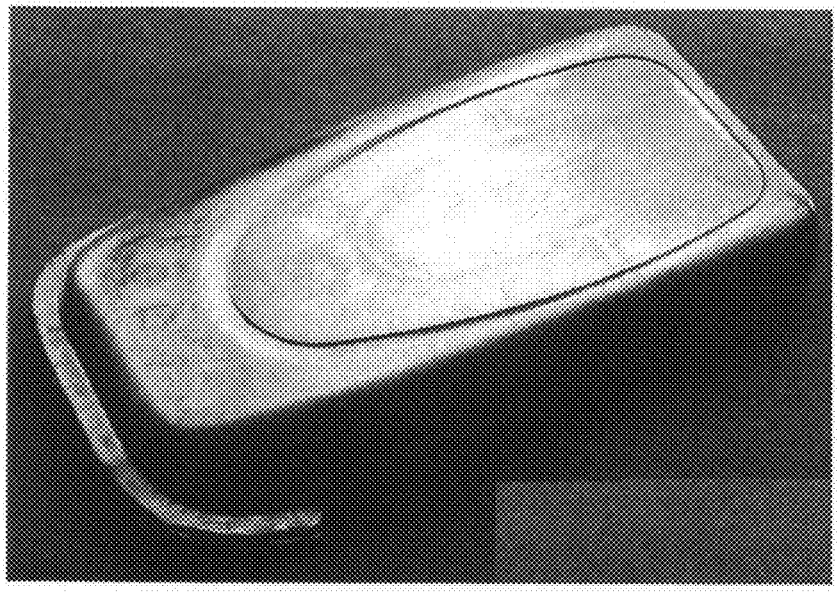
FIGS. 22A-22B are perspective and top-down photographs, respectively, of an as-cast product produced using a fan gate configuration in accordance with the present disclosure.
Figure 22B:
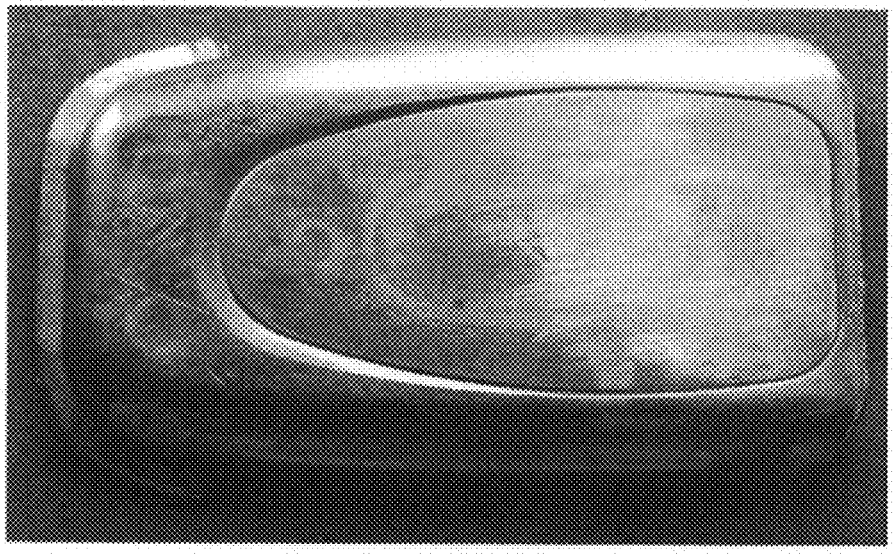
Figure 22C:
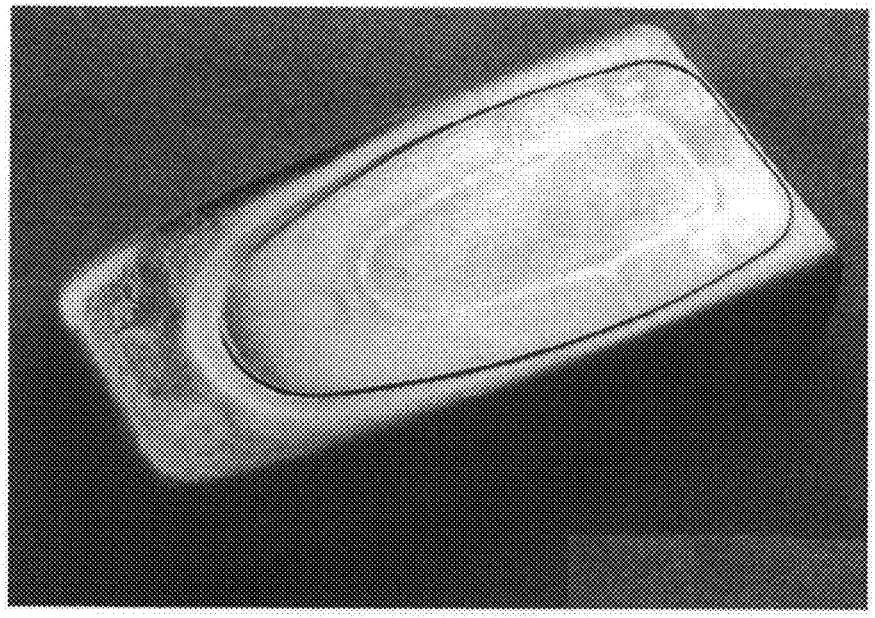
FIGS. 22C-22D are perspective and top-down photographs, respectively, of an as-cast product produced using a tangential gate configuration in accordance with the present disclosure.
Figure 22D:
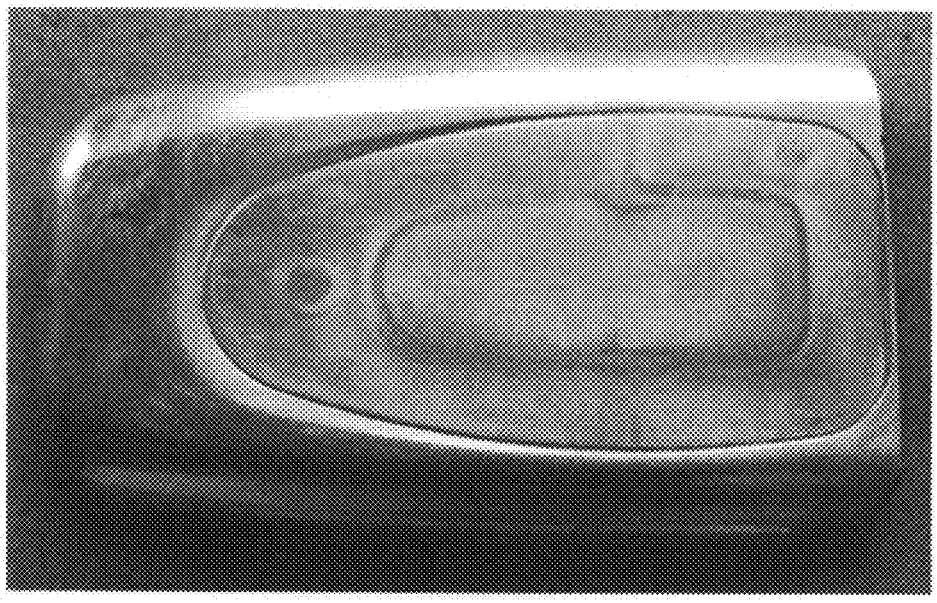

FIGS. 22A-22B are perspective and top-down photographs, respectively, of an as-cast product produced from an Al—Ni alloy containing about 6.6 wt. % Ni using a fan gate configuration in accordance with the operating parameters of Table 18. FIGS. 22C-22D are perspective and top-down photographs, respectively, of an as-cast product produced from an Al—Ni alloy containing about 6.8 wt. % Ni using a tangential gate configuration in accordance with the operating parameters of Table 18. As shown in these photographs, features including the likes of runners and gate lands, among others, have been trimmed and/or removed.

Figure 22E:
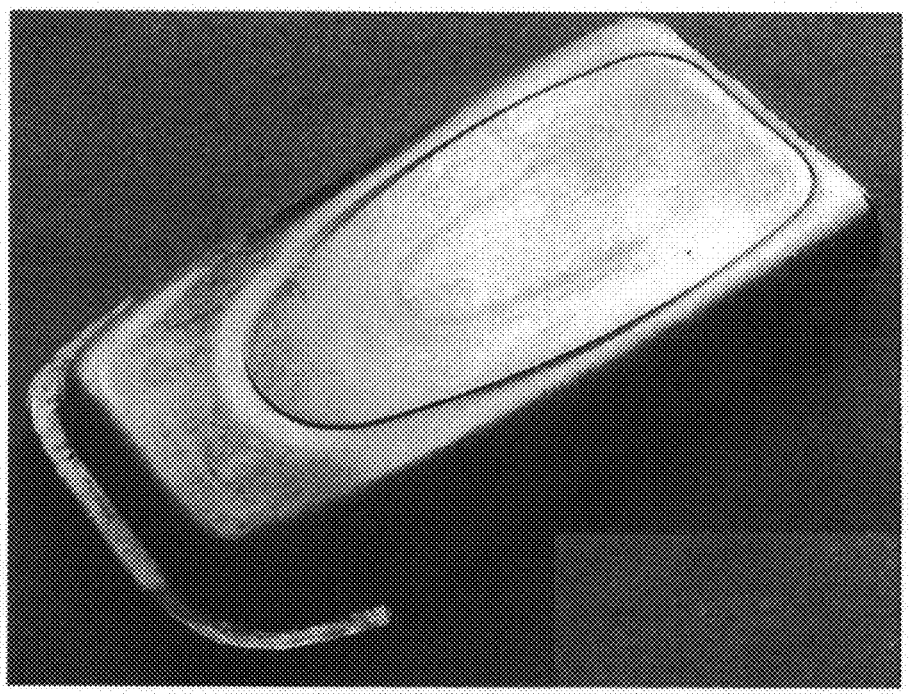
FIGS. 22E-22F are perspective and top-down photographs, respectively, of an as-cast product produced using a fan gate configuration in accordance with the present disclosure.
Figure 22F:
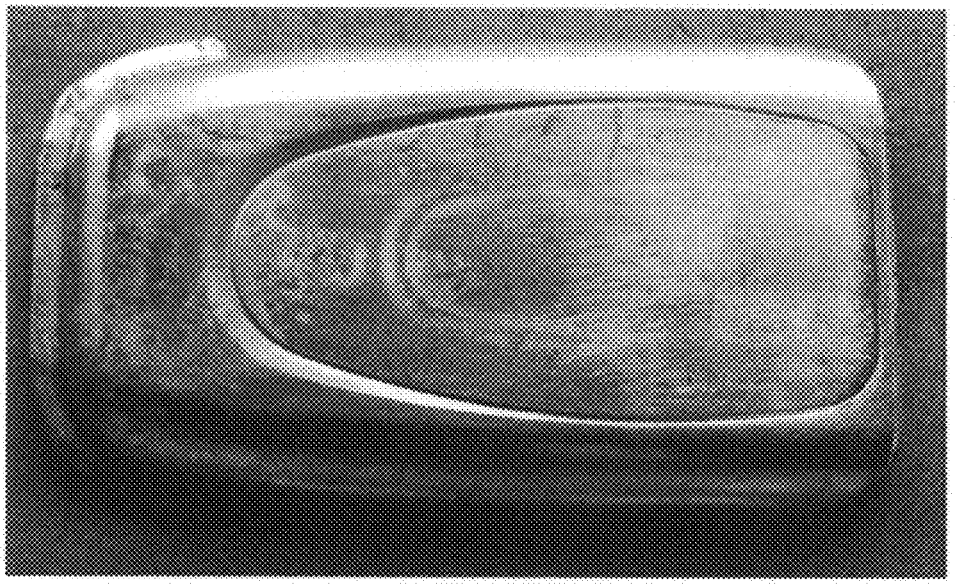
Figure 22G:
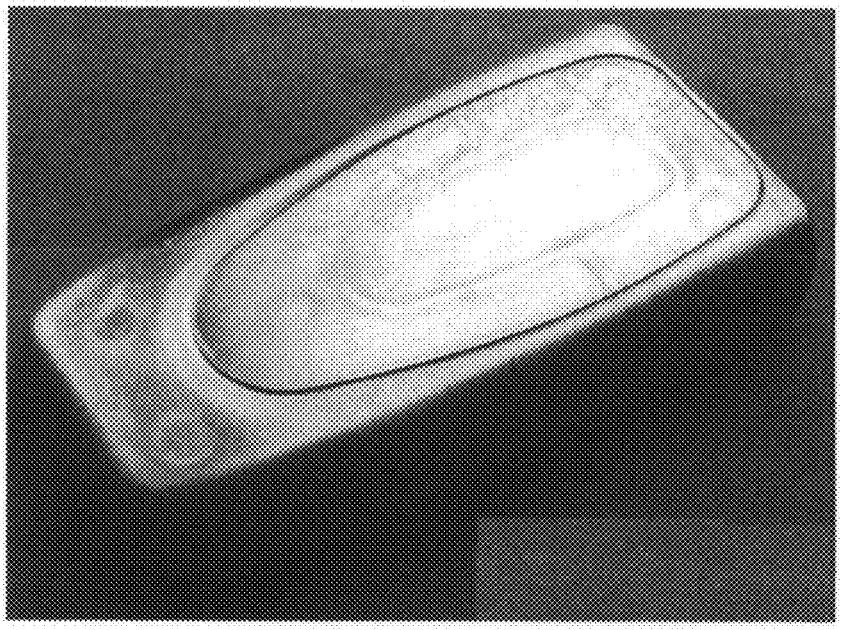
FIGS. 22G-22H are perspective and top-down photographs, respectively, of an as-cast product produced using a tangential gate configuration in accordance with the present disclosure.
Figure 22H:
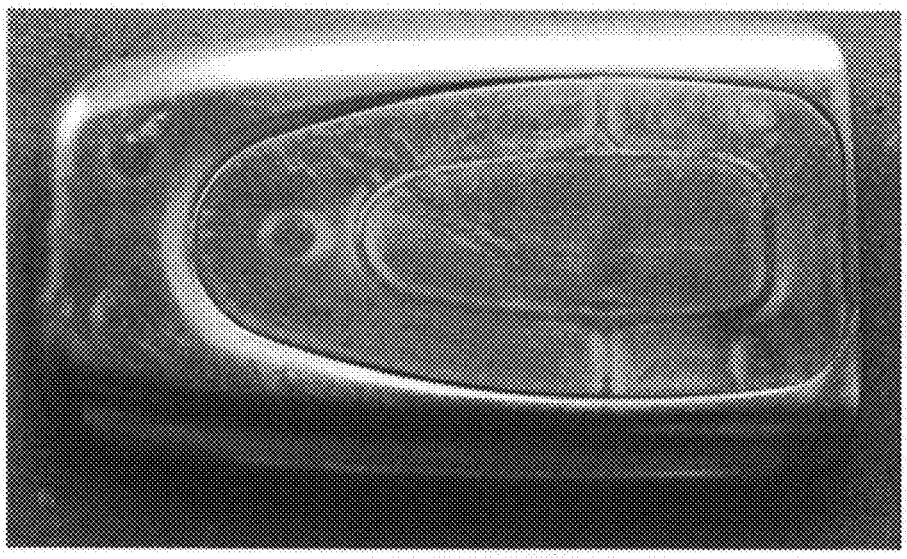

FIGS. 22E-22F are perspective and top-down photographs, respectively, of an as-cast product produced from an Al—Ni—Mn alloy containing about 6.8 wt. % Ni and about 2.8 wt. % Mn using a fan gate configuration in accordance with the operating parameters of Table 18. FIGS. 22G-22H are perspective and top-down photographs, respectively, of an as-cast product produced from an Al—Ni—Mn alloy containing about 7.1 wt. % Ni and about 2.9 wt. % Mn using a tangential gate configuration in accordance with the operating parameters of Table 18. Like above, features including the likes of runners and gate lands, among others, have been trimmed and/or removed from these as-cast products.

These FIGS. 22A-22H illustrate that thin walled shape cast aluminum alloy products without major defects may be successfully cast, and using the fan gate or tangential gate configurations. For products intended to be substantially free of visually apparent surface defects, a tangential gate configuration may be useful. For products intended to have a marbled appearance, a fan gate configuration may be useful. For the as-cast products of FIGS. 20A-20B and 22A-22H, any scratches, discolorations or color changes are typical characteristics of an as-cast part in its as-cast condition, and are not considered to be surface defects. For example, the color change visible on the part in FIG. 22B is a characteristic of the casting process, most likely as a result of change in solidification rate due to the screw boss and/or rib features on the opposite side of the part. In general, the parts as shown in FIGS. 20A-20B and 22A-22H may result in the production of consumer electronics parts that are substantially free of visually apparent surface defects after having been subjected to an appropriate finishing process, as illustrated in FIGS. 36-37, even though the parts in their as-cast condition may show minor scratches, discolorations and/or color changes, among other casting characteristics.

Figure 39A:
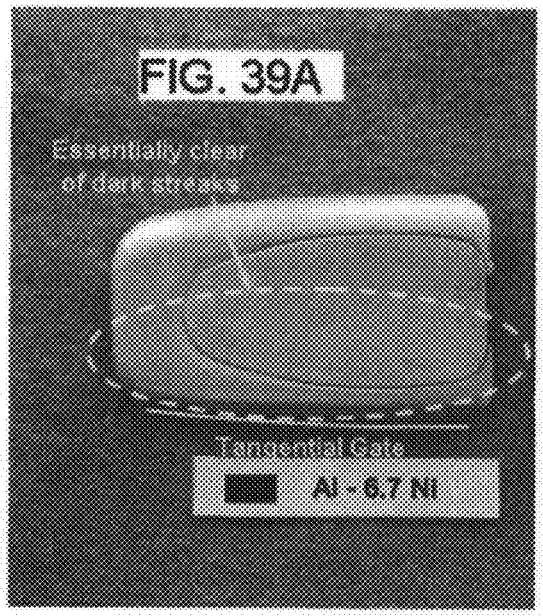
FIG. 39A is a photograph illustrating a thin walled shape cast mobile electronic device cover produced from an Al—Ni alloy and a die casting using a tangential gate configuration, after degreasing and anodizing.
Figure 39B:
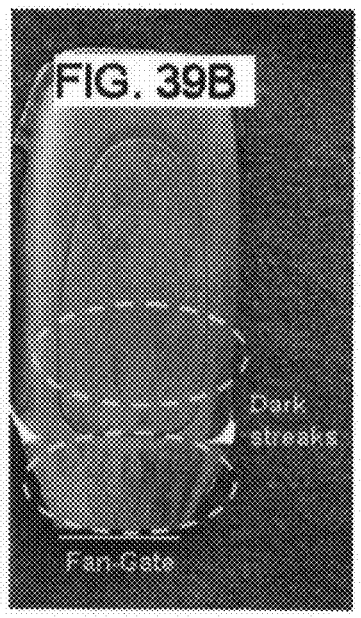
FIG. 39B is a photograph illustrating a thin walled shape cast mobile electronic device cover produced from an Al—Ni alloy and a die casting using a fan gate configuration, after degreasing and anodizing.
Figure 40A:
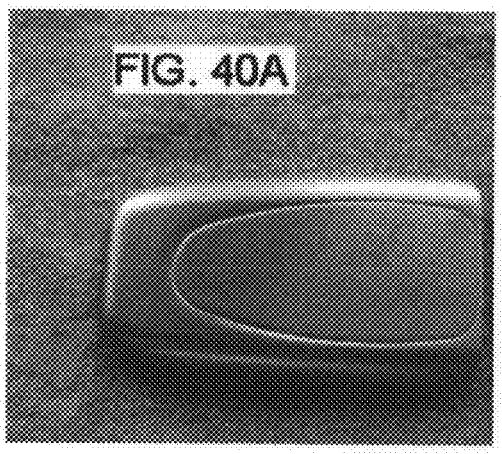
FIG. 40A is a photograph illustrating a thin walled shape cast mobile electronic device cover produced from an Al—Ni alloy and a die casting using a tangential gate configuration, after degreasing, anodizing and coloring.
Figure 40B:
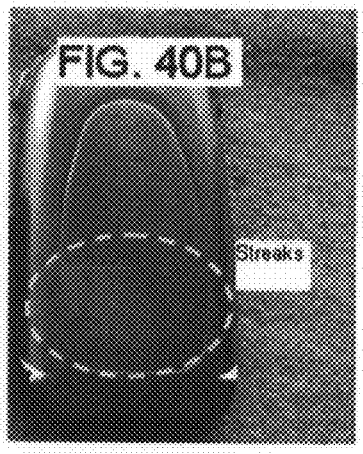
FIG. 40B is a photograph illustrating a thin walled shape cast mobile electronic device cover produced from an Al—Ni alloy and a die casting using a fan gate configuration, after degreasing, anodizing and coloring.

Two shape cast Al-6.7Ni alloys are produced using casting parameters similar to those provided in Table 18, above, but one with a fan gate configuration and the other with a tangential gate configuration. Both products are then degreased, anodized and sealed. The shape cast product produced with the tangential gate configuration realizes substantially less surface defects that the product produced with the fan gate configuration. This is illustrated in FIGS. 39A (tangential gate configuration) an FIG. 39B (fan gate configuration). Two similar products (one tangential gate and one fan gate) are finished by chemical etching, anodizing, dyeing and mechanical polishing. Even after finishing, visually apparent surface defects may be seen in the product produced from the fan gate configuration, whereas the shape cast product produced with the tangential gate configuration realizes substantially less surface defects. This is illustrated in FIG. 40A (tangential gate configuration) and FIG. 40B (fan gate configuration).

While various embodiments of the present disclosure have been described in detail, it is apparent that modifications and adaptations of those embodiments will occur to those skilled in the art. However, it is to be expressly understood that such modifications and adaptations are within the spirit and scope of the present disclosure.

What is claimed is:

1. A method comprising:

(a) selecting a product application for a shape cast aluminum alloy product;

(b) selecting a finishing style for the shape cast aluminum alloy product;

wherein the finishing style includes a visually apparent defect free surface;

(c) selecting, based on at least one of steps (a) and (b):

(i) a predetermined microstructure of the shape cast aluminum alloy product;

wherein the predetermined microstructure comprises a layered microstructure, wherein the layered microstructure comprises an outer layer having alpha aluminum phase and eutectic microstructure; and (ii) an alloy for use in producing the shape cast aluminum alloy product, wherein the alloy is one of:

(A) an Al—Ni casting alloy comprising from about 0.5 wt. % to about 8.0 wt. % Ni; and (B) an Al—Ni—Mn casting alloy comprising from about 0.5 wt. % to about 8.0 wt. % Ni and from about 0.5 wt. % to about 3.5 wt. % Mn;

(d) producing the shape cast aluminum alloy product in response to the selection step (c), wherein the producing comprises:

(i) die casting the shape cast aluminum alloy product from either the Al—Ni or the Al—Ni—Mn alloy;

wherein the shape cast aluminum alloy product realizes the layered microstructure, wherein the outer layer has a thickness of not greater than about 400 microns;

(ii) removing at least a portion of the outer layer from the shape cast aluminum alloy product; and (iii) anodizing the shape cast aluminum alloy product, wherein the anodizing comprises forming a uniform oxide layer from a portion of the shape cast aluminum alloy product;

wherein after the anodizing step (iii), the shape cast aluminum alloy product realizes both (A) a CIELAB L-value of at least about 55 and (B) an ISO brightness of at least about 20.

2. The method of claim 1, wherein after the anodizing step (iii), the shape cast aluminum alloy product realizes a Delta-E of not greater than about 5.0.

3. The method of claim 1, wherein the selecting step (c) comprises selecting a hypereutectic alloy composition.

4. The method of claim 3, wherein the alloy is the Al—Ni—Mn alloy.

5. The method of claim 3, wherein the uniform oxide layer is associated with an intended viewing surface of the product, wherein the method comprises:

applying a colorant to at least a portion of the uniform oxide layer, wherein after the applying step, the intended viewing surface of the shape east aluminum alloy product has a Delta-E of not greater than about 5.0 due to, at least in part, the uniformity of the oxide layer, and wherein the intended viewing surface is substantially free of visually apparent surface defects.

6. A method comprising:

(a) selecting a product application for a shape cast aluminum alloy product;

(b) selecting a finishing style for the shape cast aluminum alloy product;

wherein the finishing style is a marbled surface;

(c) selecting, based on at least one of steps (a) and (b):

(i) a predetermined microstructure of the shape cast aluminum alloy product;

wherein the predetermined microstructure comprises a layered microstructure, wherein the layered microstructure comprises an outer layer having a fairly regular distribution of alpha aluminum phase and eutectic microstructure; and (ii) an alloy for use in producing the shape cast aluminum alloy product, wherein the alloy is one of:

(A) an Al—Ni casting alloy comprising from about 0.5 wt. % to about 8.0 wt. % Ni; and (B) an Al—Ni—Mn casting alloy comprising from about 0.5 wt, % to about 8.0 wt. % Ni and from about 0.5 wt. % to about 3.5 wt. % Mn; and (d) producing the shape cast aluminum alloy product in response to the selection step (c), wherein the producing comprises:

(i) die casting the shape cast aluminum alloy product having the layered microstructure from either the Al—Ni or the Al—Ni—Mn alloy;

(ii) anodizing the shape cast aluminum alloy product, wherein the anodizing comprises forming a uniform oxide layer from a portion of the shape cast aluminum alloy product; and (iii) applying a colorant to the uniform oxide layer, wherein, after the applying step, the shape cast aluminum alloy product realizes a marbled intended viewing surface due, at least in part, to the alpha aluminum phase and eutectic microstructure;

wherein after the anodizing step (ii), the shape cast aluminum alloy product realizes both (A) a CIELAB L-value of at least about 55 and (B) an ISO brightness of at least about 20.

7. The method of claim 6, wherein the selecting step (c) comprises selecting a hypoeutectic alloy composition.

8. The method of claim 7, wherein the alloy is the Al—Ni—Mn alloy.

* * * * *